US007496301B2

(12) United States Patent
Kamimura

(10) Patent No.: US 7,496,301 B2
(45) Date of Patent: Feb. 24, 2009

(54) IMAGE FORMING DEVICE AND CARTRIDGE WITH DEVELOPER DETECTION

(75) Inventor: Naoya Kamimura, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 145 days.

(21) Appl. No.: 11/258,928

(22) Filed: Oct. 27, 2005

(65) Prior Publication Data

US 2006/0093385 A1 May 4, 2006

(30) Foreign Application Priority Data

Oct. 29, 2004 (JP) ..... 2004-317221

(51) Int. Cl.
*G03G 15/08* (2006.01)

(52) U.S. Cl. ..... 399/27; 399/111

(58) Field of Classification Search ..... 399/27, 399/64, 111, 119, 120
See application file for complete search history.

(56) References Cited

U.S. PATENT DOCUMENTS

| | | | | |
|---|---|---|---|---|
| 5,036,358 | A * | 7/1991 | Yoshida | 399/64 |
| 5,923,918 | A * | 7/1999 | Nakagawa et al. | 399/27 |
| 6,337,956 | B1 | 1/2002 | Sato et al. | |
| 2001/0014226 | A1* | 8/2001 | Sakurai et al. | 399/27 |
| 2004/0001723 | A1* | 1/2004 | Ashida et al. | 399/27 |
| 2005/0117919 | A1* | 6/2005 | Ito et al. | 399/27 |

FOREIGN PATENT DOCUMENTS

| | | | |
|---|---|---|---|
| EP | 1 462 870 | | 9/2004 |
| JP | 5165331 | | 7/1993 |
| JP | 10-142885 | | 5/1998 |
| JP | 11-143205 | A * | 5/1999 |
| JP | 11133810 | | 5/1999 |
| JP | 2000258984 | | 9/2000 |
| JP | 2000305347 | | 11/2000 |
| JP | 2000347494 | | 12/2000 |
| JP | 2000356901 | | 12/2000 |
| JP | 2003-323035 | A * | 11/2003 |

OTHER PUBLICATIONS (EP 05 02 3561) European Search Report dated Jan. 30, 2006.

* cited by examiner

*Primary Examiner*—Sophia S Chen
(74) *Attorney, Agent, or Firm*—Banner & Witcoff, Ltd.

(57) ABSTRACT

An image-forming device has a developer-accommodating section and a residual toner detecting unit. The developer-accommodating section accommodates a developer. The developer-accommodating section defines a plurality of detection light transmitting points through which a detection light is transmitted to detect an amount of developer accommodated in the developer-accommodating section. The residual toner detecting unit has a light-emitting unit that irradiates a detection light through one of the detection light transmitting points and a light-receiving unit that receives the detection light that has passed through the subject one detection light transmitting point.

20 Claims, 29 Drawing Sheets

IMAGE FORMING DEVICE AND CARTRIDGE WITH DEVELOPER DETECTION

BACKGROUND OF THE INVENTION

1. Field of the Invention

The present invention relates to an image-forming device such as a laser printer, and a cartridge detachably mounted in the image-forming device.

2. Description of the Related Art

Some conventional electrophotographic image-forming devices such as laser printers include a developer cartridge that is detachably mounted in the image-forming device. A toner-accommodating chamber for accommodating toner is formed in the developer cartridge. In this type of image-forming device, the developer cartridge is replaced when the toner accommodated in the toner-accommodating chamber has been consumed. To this end, the image-forming device includes a residual toner detecting device for detecting the amount of toner remaining in the toner-accommodating chamber.

One such residual toner detecting device for an image-forming device has been proposed in U.S. Pat. No. 6,337,956. This image-forming device includes a developing device having a toner-accommodating chamber. Light-transmitting windows are provided on both side walls of the chamber in the widthwise direction. The residual toner detecting device includes a light-emitting element and a light-receiving element disposed so that the optical axis of light emitted from the light-emitting unit passes through the light-transmitting windows in both side walls of the toner-accommodating chamber.

In this conventional image-forming device, the residual toner detecting device determines the amount of residual toner in the toner-accommodating chamber with the light-emitting element and the light-receiving element disposed in opposition to each other on opposite sides of the toner-accommodating chamber to detect whether a detection light emitted from the light-emitting element passes through the toner-accommodating chamber and is received by the light-receiving element.

SUMMARY OF THE INVENTION

However, in this residual toner detecting device, the detection light emitted from the light-emitting element to be received by the light-receiving element always passes through one specific point in the toner-accommodating chamber. Since the detection light only passes through this specific point, incorrect detections readily occur if an abnormal condition arises in that specific spot. When such an abnormality occurs, the amount of residual toner cannot be determined accurately.

In view of the foregoing, it is an object of the present invention to provide an image-forming device capable of accurately detecting and determining the amount of developer remaining in a developer-accommodating section. It is another object of the present invention to provide a cartridge that is mounted in the image-forming device.

In order to attain the above and other objects, the present invention provides an image-forming device, including: a developer-accommodating section; and a residual toner detecting unit. The developer-accommodating section accommodates a developer. The developer-accommodating section defines a plurality of detection light transmitting points through which a detection light is transmitted to detect an amount of developer accommodated in the developer-accommodating section. The residual toner detecting unit has a light-emitting unit that irradiates a detection light through one of the detection light transmitting points and a light-receiving unit that receives the detection light that has passed through the subject one detection light transmitting point.

According to another aspect, the present invention provides a cartridge that can be detachably mounted in an image-forming device. The image-forming device is capable of outputting a detection light at a plurality of different positions for detecting the amount of developer accommodated in the cartridge. The cartridge includes a developer-accommodating section that accommodates developer. The developer-accommodating section defines a plurality of detection light transmitting points corresponding to the positions, at which the image-forming device outputs the detection light, to transmit the detection light.

BRIEF DESCRIPTION OF THE DRAWINGS

The particular features and advantages of the invention as well as other objects will become apparent from the following description taken in connection with the accompanying drawings, in which:

FIG. 15(*b*) is a perspective view of the developer cartridge and showing the details of an agitator;

DETAILED DESCRIPTION OF THE PREFERRED EMBODIMENTS

An image forming device according to the preferred embodiments of the invention will be described with reference to the accompanying drawings.

Figure 1:
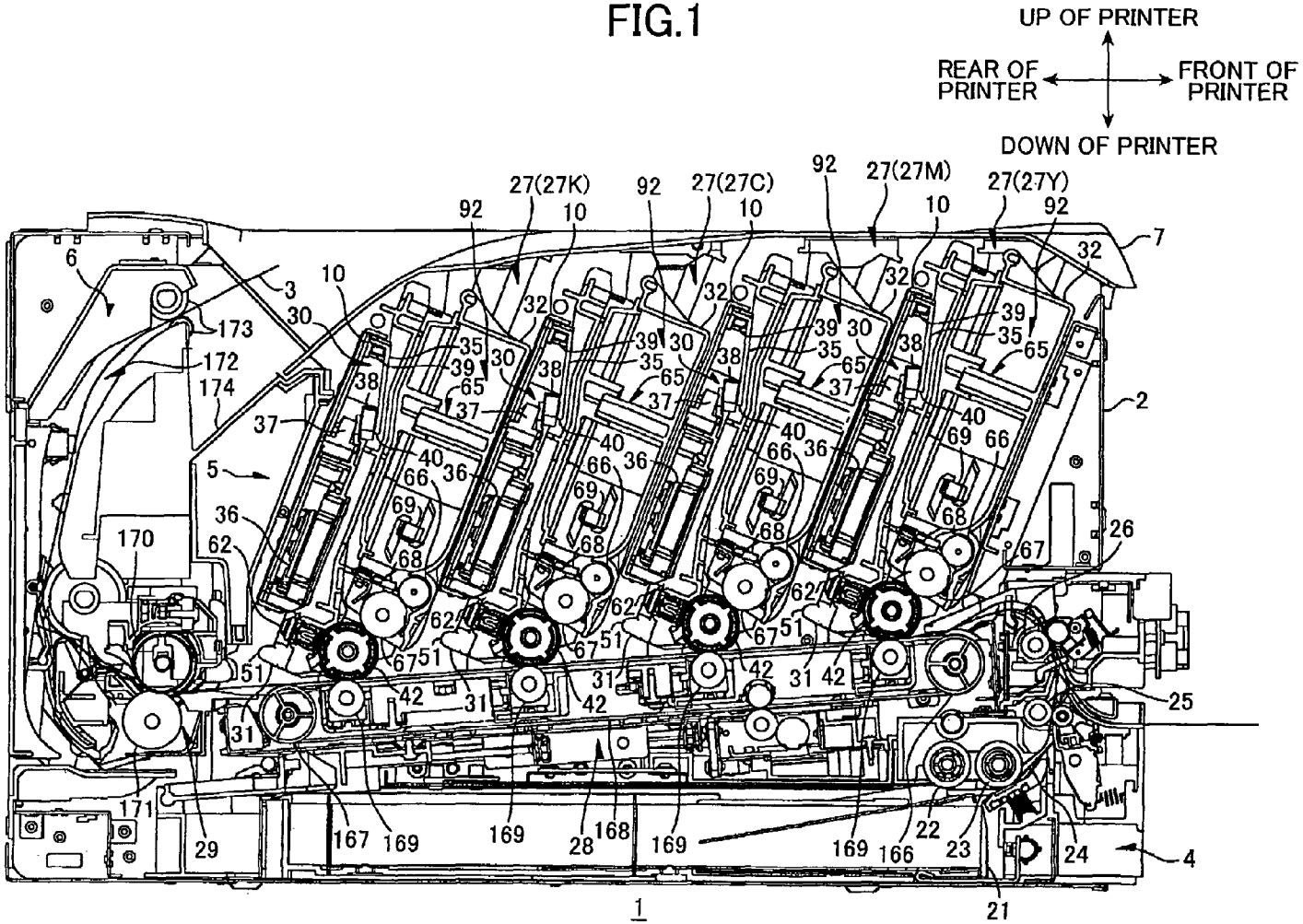
FIG. 1 is a side cross-sectional view showing a color laser printer according to a preferred embodiment of the present invention.

FIG. 1 is a side cross-sectional view showing a color laser printer, serving as a preferred embodiment of the image-forming device according to the present invention.

A color laser printer 1 shown in FIG. 1 is a transverse tandem type color laser printer having a plurality of process sections 27 that are horizontally juxtaposed. The color laser printer 1 includes a main casing 2 and, within the main casing 2, a feeder unit 4 for feeding a paper 3, an image-forming unit 5 for forming images on the paper 3 supplied from the feeder unit 4, and a discharge unit 6 for discharging the paper 3 from the color laser printer 1 after an image has been formed on the paper 3.

The main casing 2 is shaped substantially like an open-topped rectangular box when viewed from the side. A top cover 7 is provided on the top side of the main casing 2. The top cover 7 is rotatably supported by hinges (not shown) disposed on the rear side of the main casing 2 (hereinafter, the left side in FIG. 1 will be referred to as the rear side, while the right side in FIG. 1 will be referred to as the front side) and is capable of opening and closing on the main casing 2.

Figure 17:
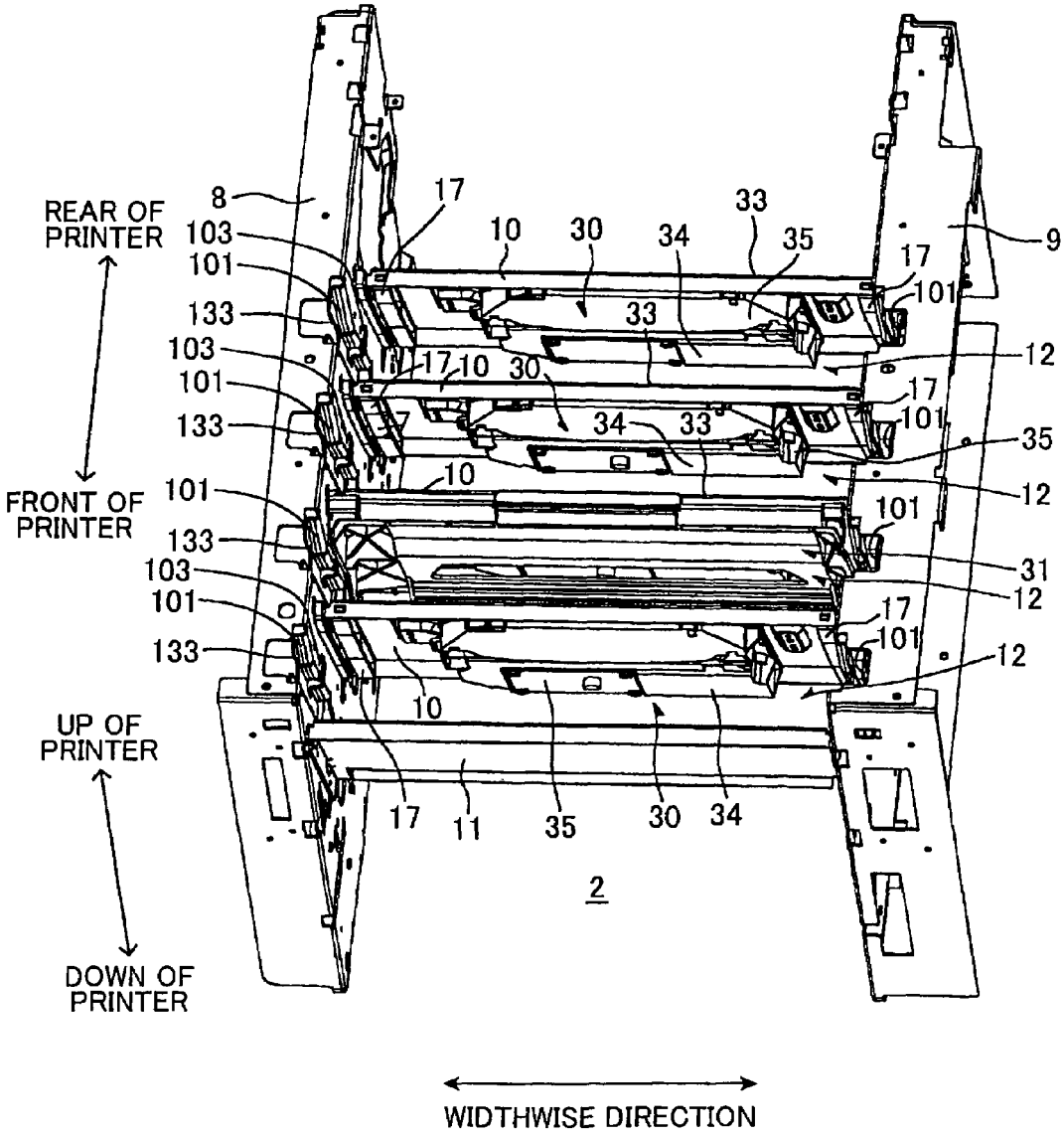
FIG. 17 is a perspective view from above the front side of a main casing in the color laser printer.

As shown in FIG. 17, the main casing 2 includes a left side plate 8 and a right side plate 9 that face each other in a widthwise direction orthogonal to the front-to-rear direction and to the vertical direction and that are separated by a prescribed gap; and four partitioning plates 10 and a front plate 11 that span between the left side plate 8 and right side plate 9. The partitioning plates 10 are disposed in the main casing 2 at prescribed intervals in the front-to-rear direction, and the front plate 11 is disposed further forward of the partitioning plates 10 so as to partition the space between the left side plate 8 and right side plate 9 in the front-to-rear direction into a space for each of the process sections 27 (FIGS. 1 and 18) described later. Each partition plate 10 has a rear surface 33 on its rear side.

The partitioning plates 10 and the front plate 11 are each slanted with respect to the front-to-rear direction, which is identical to the direction in which the paper 3 is conveyed through the color laser printer 1 while being formed with images, and the vertical direction, with the top end farther forward than the bottom end. As shown in FIG. 1, the partitioning plates 10 and front plates 11 are arranged so that a vertical gap is formed between the top ends of the plates 10, 11 and the top cover 7 and another vertical gap is formed between the bottom ends of the plates 10, 11 and a transfer section 28 described later.

Figure 18:
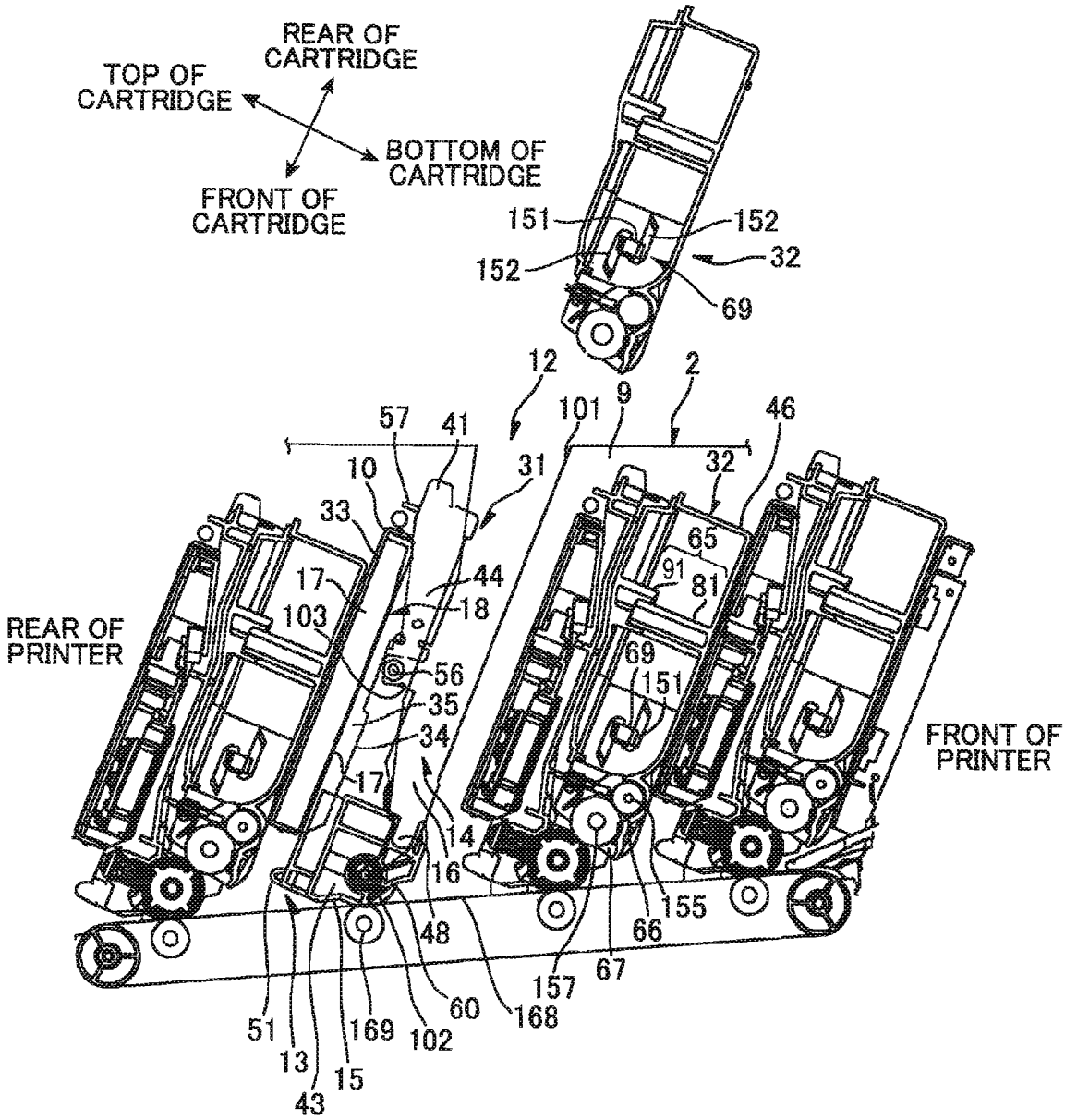
FIG. 18 is a side view illustrating the process of mounting the drum cartridge and developer cartridge in the main casing.

Accordingly, as shown in FIG. 17, four process-accommodating sections 12 are partitioned in the main casing 2 by the left side plate 8 and right side plate 9 and the adjacent partitioning plates 10 and front plate 11. Each of the process-accommodating sections 12 is provided for one of the process sections 27 corresponding to each printing color. Each of the process-accommodating sections 12 includes a drum-accommodating section 13 (see FIG. 18) for accommodating a drum cartridge 31 described later, and a developer-accommodating section 14 (see FIG. 18) for accommodating a developer cartridge 32 described later. As shown in FIG. 18, the drum cartridge 31 has a holder unit 43 that is mounted in the drum-accommodating section 13, while the developer cartridge 32 is mounted in the developer-accommodating section 14.

As shown in FIG. 18, the drum-accommodating sections 13 are provided lower than the partitioning plates 10 in spaces partitioned by the left side plate 8 and right side plate 9 in the widthwise direction and by imaginary slanted lines extending from the partitioning plates 10 and the front plate 11 along the same planes thereof in the front-to-rear direction. Each of the spaces partitioned in the drum-accommodating section 13 in this way is a drum-accommodating space 13 for accommodating the holder unit 43 of the drum cartridge 31.

The developer-accommodating section 14 is disposed as a continuation of the drum-accommodating section 13 on the upstream side of the drum-accommodating section 13 with respect to the direction in which the drum cartridge 31 is mounted. In other words, the developer-accommodating section 14 is provided above the drum-accommodating section 13 along the mounting direction for the drum cartridge 31 and the developer cartridge 32. The developer-accommodating sections 14 are partitioned by the partitioning plates 10 and front plate 11 in the front-to-rear direction and by the left side plate 8 and right side plate 9 in the widthwise direction. The internal space of the developer-accommodating sections 14 partitioned in this way (excluding an extended accommodating space 18 described later) forms a developer-accommodating space 16 for accommodating the developer cartridge 32.

As shown in FIGS. 17 and 18, in each of the developer-accommodating sections 14, rail parts 17 are provided on the partitioning plate 10 to extend along both widthwise ends of the partitioning plate 10. The rail parts 17 are formed as thick strips extending in the mounting direction of the drum cartridge 31. When mounting the drum cartridge 31, ridges 51 of the drum cartridges 31 (to be described later) slide against the rail parts 17, respectively.

As shown in FIG. 1, the feeder unit 4 includes: a paper supply tray 21 that is detachably mounted in a lower section of the main casing 2 and can be inserted into or removed from the main casing 2 through the front side in a horizontal direction; a pickup roller 22 and a feeding roller 23 disposed above the front side of the paper supply tray 21; a feeding side U-shaped path 24 disposed in front of and above the feeding roller 23; and a conveying roller 25 and a registration roller 26 disposed along the feeding side U-shaped path 24.

The paper 3 is stacked inside the paper supply tray 21. The pickup roller 22 picks up the topmost sheet of the paper 3 and conveys the sheet forward. Subsequently, the feeding roller 23 feeds the sheet along the feeding side U-shaped path 24. The feeding side U-shaped path 24 is shaped substantially like the letter U and serves as a conveying path for the paper 3. The upstream end of the feeding side U-shaped path 24 is a lower part positioned adjacent to the feeding roller 23 for feeding the paper 3 forward, while the downstream end is an upper part positioned adjacent to a conveying belt 168 described later for conveying the paper 3 rearward.

After the feeding roller 23 feeds the sheet of paper 3 forward along the upstream end of the feeding side U-shaped path 24, the conveying roller 25 continues to convey the paper 3 along the feeding side U-shaped path 24 as the conveying direction of the paper 3 is reversed. The registration roller 26 first registers the sheet of paper 3 and subsequently conveys the sheet rearward.

The image-forming unit 5 includes the process sections 27, the transfer section 28, and a fixing section 29. The process sections 27 are provided one for each color of toner. Specifically, the color laser printer 1 of the preferred embodiment has four process sections 27, including a yellow process section 27Y, a magenta process section 27M, a cyan process section 27C, and a black process section 27K. The process sections 27 are disposed one in each of the process-accommodating sections 12, aligned one after another horizontally and separated by a prescribed gap in the front-to-rear direction.

Each of the process sections 27 includes a scanning unit 30, the drum cartridge 31, and the developer cartridge 32 that is detachably mounted on the drum cartridge 31. A process cartridge is configured of the drum cartridge 31, and the developer cartridge 32 mounted on the drum cartridge 31.

The scanning unit 30 includes a scanner casing 35 and, within the scanner casing 35, a laser light-emitting unit (not shown), a polygon mirror 36, two lenses 37 and 38, and a reflecting mirror 39.

As shown in FIG. 17, the scanner casing 35 is disposed in the widthwise center of each partitioning plate 10 so that the rail parts 17 of each partitioning plate 10 are positioned one on either widthwise end of the scanner casing 35. Further, a rear wall of the scanner casing 35 contacts a front surface of the partitioning plates 10, while a front wall 34 of the scanner casing 35 protrudes forward away from the partitioning plates 10. By disposing the scanner casing 35 so as to protrude forward from the partitioning plates 10 in this way, the scanning unit 30, drum cartridge 31, and developer cartridge 32 can be arranged in close proximity with each other, thereby making it possible to achieve a more compact device.

Since the scanner casing 35 protrudes forward from the partitioning plates 10, the drum cartridge 31 is restricted from passing through the developer-accommodating section 14 when the developer cartridge 32 is mounted on the drum cartridge 31. However, the drum cartridge 31 can pass through the developer-accommodating space 16 when the developer cartridge 32 is separated from the drum cartridge 31.

As shown in FIG. 18, due to the scanner casing 35, the developer-accommodating section 14 is formed narrower than the drum-accommodating section 13 in the direction orthogonal to the widthwise direction and to the mounting direction of the drum cartridge 31 and developer cartridge 32 (hereinafter, referred to as the "thickness direction" of the drum cartridge 31 and developer cartridge 32).

More specifically, the developer-accommodating section 14 is formed wider in the thickness direction than the thickness of the holder unit 43 of the drum cartridge 31, and narrower than the thickness of the drum cartridge 31 and developer cartridge 32 when mounted on each other.

As shown in FIG. 18, the extended accommodating space 18 is formed in the developer-accommodating section 14 between an upper end and both widthwise ends of the scanner casing 35 and near the front wall 34 of the scanner casing. 35 (a space between the front wall 34 of the scanner casing 35 and the developer-accommodating space 16 in which a middle plate 54 described later is provided). The extended accommodating space 18 accommodates an extended part 44 of the drum cartridge 31 described later.

As shown in FIG. 1, a window 40 is formed in the front wall 34 of the scanner casing 35 for allowing the passage of a laser beam. The laser light-emitting unit of the scanning unit 30 emits a laser beam based on prescribed image data. This laser beam is deflected by the polygon mirror 36, passes through or is reflected by the lens 37, reflecting mirror 39, and lens 38, and is irradiated through the window 40.

Figure 2:
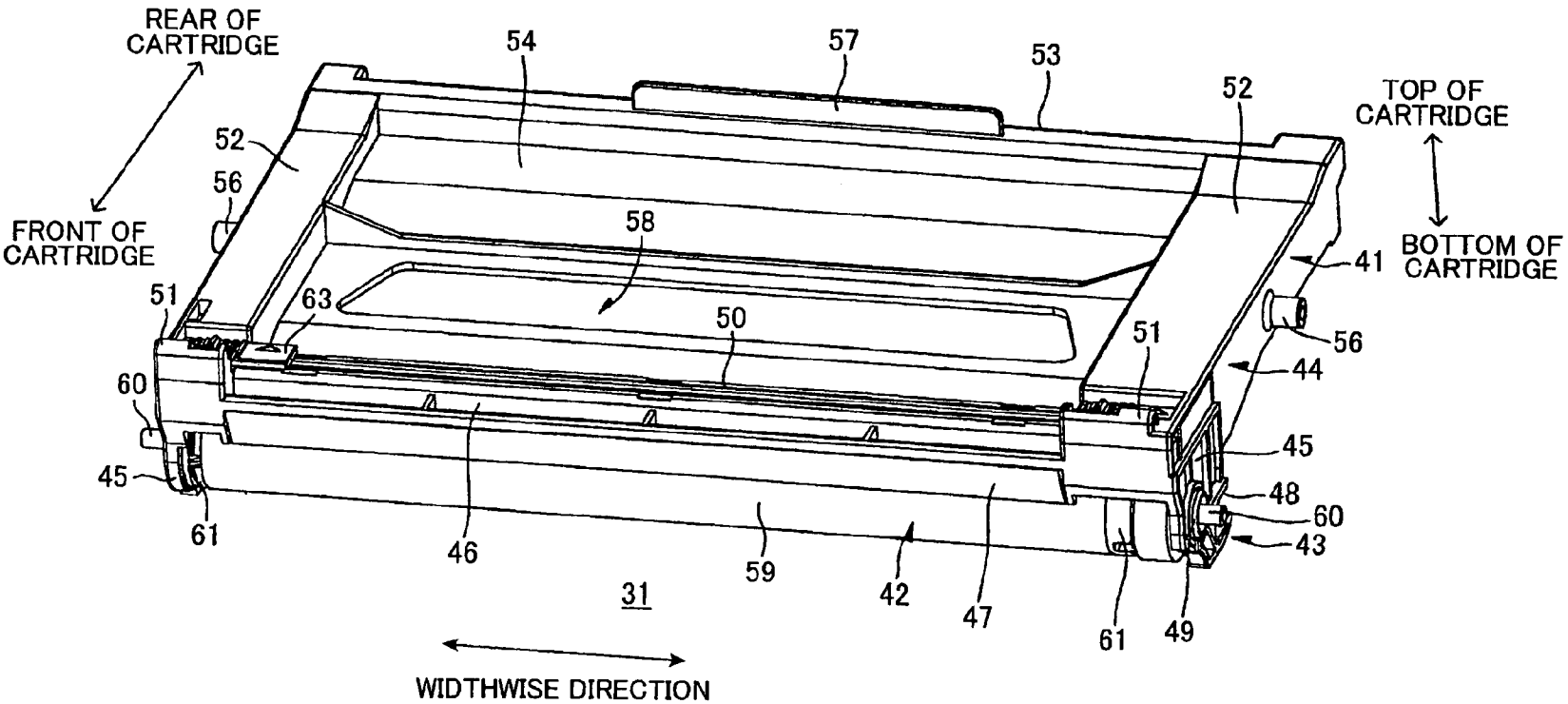
FIG. 2 is a perspective view from the top front side of a drum cartridge for the color laser printer of FIG. 1.
Figure 3:
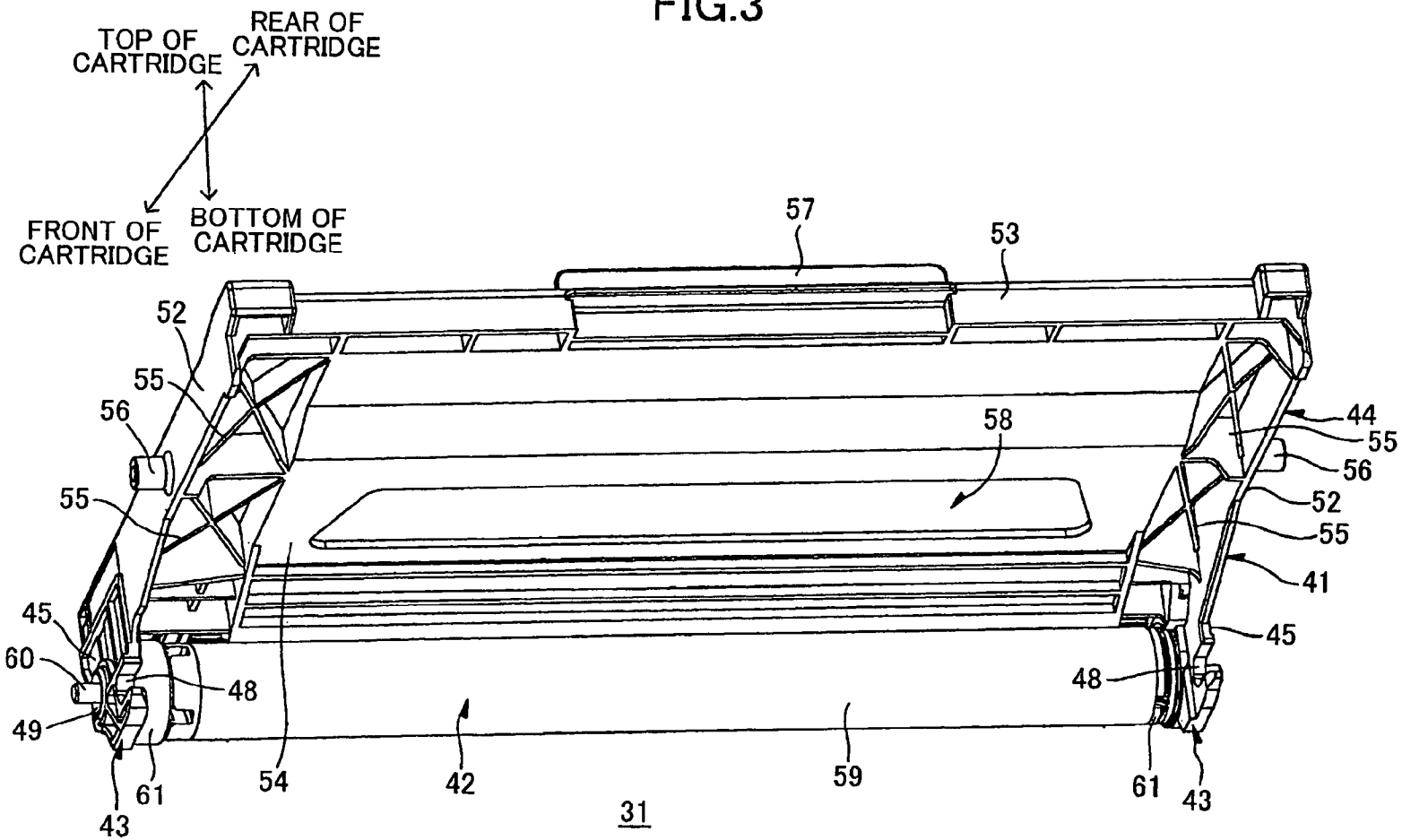
FIG. 3 is a perspective view from the bottom rear side of the drum cartridge.

As shown in FIGS. 2 and 3, the drum cartridge 31 includes a drum casing 41; and a photosensitive drum 42 and a Scorotron charger 62 (see FIG. 1) disposed in the drum casing 41.

The drum casing 41 includes the holder unit 43, and the extended part 44 extending from the holder unit 43. The holder unit 43 and extended part 44 are integrally formed of a synthetic resin.

Below, the drum cartridge 31 will be described with reference to FIGS. 2 through 7. In the following description, when the drum cartridge 31 is in a mounted state in the color laser printer 1, the side of the drum cartridge 31 in the thickness direction positioned toward the rear side of the color laser printer 1 will be referred to as the top surface side or upper side of the drum cartridge 31; the side positioned toward the front of the color laser printer 1 will be referred to as the bottom surface side or lower side of the drum cartridge 31; the side of the drum cartridge 31 downstream in the mounting direction will be referred to as the front side of the drum cartridge 31; and the side of the drum cartridge 31 upstream in the mounting direction will be referred to as the rear side of the drum cartridge 31. The widthwise direction of the drum cartridge 31 is defined as perpendicular to both of the top-to-bottom direction and the front-to-rear direction of the drum cartridge 31.

The holder unit 43 includes two side walls 45 opposing each other across a prescribed gap in the widthwise direction, a top wall 46 that spans between the upper edges of the side walls 45, and a front wall 47 that extends from the front edge of the top wall 46 vertically along part of the front edges of the side walls 45. The holder unit 43 is thicker than a developer casing 64 of the developer cartridge 32.

The holder unit 43 is formed thicker than the extended part 44. This construction can reliably accommodate the photosensitive drum 42 and the charger 62.

Figure 6:
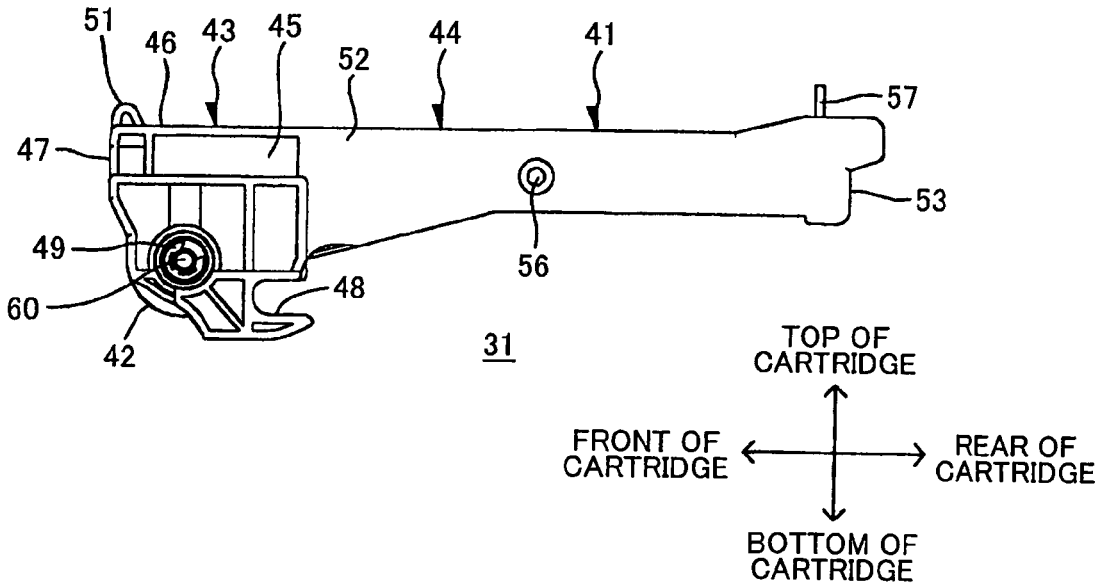
FIG. 6 is a right side view of the drum cartridge.
Figure 7:
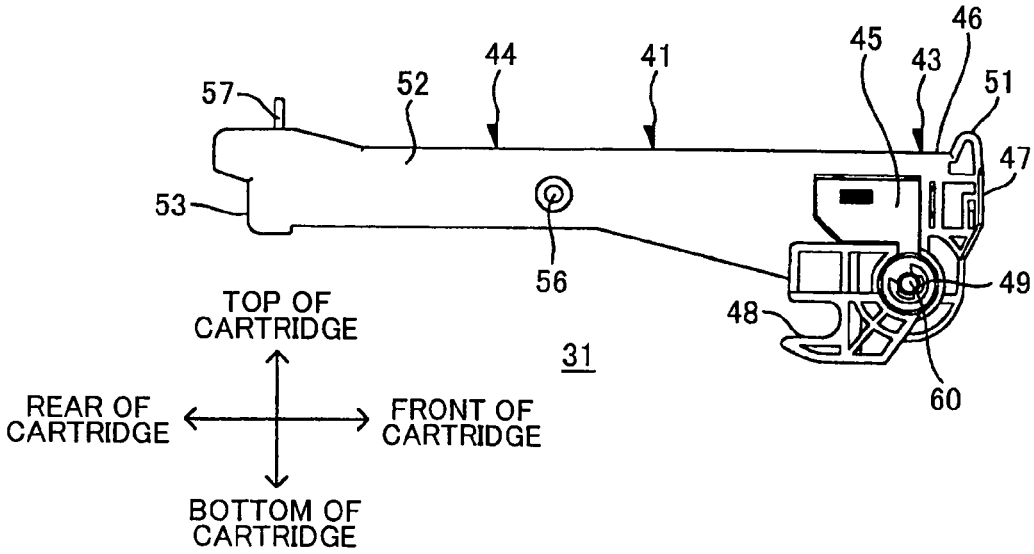
FIG. 7 is a left side view of the drum cartridge.

As shown in FIGS. 6 and 7, a developer positioning groove 48 formed substantially in the shape of a U that opens rearward is formed on the lower part of each side wall 45. An insertion part 49 is formed on the front side of the developer positioning groove 48 for inserting a drum shaft 60 of the photosensitive drum 42.

As shown in FIG. 2, a cleaner fitting part 50 is formed in the top wall 46 along the width of the same. A cleaner 63 described later is slidably fitted into the cleaner fitting part 50. As shown in FIGS. 6 and 7, the ridges 51 formed on both widthwise ends of the top wall 46 are substantially triangular shaped protrusions when viewed from the side that protrude upward on the front end of the top wall 46.

As shown in FIGS. 2 and 3, the extended part 44 extends rearward from the holder unit 43 so as to extend above the upper end of the scanner casing 35 in the developer-accommodating section 14 when the holder unit 43 is mounted in the drum-accommodating section 13.

The extended part 44 includes two extended side parts 52 that face each other across a gap in the widthwise direction, an extended rear wall 53 that spans between the rear edges of the extended side parts 52, and the middle plate 54 disposed in an area surrounded by the holder unit 43, the extended side parts 52, and the extended rear wall 53.

As shown in FIG. 2, each of the extended side parts 52 has a substantially box-shaped cross section that is open on the bottom. As shown in FIG. 2, the outside surfaces of the extended side parts 52 extend rearward from both widthwise ends of the holder unit 43 so as to extend continuously rearward from the top of the developer positioning grooves 48.

As shown in FIG. 3, two reinforcing ribs 55 substantially X-shaped from a bottom view are disposed in the box-shaped interior of the extended side parts 52 along the front-to-rear direction. A drum boss 56 protruding outward in the widthwise direction is provided on the outer side surface of each extended side part 52 midway along the longitudinal direction thereof.

As described above, the extended rear wall 53 extends in the widthwise direction, connecting the rear edges of the extended side parts 52. A drum grip 57 is provided in the widthwise center of the extended rear wall 53 to facilitate gripping the drum cartridge 31 and mounting and removing the drum cartridge 31 with respect to the drum-accommodating section 13.

Figure 4:
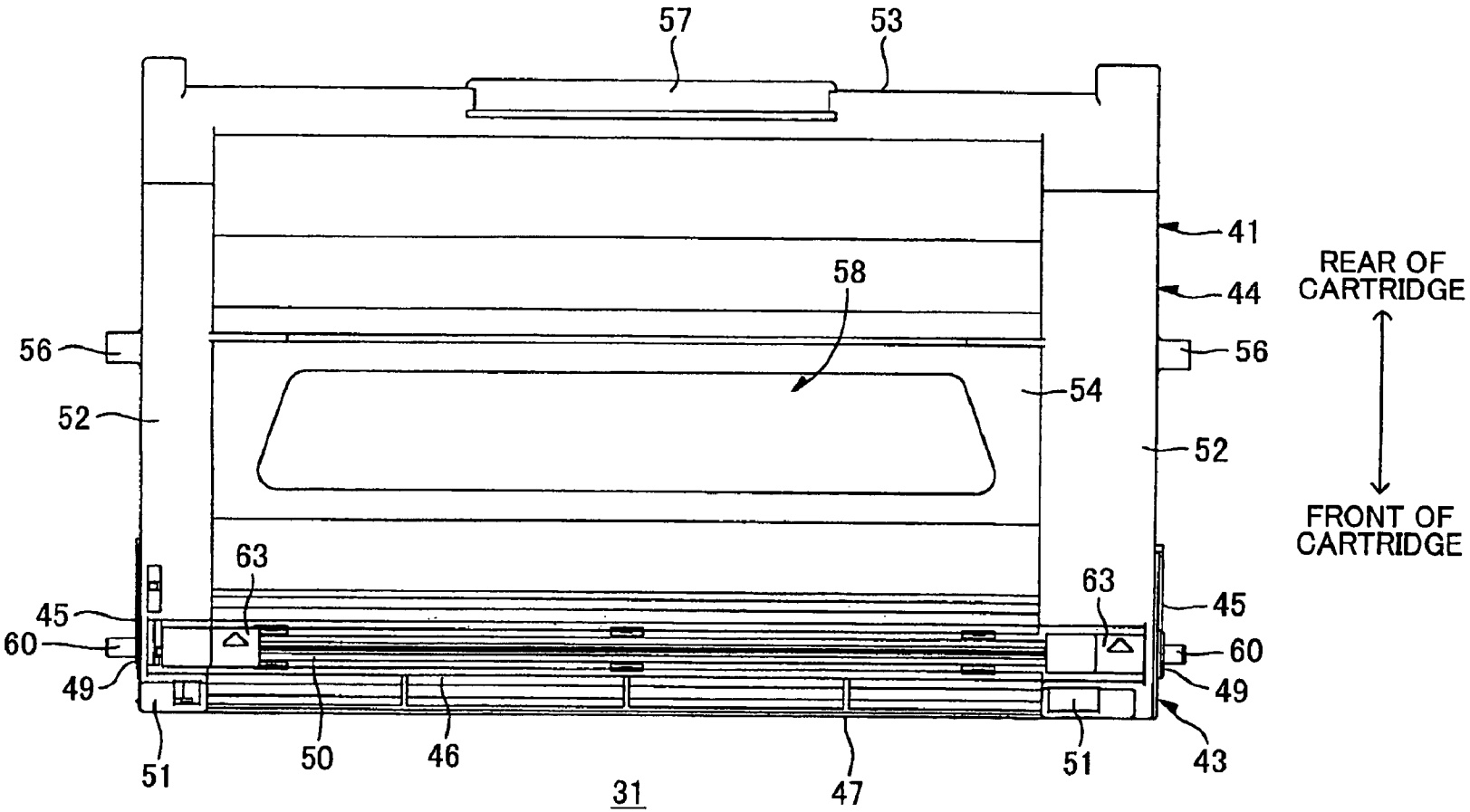
FIG. 4 is a plan view of the drum cartridge.

The middle plate 54 is formed in a substantially rectangular planar shape as shown in FIG. 2. The middle plate 54 is disposed in a portion surrounded by the holder unit 43, extended side parts 52, and extended rear wall 53 and is connected to the holder unit 43, extended side parts 52, and extended rear wall 53 at a position sunken below the top surface of the extended side parts 52 and extended rear wall 53. An opening 58 is formed in the middle plate 54 to allow passage of a laser beam emitted through the window 40 of the scanner casing 35. As shown in FIG. 4, the opening 58 is shaped like a trapezoid in a plan view with the front side wider than the rear side. By forming the opening 58 to be trapezoidal in a plan view, it is possible to cut out only the portion of the middle plate 54 through which the laser beam passes, resulting in a stronger extended part 44 than when the middle plate 54 is formed to be rectangular in a plan view.

As shown in FIG. 2, the photosensitive drum 42 is accommodated within the holder unit 43 along the widthwise direction. The photosensitive drum 42 includes a main drum body 59 that is cylindrical in shape and has a positive charging photosensitive layer formed of a polycarbonate or the like on its outer surface, and the drum shaft 60 extending along the axial center of the main drum body 59. The drum shaft 60 is supported by both axial ends in the side walls 45 such that each axial end is inserted into the insertion part 49 of the respective side wall 45 and protrudes axially outward from each side wall 45. The drum shaft 60 is incapable of rotating relative to the side walls 45.

Figure 5:
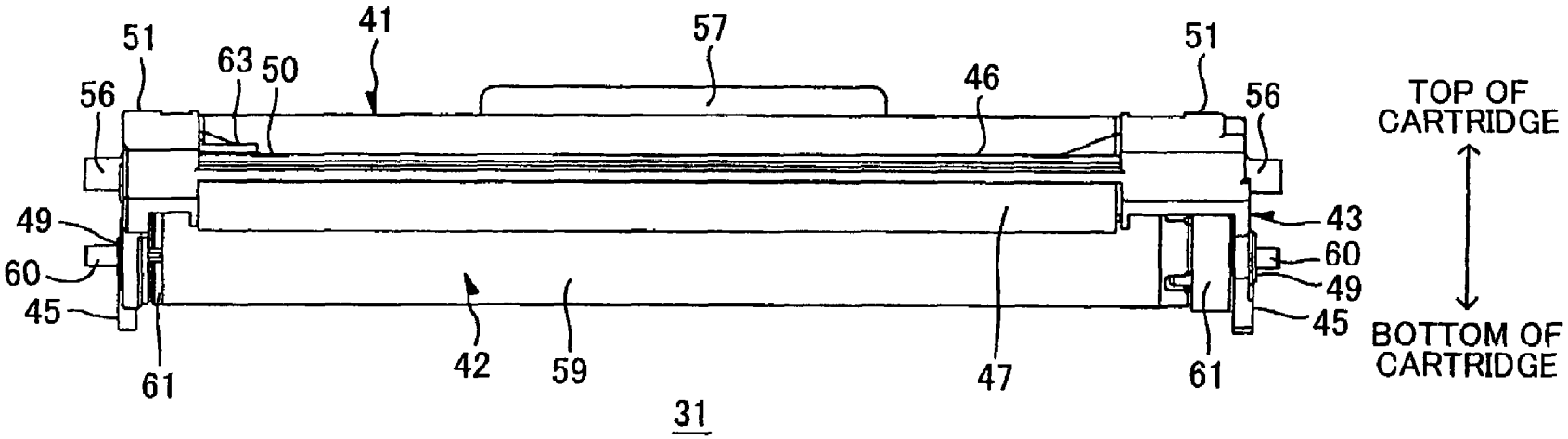
FIG. 5 is a front view of the drum cartridge.

A rotational support member 61 is fitted onto each axial end of the main drum body 59 so as to be incapable of rotating relative to the main drum body 59. The rotational support members 61 are supported on and capable of rotating relative to the drum shaft 60. Hence, the main drum body 59 is supported so as to be capable of rotating relative to the drum shaft 60. With this construction, as shown in FIG. 5, the photosensitive drum 42 is disposed in the holder unit 43 so that a front surface is exposed below the front wall 47.

As shown in FIG. 1, the charger 62 is accommodated in the holder unit 43 above the ridges 51 (rearward in FIG. 2) and extends in the widthwise direction. The charger 62 is a positive-charging Scorotron charger that includes a wire and a grid for generating a corona discharge. The charger 62 is supported on the top wall 46 rearward of the photosensitive drum 42 (above in FIG. 2) and faces the photosensitive drum 42 at a prescribed distance so as not to contact the same. As shown in FIG. 2, the charger 62 is provided with the cleaner 63 for cleaning the wire. The cleaner 63 is slidably fitted into the cleaner fitting part 50 of the top wall 46.

The developer cartridge 32 shown in FIGS. 8-16 includes the developer casing 64, and, provided in the developer casing 64, an agitator 69, a supply roller 66, a developing roller 67, and a thickness-regulating blade 68.

Next, the developer cartridge 32 will be described in detail with reference to FIGS. 8 through 16. In the following description, when the developer cartridge 32 is in a mounted state in the color laser printer 1, the side of the developer cartridge 32 in the thickness direction positioned toward the rear side of the color laser printer 1 will be referred to as the top surface side or upper side of the developer cartridge 32; the side positioned toward the front of the color laser printer 1 will be referred to as the bottom surface side or lower side of the developer cartridge 32; the side of the developer cartridge 32 downstream in the mounting direction will be referred to as the front side of the developer cartridge 32; and the side of the developer cartridge 32 upstream in the mounting direction will be referred to as the rear side of the developer cartridge 32. The widthwise direction of the developer cartridge 32 is defined as perpendicular to both of the top-to-bottom direction and the front-to-rear direction of the developer cartridge 32.

Figure 8:
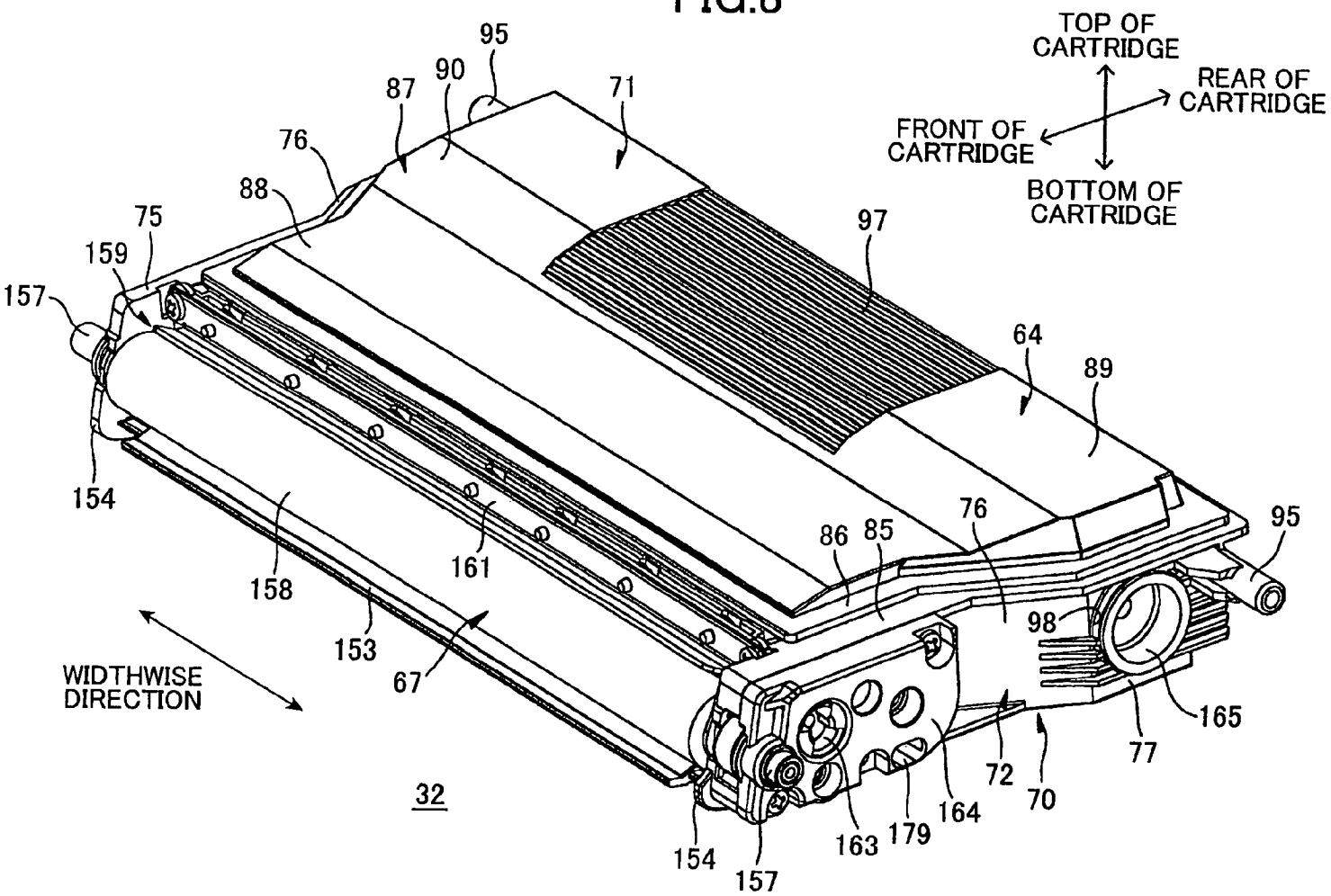
FIG. 8 is a perspective view from the top front side of a developer cartridge for the color laser printer of FIG. 1.
Figure 15A:
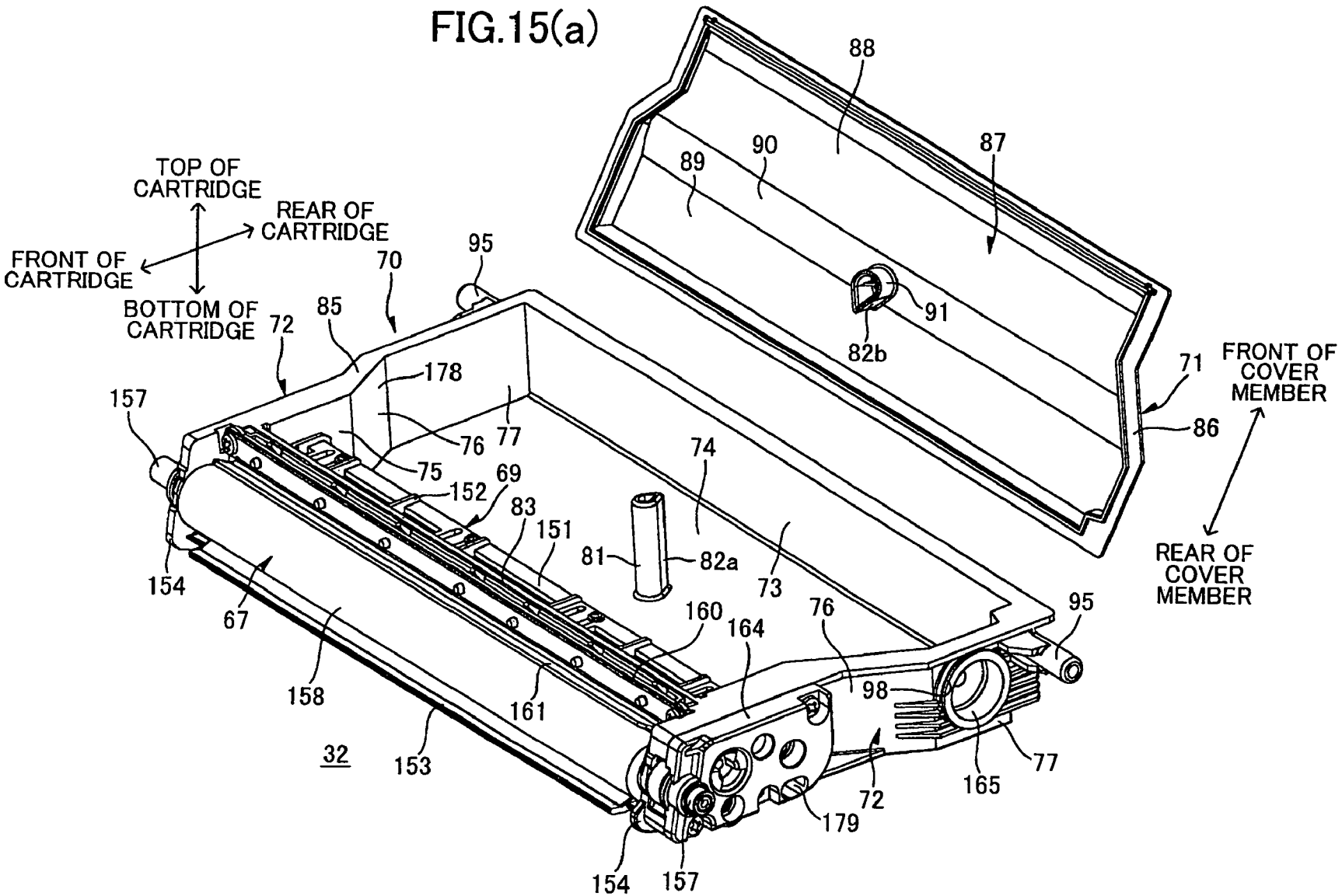
FIG. 15(*a*) is an exploded perspective view of the developer cartridge.
Figure 15B:
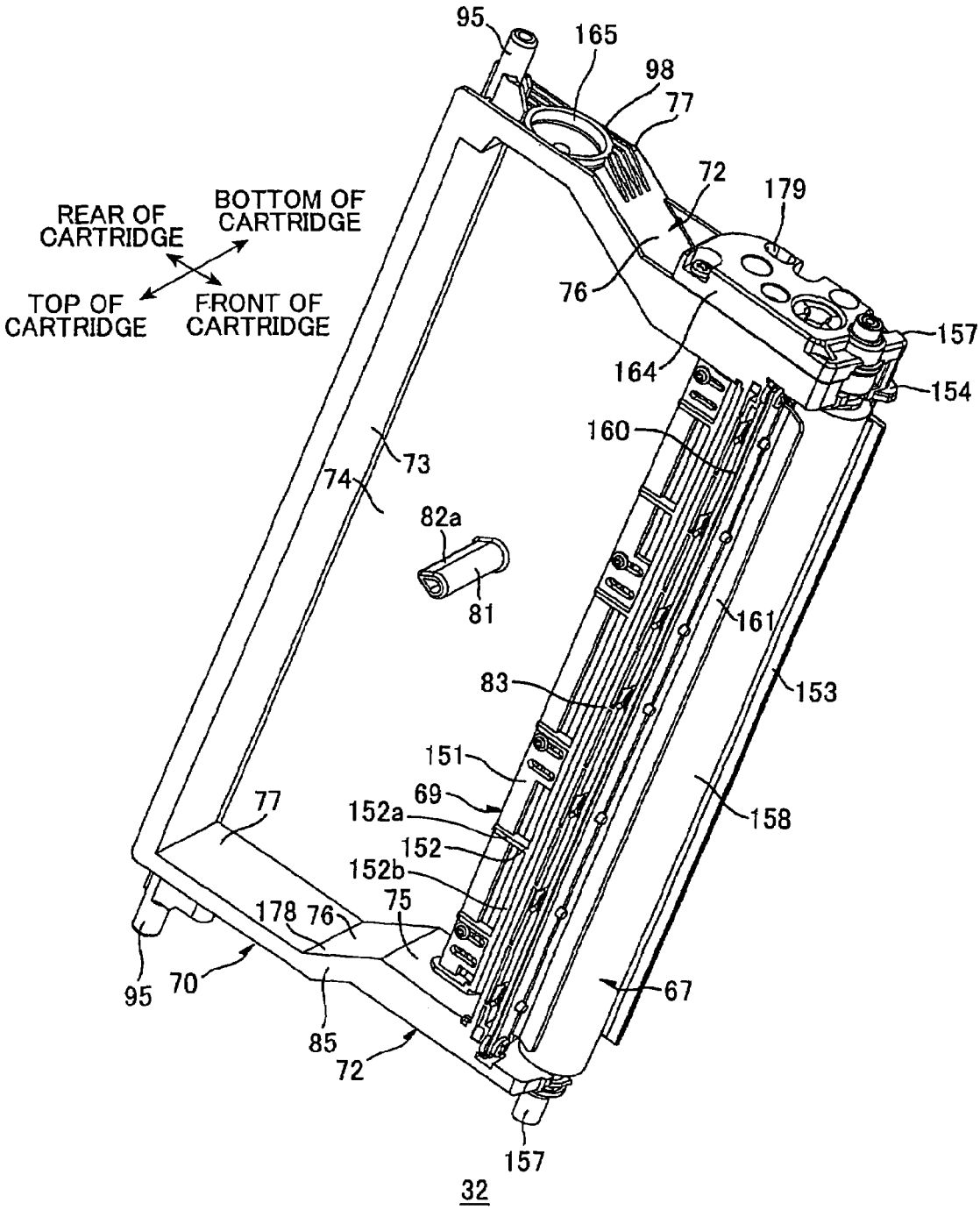

As shown in FIG. 8, the developer casing 64 is formed in a thin box shape with an open front side. As shown in FIG. 15(*a*), the developer casing 64 includes a casing member 70 that is open on the top surface side; and a cover member 71 formed separately from the casing member 70 for covering the open top surface side of the casing member 70.

The casing member 70 includes a pair of side walls 72 spaced apart from each other and facing each other in the widthwise direction; a rear wall 73 connected to the rear edges of the side walls 72; and a bottom wall 74 connected to the bottom edges of the side walls 72 and rear wall 73 so as to cover one side of an area surrounded by the side walls 72 and rear wall 73.

Figure 14:
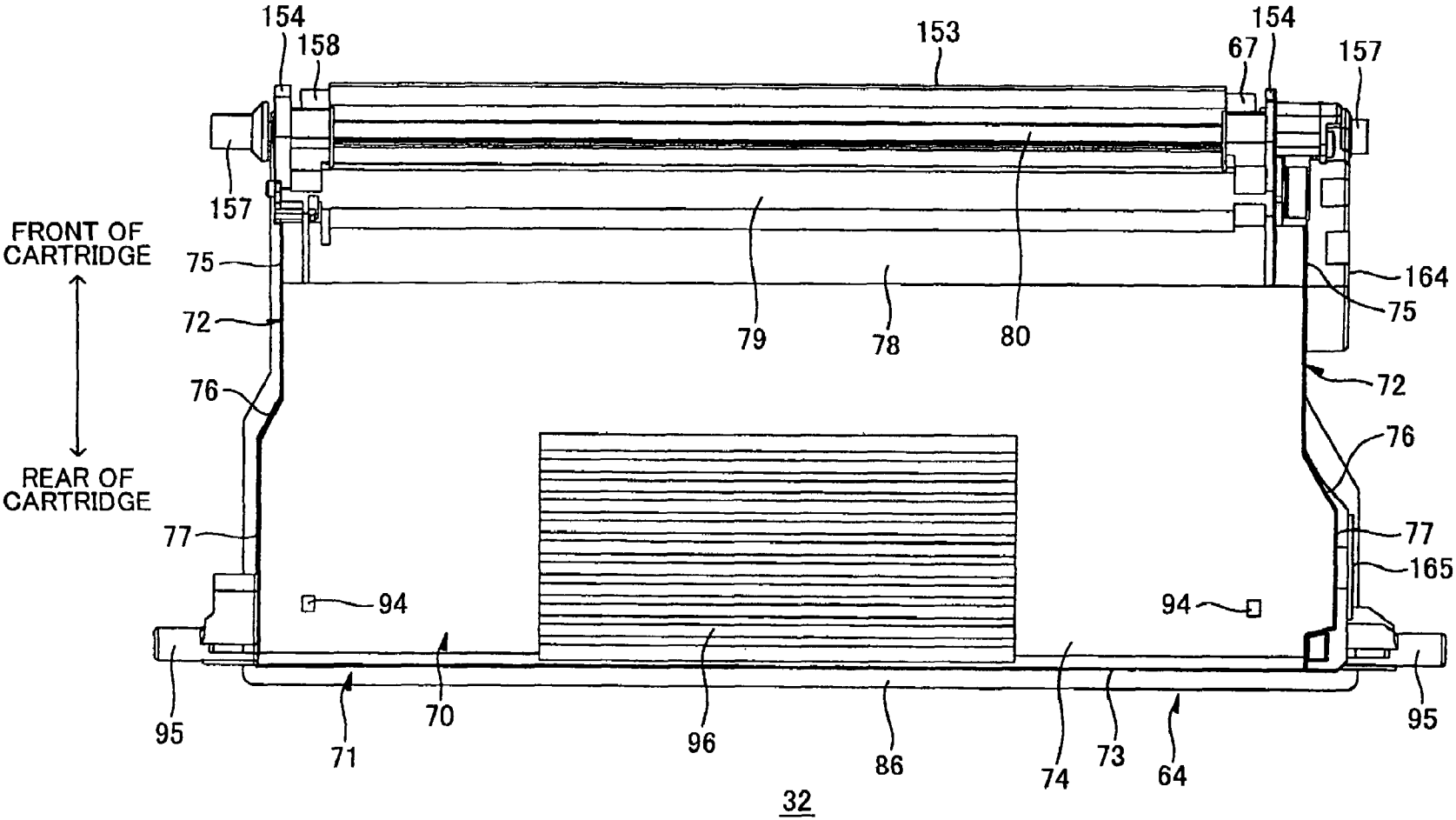
FIG. 14 is a bottom view of the developer cartridge.

As shown in FIG. 14, each of the side walls 72 has a plate shape and extends in the front-to-rear direction. Each side wall 72 is integrally provided with a front side wall 75, a sloped wall 76, and a rear side wall 77 that are connected seamlessly in the front-to-rear direction.

These front side walls 75 are provided parallel to each other on opposing sides of the thickness-regulating blade 68, supply roller 66, and agitator 69 and are disposed on the front of the developer cartridge 32 extending from the front edge rearward to corresponding midway positions in the front-to-rear direction.

The rear side walls 77 are also disposed parallel to each other in the rear of the developer cartridge 32 on the opposite side of the agitator 69 from the developing roller 67 and extend from the rear edge of the developer cartridge 32 forward to corresponding midway positions in the front-to-rear direction so that a gap is formed between the front end of the rear side walls 77 and the rear end of the front side walls 75 in the front-to-rear direction. The rear side walls 77 are separate from each other by a distance greater than the distance separating the front side walls 75.

The sloped walls 76 are provided at a slant to the front-to-rear direction so that the distance between the two grows gradually larger from the front edges toward the rear edges. The sloped walls 76 are disposed between the front side walls 75 and rear side walls 77 so that the front edges of the sloped walls 76 are connected to the front side walls 75, while the rear edges are connected to the rear side walls 77. As shown in FIG. 15(*a*), the inner surface of the sloped walls 76 is a sloped surface 178 for guiding discharged toner. The sloped surfaces 178 function to facilitate the guiding of toner by eliminating a step part between the front side walls 75 and rear side walls 77, even though the distance between the front side walls 75 is shorter than the distance between the rear side walls 77, thereby preventing toner from accumulating between the front side walls 75 and rear side walls 77 and enabling the toner to be discharged from a toner-accommodating chamber 92 (see FIG. 16) described later.

Figure 9:
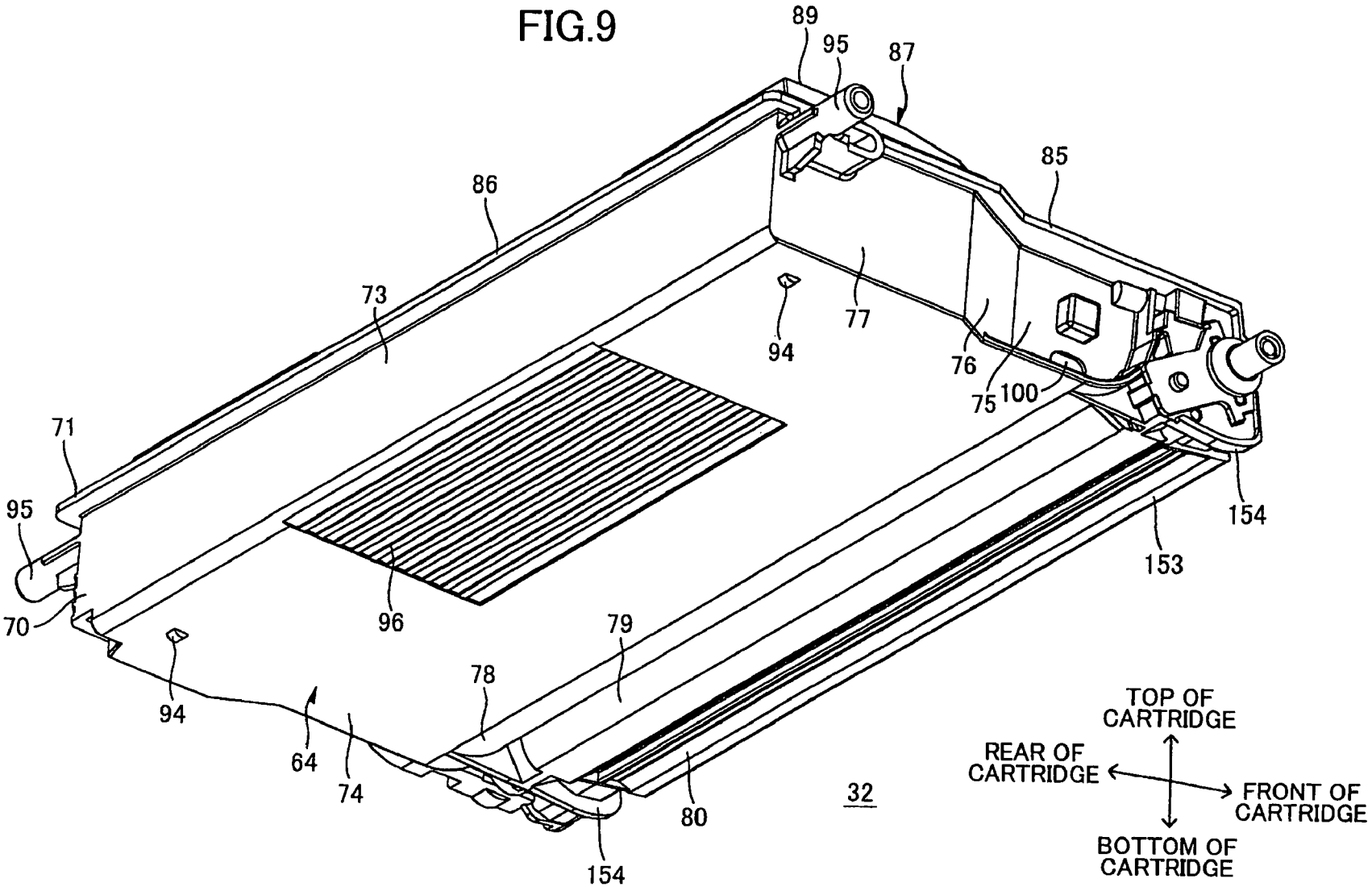
FIG. 9 is a perspective view from the bottom rear side of the developer cartridge.
Figure 10:
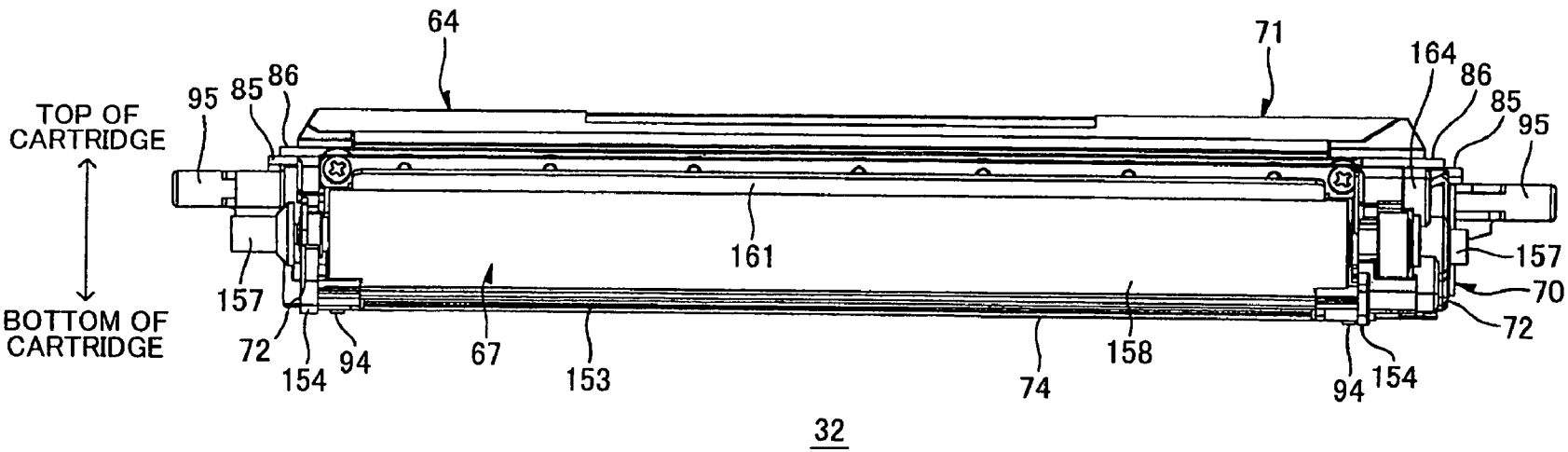
FIG. 10 is a front view of the developer cartridge.

As shown in FIG. 9, developer bosses 95 protrude outward in the widthwise direction from the rear ends of the rear side walls 77 near the top surface side.

As shown in FIGS. 9 and 15(*a*), the rear wall 73 is formed in the shape of a thin rectangular plate extending in the widthwise direction.

Figure 16:
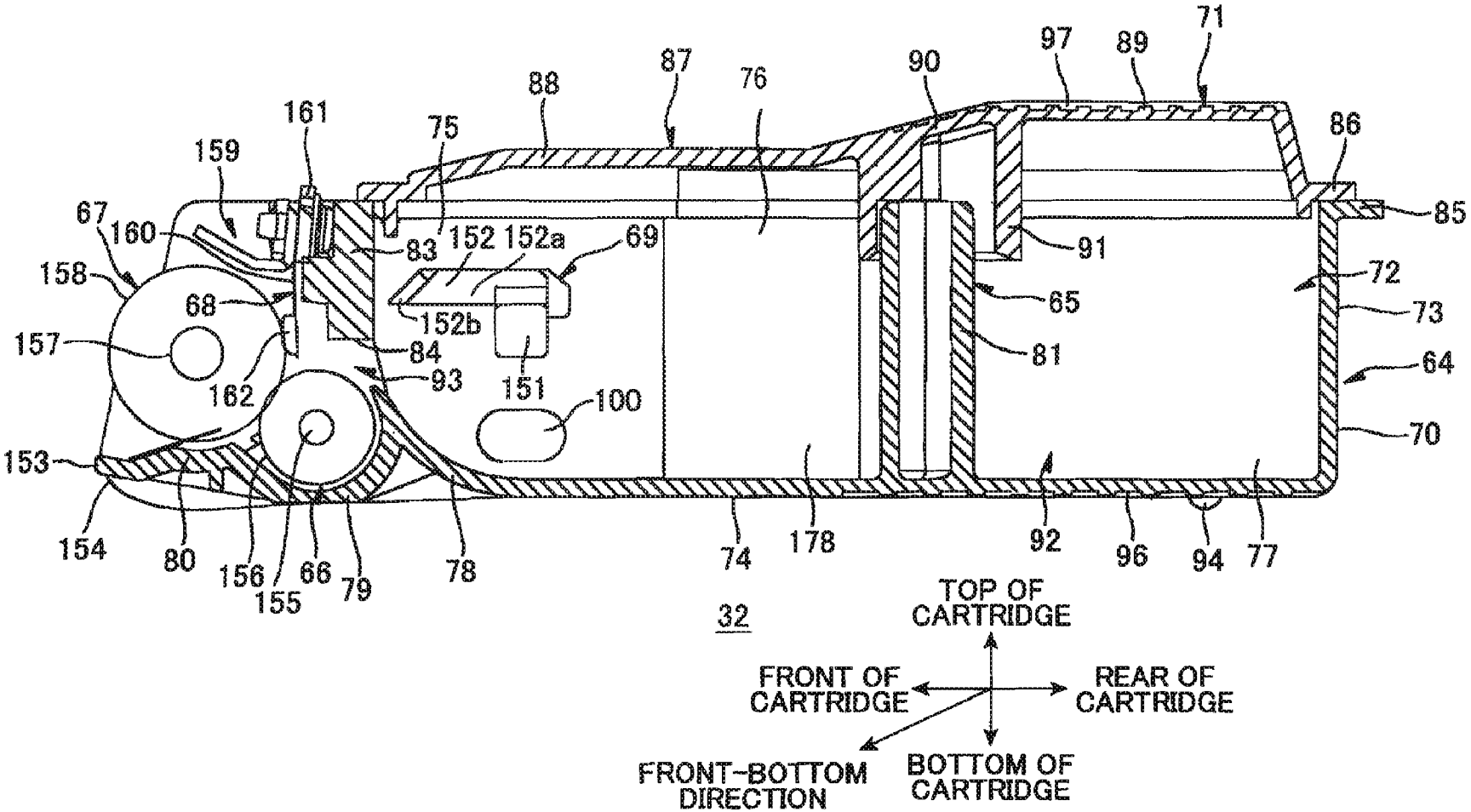
FIG. 16 is a side cross-sectional view of the developer cartridge.

As shown in FIG. 16, the bottom wall 74 is plate-shaped. The front end of the bottom wall 74 (the portion between the front side walls 75 downstream in the mounting direction of the developer cartridge 32) is formed sequentially of a discharge wall 78, a supply roller accommodating wall 79, and a tongue wall 80 from the rear side toward the front side. The discharge wall 78 protrudes toward the top surface side and has an arc-shaped cross-section that follows the rotating path of the agitator 69. The supply roller accommodating wall 79 has an arc-shaped cross-section following the outer periphery of the supply roller 66. The tongue wall 80 slants downward toward the front to expose the developing roller 67.

As shown in FIG. 14, a bottom grip part 96 is provided on the outer surface of the bottom wall 74 to provide the user with a grip region. The bottom grip part 96 is disposed on the bottom wall 74 in the widthwise center thereof and extends from the rear of the bottom wall 74 (the portion of the bottom wall 74 between the rear side walls 77 on the upstream side in the mounting direction of the developer cartridge 32) to a midway position between the front and rear ends of the bottom wall 74 (the portion of the bottom wall 74 between the sloped walls 76 on the midway in the mounting direction of the developer cartridge 32). The bottom grip part 96 is substantially rectangular in a bottom view and has an irregular or corrugated surface for gripping. The bottom grip part 96 serves as a mark to indicate that the user should grip the developer cartridge 32 there.

As shown in FIG. 9, contact protrusions 94 are formed on the outer surface of the bottom wall 74 near the rear side on both widthwise ends and protrude slightly outward from the bottom surface.

As shown in FIG. 15(*a*), a support post member 81 is erected upward from the inner surface of the bottom wall 74 at a position in the widthwise center and between the front and rear ends of the bottom wall 74.

The support post member 81 is disposed on the inner surface of the bottom wall 74 opposite the bottom grip part 96 provided on the outer surface of the bottom wall 74. As shown in FIG. 16, the support post member 81 is erected to a height substantially equivalent to the height of the rear wall 73 in the thickness direction of the developer cartridge 32. As shown in FIG. 15(*a*), the support post member 81 is disposed in the widthwise center and the front-to-rear center of the toner-accommodating chamber 92 described later so as to be separate from each of the side walls 72, rear wall 73, and a partitioning wall 83 described later. The support post member 81 is substantially cylindrical in shape and has a teardrop-shaped cross-section, with the tapered point of the teardrop shape pointing rearward and the rounded bottom end of the teardrop pointing forward. The substantially V-shaped tapered surface formed along the rear side of the support post member 81 serves as a guide surface 82*a* for guiding toner in a discharging direction (downward when the developer cartridge 32 is mounted). The guide surface 82*a* functions to smoothly guide toner downstream in the discharging direction and prevents the toner from accumulating around a reinforcing post 65 described later.

As shown in FIG. 16, the partitioning wall 83 spans between the front side walls 75 at a midpoint in the front-to-rear direction of the front side walls 75. The partitioning wall 83 has a thin rectangular shape extending in the widthwise direction and extends from the top surface side edges of the front side walls 75 part way toward the bottom surface side in the thickness direction of the developer cartridge 32. A gap is formed in the thickness direction between the edge of the partitioning wall 83 facing the bottom surface side and a connection part between the front edge of the discharge wall 78 and the rear edge of the supply roller accommodating wall 79 that protrude toward the top surface side.

A long, narrow discharge opening 84 extending in the widthwise direction of the developer cartridge 32 is formed between the end of the partitioning wall 83 facing the lower surface side and the connection part between the front end of the discharge wall 78 and the rear end of the supply roller accommodating wall 79.

As shown in FIG. 15(*a*), a rim part 85 for contacting the peripheral edge of the cover member 71 is formed along edge parts on the top surface sides of the side walls 72, the partitioning wall 83, and the rear wall 73.

The cover member 71 is formed in a substantial plate shape that corresponds to the space surrounded by the partitioning wall 83, side walls 72, and rear wall 73. The cover member 71 is integrally formed of a contact part 86 formed along the peripheral edge of the cover member 71 in the same plane for contacting the rim part 85 of the casing member 70; and a top wall 87 that is enclosed by the contact part 86 and depressed toward the top surface side.

The top wall 87 is integrally provided with a front top wall 88 that is shaped like a rectangular plate and is disposed on the front side of the cover member 71; a rear top wall 89 that is shaped like a rectangular plate provided on the rear side of the cover member 71 and that is wider and more deeply depressed than the front top wall 88; and a center top wall 90 having a substantial trapezoidal plate shape that is provided between the front top wall 88 and rear top wall 89 in the front-to-rear direction.

As shown in FIG. 8, a top side grip part 97 is provided on the outer surface of the top wall 87 as a region for the user to grip. The top side grip part 97 is disposed in the widthwise center region of the top wall 87 from the rear top wall 89 to the center top wall 90. The top side grip part 97 is substantially rectangular in a plan view and has an irregular or corrugated surface. The top side grip part 97 serves as a mark that directs the user where to grip the developer cartridge 32.

As shown in FIG. 15(*a*), a cylindrical fitting part 91 is disposed on the inner surface of the top wall 87 in the widthwise center of the center top wall 90 for fitting over the end of the support post member 81 on the top surface side. The cylindrical fitting part 91 is provided on the inner surface of the top wall 87 at a position corresponding to the top side grip part 97 provided on the outer surface of the top wall 87. As shown in FIG. 16, the cylindrical fitting part 91 extends toward the bottom wall 74 from the center top wall 90 farther than the depth of the depression in the rear top wall 89 from the contact part 86. The cylindrical fitting part 91 is substantially cylindrical in shape and has a substantially teardrop-shaped cross-section resembling the cross-section of the support post member 81, but slightly larger so as to fit over the support post member 81. A guide surface 82*b* formed on the cylindrical fitting part 91 corresponds to the guide surface 82*a* formed on the support post member 81.

The developer casing 64 is formed by covering the casing member 70 with the cover member 71 so that the contact part 86 of the cover member 71 contacts the rim part 85 of the casing member 70 and the top end of the support post member 81 fits inside the cylindrical fitting part 91 and subsequently welding the contact part 86 to the rim part 85. The developer casing 64 is formed in a thin structure with the bottom grip part 96 and top side grip part 97 opposing each other in the thickness direction, enabling the user to grip and hold the bottom grip part 96 and top side grip part 97 in one hand.

When the support post member 81 is fitted into the cylindrical fitting part 91, the support post member 81 and cylindrical fitting part 91 form the reinforcing post 65 that spans between the bottom wall 74 and the top wall 87, as shown in FIG. 16. Hence, the reinforcing post 65 can absorb stress applied between the bottom wall 74 and top wall 87 in a compressing direction, thereby improving the stiffness of the toner-accommodating chamber 92 described below.

In the developer casing 64 having the construction described above, the toner-accommodating chamber 92 is defined by the top wall 87; the rear-to-middle section of the bottom wall 74 having the discharge wall 78 and opposing the top wall 87 at prescribed distances in the thickness direction; and the side walls 72 (specifically, from the rear side walls 77 to a midpoint of the front side walls 75 in the front-to-rear direction), the rear wall 73, and the partitioning wall 83 provided between the top wall 87 and the bottom wall 74.

A developing chamber 93 is formed further forward from the toner-accommodating chamber 92 by the front section of the bottom wall 74 including the supply roller accommodating wall 79 and the tongue wall 80, the side walls 72 formed continuously with the front side of the bottom wall 74 (specifically, from the front edge to a midpoint of the front side walls 75 in the front-to-rear direction), and the partitioning wall 83.

In the toner-accommodating chamber 92, the front top wall 88 and rear top wall 89 are disposed parallel to the bottom wall 74 such that the distance between the rear top wall 89 and the bottom wall 74 is greater than the distance between the front top wall 88 and the bottom wall 74. The center top wall 90 is disposed at a slant to the bottom wall 74, sloping toward the top surface side from the front to the rear.

Figure 11:
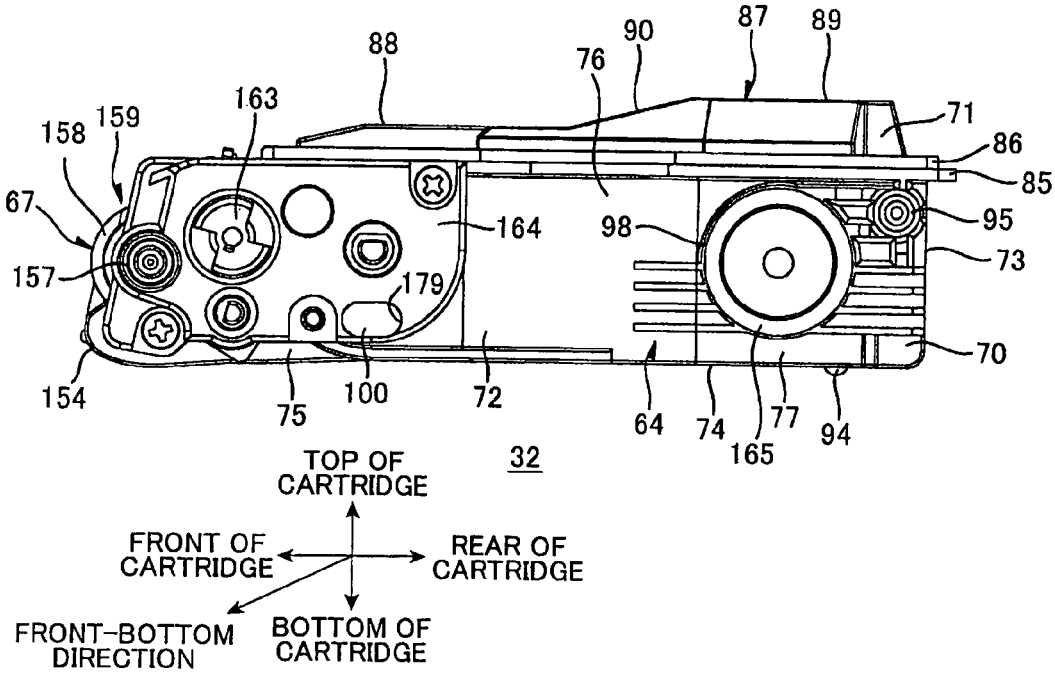
FIG. 11 is a right side view of the developer cartridge.

A toner fill through-hole 98 is formed in one of the rear side walls 77 of the toner-accommodating chamber 92. As shown in FIGS. 8 and 11, the toner fill through-hole 98 is substantially circular in a side view and penetrates the rear side wall 77 in the thickness direction.

The toner fill through-hole 98 is normally covered with a cap 165.

Figure 12:
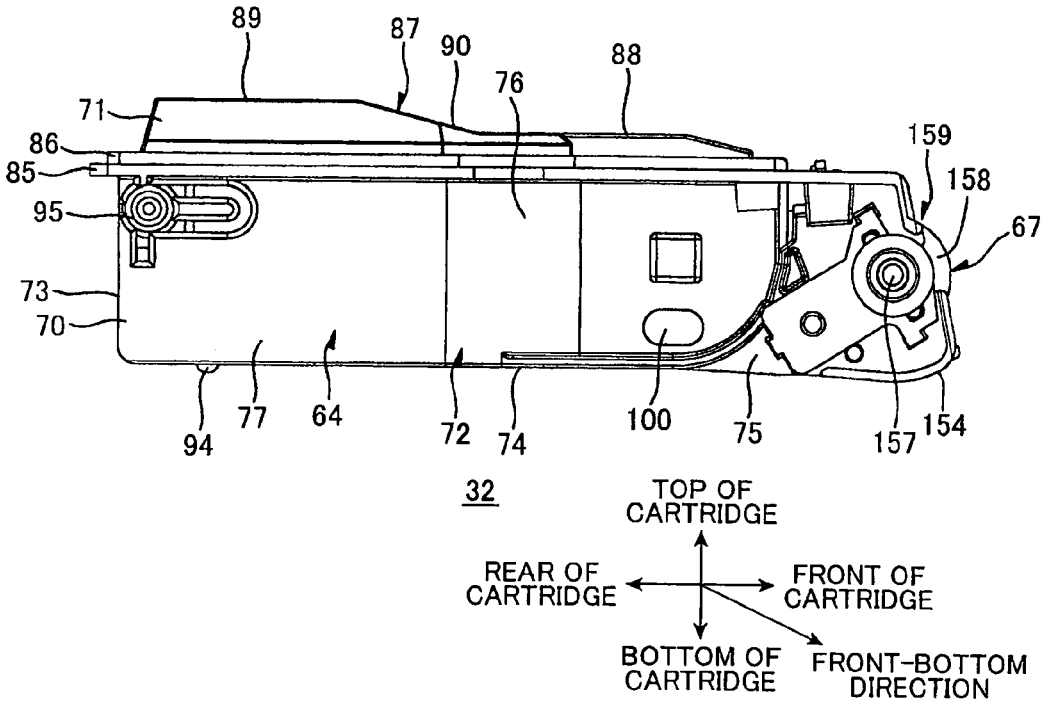
FIG. 12 is a left side view of the developer cartridge.
Figure 13:
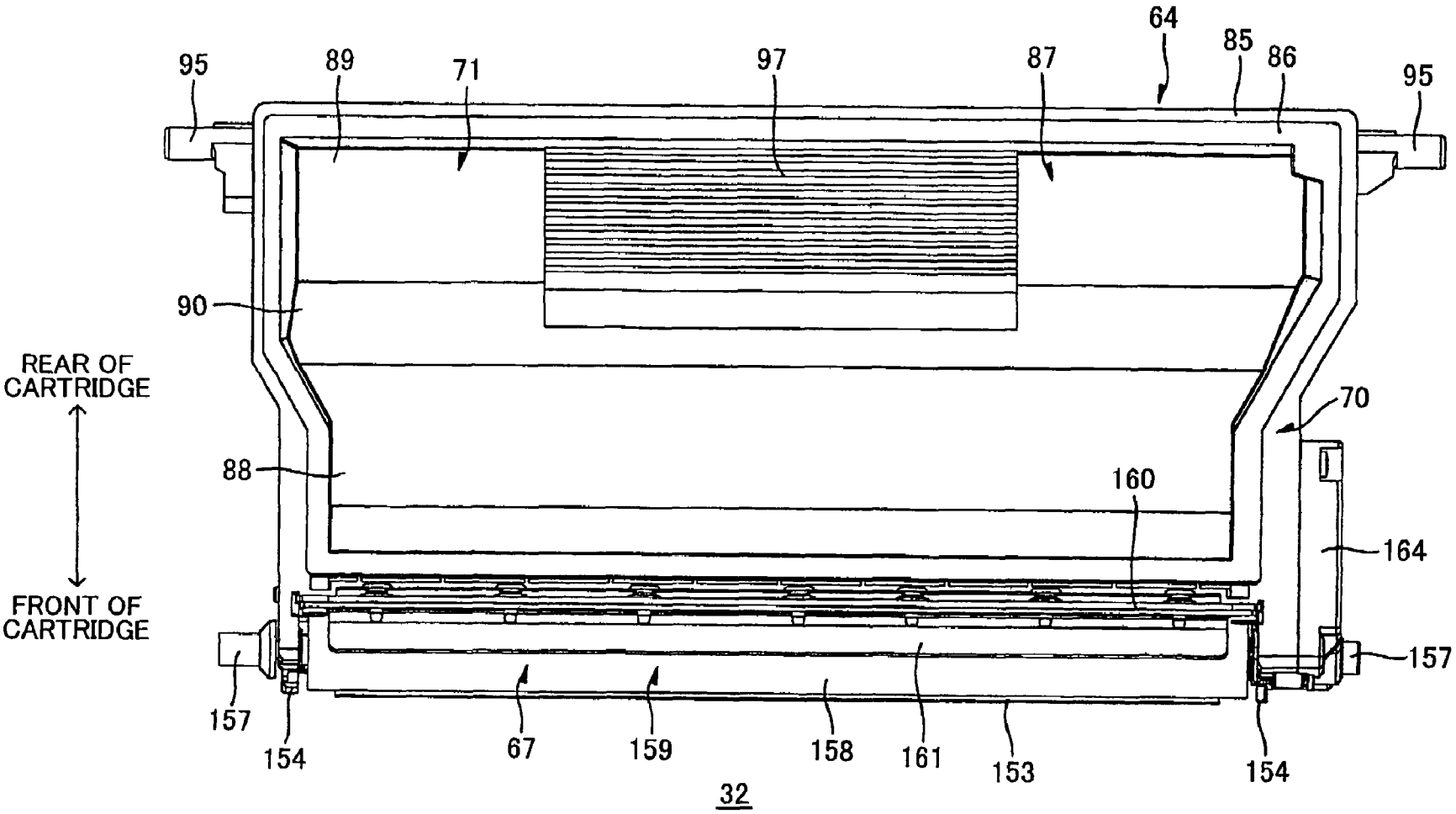
FIG. 13 is a plan view of the developer cartridge.

As shown in FIGS. 11 and 12, detection windows 100 are formed one in each front side wall 75 of the toner-accommodating chambers 92 at corresponding positions in the widthwise direction. The detection windows 100 allow the passage of a detection light for detecting the amount of toner accommodated in the toner-accommodating chamber 92.

Each detection window 100 has a substantially elliptical shape in a side view and extends in the front-to-rear direction. The detection windows 100 are formed by cutting out the shapes in each front side wall 75 and fitting transparent plates formed of a synthetic resin in the cutout areas. By forming the detection windows 100 in a substantially elliptical shape elongated in the front-to-rear direction, an optical sensor 182 described later can transmit a detection light through the detection windows 100 when the developer cartridge 32 is mounted in the developer-accommodating section 14. Further, two detection light transmitting points described later through which the detection light is transmitted can be allocated in the detection windows 100 for a separated position and a contact position to be described later.

The detection windows 100 are formed so that detection light can pass through the front ends thereof when not blocked by residual toner. In other words, if the detection light passes through the front ends of the detection windows 100 when the developer cartridge 32 is mounted in the developer-accommodating section 14 (specifically, when the toner in the toner-accommodating chamber 92 has shifted by its own weight downward toward the discharge opening 84), then it is known that the toner in the toner-accommodating chamber 92 has been consumed to a point that the developer cartridge 32 must be replaced.

The rear end of the detection window 100 is positioned above the front end in the vertical direction by a prescribed interval when the developer cartridge 32 is mounted in the developer-accommodating section 14. In this position, the detection light can pass through the rear ends of the detection windows 100 when toner consumption has progressed to a point slightly before the developer cartridge 32 must be replaced.

As shown in FIG. 18, the agitator 69 includes a pair of agitating members 152 that rotate on a rotational shaft 151. In FIGS. 15(*a*), 15(*b*), and 16, only one of the pair of agitating members 152 is shown for clarity. The outer circular path is defined by the agitating members 152 when the agitating members 152 rotate around the rotational shaft 151. The area of the outer circular path that is projected along the axial direction of the rotational shaft 151 onto each side wall 72 is referred to as an agitator-projected area. The detection windows 100 are formed in the front side walls 75 at positions opposing each other in the widthwise direction so as to be aligned in the thickness direction with the rotational shaft 151 of the agitator 69 and to overlap the agitator-projected area in the front-to-rear direction. The reinforcing post 65 is disposed to the rear of the optical path of the detection light passing through the detection windows 100 so as not to block the detection light.

More specifically, the agitator 69 is disposed inside the toner-accommodating chamber 92 near the discharge opening 84 and includes the rotational shaft 151 that is rotatably supported between the front side walls 75; and the agitating members 152 each having a latticed plate shape (see FIGS. 15(*a*) and 15(*b*)) that is provided on the rotational shaft 151 and protrudes radially from the same.

More specifically, as shown in FIGS. 15(*b*) and 16, each agitating member 152 has: a plurality of plates 152*a*, which are arranged along the axis of the rotational shaft 151 with gaps therebetween and each of which protrudes radially outwardly from the rotational shaft 151; and a connection plate 152*b* that extends parallel to the axis of the rotational shaft 151 and that connects the tip ends of the plates 152*a* with one another. The agitator 69 is disposed near the discharge opening 84 so that the agitating members 152 rotate along the discharge wall 78. As described above, the detection windows 100 are positioned within the agitator-projected area in the front side walls 75.

The reinforcing post 65 is positioned rearward of the agitator 69 in a position that does not overlap the outer circular path of the rotational path of the agitating members 152, so that the reinforcing post 65 is not contacted by the rotating agitating members 152. As shown in FIG. 15(*a*), the toner fill through-hole 98 is also disposed on the side wall 72 at a location rearward of the agitator 69 so as not to overlap the agitator-projected area on the side wall 72.

As shown in FIG. 1, when the developer cartridges 32 are mounted in the color laser printer 1, the toner-accommodating chambers 92 are located in the upper portion of the developer casings 64 (the rear portion in FIG. 8) for accommodating toner of each color used by the color laser printer 1. In the preferred embodiment, the toner-accommodating chambers 92 of each process section 27 accommodate a nonmagnetic, single-component polymerized toner having a positive charging nature. The toner-accommodating chamber 92 of the yellow process section 27Y accommodates a yellow toner, the toner-accommodating chamber 92 of the magenta process section 27M a magenta toner, the toner-accommodating chamber 92 of the cyan process section 27C a cyan toner, and the toner-accommodating chamber 92 of the black process section 27K a black toner.

More specifically, the toner for each color used in the preferred embodiment is a substantially spherical polymerized toner obtained by a polymerization method. The primary component of the polymerized toner is a binding resin obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The base particles are formed by compounding this binding resin with a coloring agent, a charge-controlling agent, wax, and the like. An additive to improve fluidity is also mixed with the base toner particles.

The coloring agent compounded with the binding resin provides one of the colors yellow, magenta, cyan, and black. The charge-controlling agent is a charge-controlling resin obtained by copolymerizing an ionic monomer having an ionic functional group, such as ammonium salt with a monomer that can be copolymerized with an ionic monomer, such as a styrene monomer or an acrylic monomer. The additive may be powder of a metal oxide, such as silica, aluminum oxide, titanium oxide, strontium titanate, cerium oxide, or magnesium oxide, or an inorganic powder, such as a carbide powder or metal salt powder.

As shown in FIG. 16, the developing chamber 93 is provided adjacent to the toner-accommodating chamber 92 and in front of the same and is in fluid communication with the toner-accommodating chamber 92 via the discharge opening 84.

An opening 159 is formed on the front end of the developer cartridge 32 so that the developing chamber 93 is open over a region from the top surface side to the front side. A jaw part 153 is formed on the front end of the tongue wall 80 across the entire width of the developer cartridge 32. The jaw part 153 opposes the peripheral surface of the developing roller 67 disposed in the developing chamber 93 and contacts the bottom surface side of the same to prevent toner from leaking outward.

As shown in FIGS. 11 and 12, runners 154 are formed on the front part on the bottom surface side of the front side walls 75 at positions opposing the jaw part 153 in the widthwise direction. The runners 154 are formed similar to a curved L shape in a side view and protrude further than the jaw part 153 in the front-bottom direction as indicated in the figures. As shown in FIG. 16, the supply roller 66 is disposed in the developing chamber 93 in front of the discharge opening 84 and extends in the widthwise direction so as to be accommodated in the supply roller accommodating wall 79.

The supply roller 66 includes a metal supply roller shaft 155 rotatably supported between the front side walls 75; and a supply roller layer 156 formed of an electrically conductive sponge member that covers the periphery of the supply roller shaft 155.

The developing roller 67 is disposed in the developing chamber 93 at a position diagonally forward and toward the top surface side from the supply roller 66 and extends in the widthwise direction so as to confront the tongue wall 80. The developer roller 67 includes a metal developer roller shaft 157 that is rotatably supported between the front side walls 75 and a developer roller layer 158 formed of an electrically conductive rubber material that covers the developer roller shaft 157. More specifically, the developer roller layer 158 has a two-layer construction including an elastic roller layer formed of an electrically conductive urethane rubber, silicone rubber, or EPDM rubber containing fine carbon particles or the like, and a coating layer covering the surface of the roller layer and having the primary component of urethane rubber, urethane resin, polyimide resin, or the like.

The developing roller 67 and supply roller 66 are disposed so as to contact each other with pressure. As shown in FIG. 8, the developing roller 67 is disposed in the front end of the developing chamber 93 so that the front surface of the developing roller 67 is exposed through the opening 159. As described above, the jaw part 153 contacts the developing roller 67 with pressure on the bottom surface of the exposed front part.

The thickness-regulating blade 68 is provided on the front surface of the partitioning wall 83 across the entire width of the same. As shown in FIG. 16, the thickness-regulating blade 68 includes a blade 160 formed of a metal leaf spring member; a fixing member 161 for gripping the top surface side end of the blade 160 and fixing the blade 160 to the front surface of the partitioning wall 83; and a pressing part 162 disposed on the bottom surface side end of the blade 160. The pressing part 162 has a semicircular cross-section and is formed of an insulating silicone rubber. The thickness-regulating blade 68 is disposed so that the blade 160 extends in the thickness direction of the developer cartridge 32, with the top surface side end fixed to the front surface of the partitioning wall 83 by the fixing member 161, and so that the pressing part 162 provided on the bottom surface side end is pushed against the rear side of the developer roller layer 158 on the developing roller 67 by the elastic force of the blade 160.

As shown in FIGS. 8 and 11, a gear train (not shown), an agitator drive gear (not shown), a supply roller drive gear (not shown), and a developer roller drive gear (not shown) are provided on the outer surface of the front side wall 75 on one of the side walls 72. The gear train transfers a driving force to the agitator drive gear (not shown), the supply roller drive gear (not shown), and the developer roller drive gear (not shown). The agitator drive gear (not shown) is disposed on an end of the rotational shaft 151 protruding from the outer surface of the same side wall 72. The supply roller drive gear (not shown) is provided on an end of the supply roller shaft 155 protruding from the outer surface of the same side wall 72. The developer roller drive gear (not shown) is provided on an end of the developer roller shaft 157 protruding from the outer surface of the same side wall 72. A female coupling part 163 for inputting a driving force into the gear train is also provided on the outer surface of the front side wall 75 on the same side wall 72. The gear train and the female coupling part 163 are accommodated in and supported by a gear cover 164 disposed on the outer surface of the front side wall 75.

A cover detection through-hole 179 is formed in the gear cover 164 at a position corresponding to one of the detection windows 100 in the widthwise direction. In a side view, the cover detection through-hole 179 has a substantially elliptical shape corresponding to the detection window 100 that is elongated in the front-to-rear direction.

As shown in FIG. 17, guiding grooves 101 are formed in each of the process-accommodating sections 12. By inserting both ends of the drum shaft 60 in the drum cartridge 31 into the corresponding guiding grooves 101, the guiding grooves 101 guide the drum cartridge 31 as the drum cartridge 31 is mounted into or removed from the main casing 2. The guiding grooves 101 are formed as depressions in the inside surfaces of the left side plate 8 and right side plate 9 at corresponding positions in the widthwise direction, slanting rearward from top to bottom along the mounting direction of the drum cartridges 31 as shown in FIG. 18.

The lower end (deepest end) of each guiding groove 101 is a receiving part 102 (see FIG. 18) for receiving the drum shaft 60. The receiving part 102 is formed as a depression in which the drum shaft 60 perfectly fits in the front-to-rear direction and is positioned so that, when the drum shaft 60 is received in the receiving parts 102, the photosensitive drum 42 is positioned in contact with a conveying belt 168 described later.

Drum positioning grooves 103 are formed in the left side plate 8 and right side plate 9 at corresponding widthwise positions. The drum positioning grooves 103 are located at the midway positions in the lengths of the guiding grooves 101. The drum positioning grooves 103 are depressions that are rectangular-shaped in a side view and open on the front for receiving the drum bosses 56.

Figure 19:
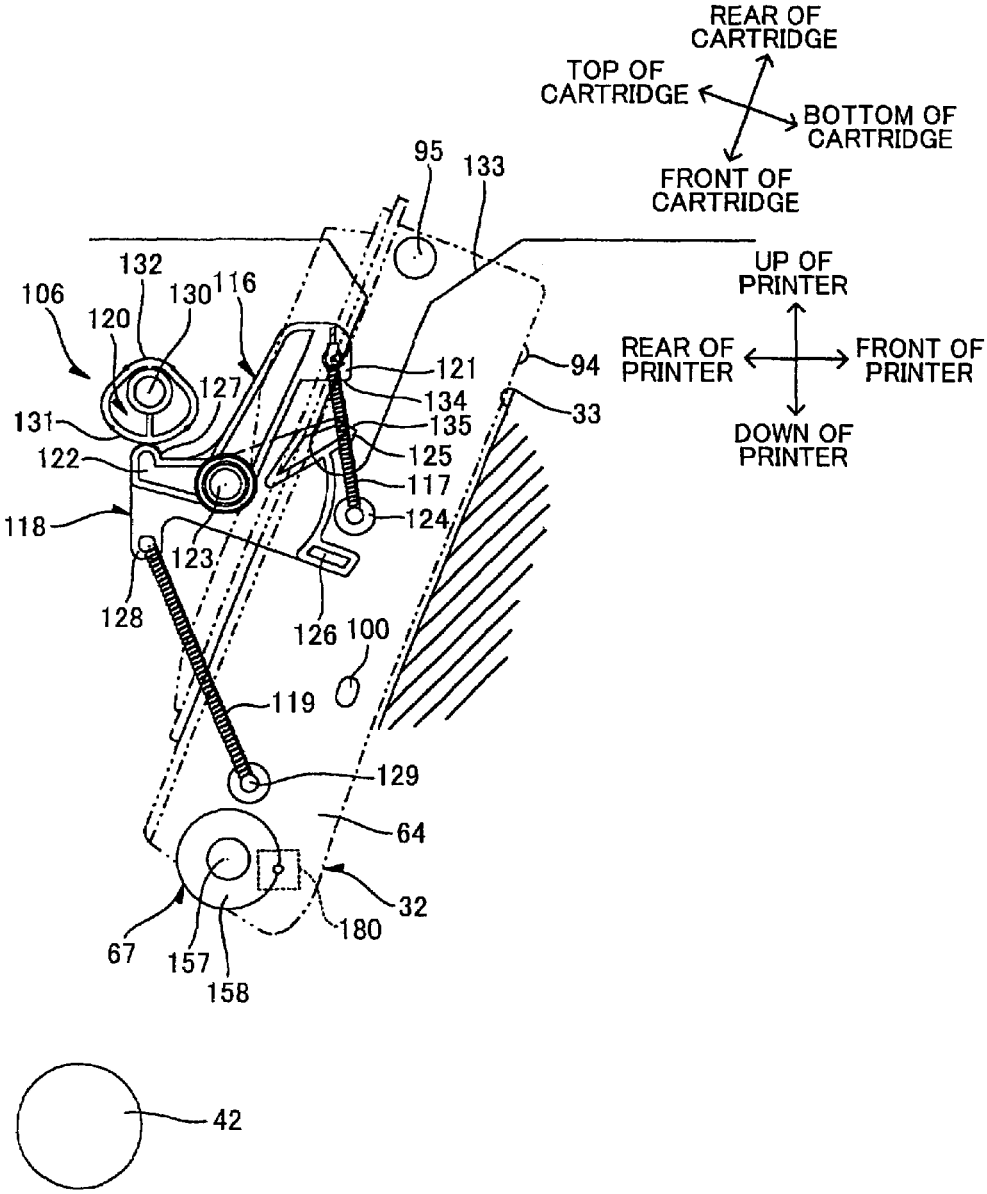
FIG. 19 is a side view showing the mounted state of the developer cartridge in the process accommodating section (prior to inserting the developer boss parts into the boss insertion grooves)

As shown in FIG. 17, boss insertion grooves 133 are formed in the upper side of the guiding grooves 101 as cutout portions in the left side plate 8 and right side plate 9 for receiving the developer boss parts 95 of the developer cartridge 32. As shown in FIG. 19, the boss insertion grooves 133 are formed as straight, substantially elongated U-shaped notches in the upper ends of the left side plate 8 and right side plate 9 that slant rearward from top to bottom along the mounting direction of the developer cartridge 32, that is, along a path that the developer boss parts 95 move when the developer cartridge 32 is mounted or removed. Further, the boss insertion grooves 133 are formed deep enough that the bottoms of the boss insertion grooves 133 are deeper than the position of the developer boss parts 95 when the developer cartridge 32 is mounted on the drum cartridge 31. The boss insertion grooves 133 also have sufficient width in the front-to-rear direction that the developer boss parts 95 fit into the boss insertion grooves 133 with some play. The upper end of the boss insertion grooves 133 has a substantially triangular shape growing wider toward the top to facilitate reception of the developer boss parts 95.

Figure 22:
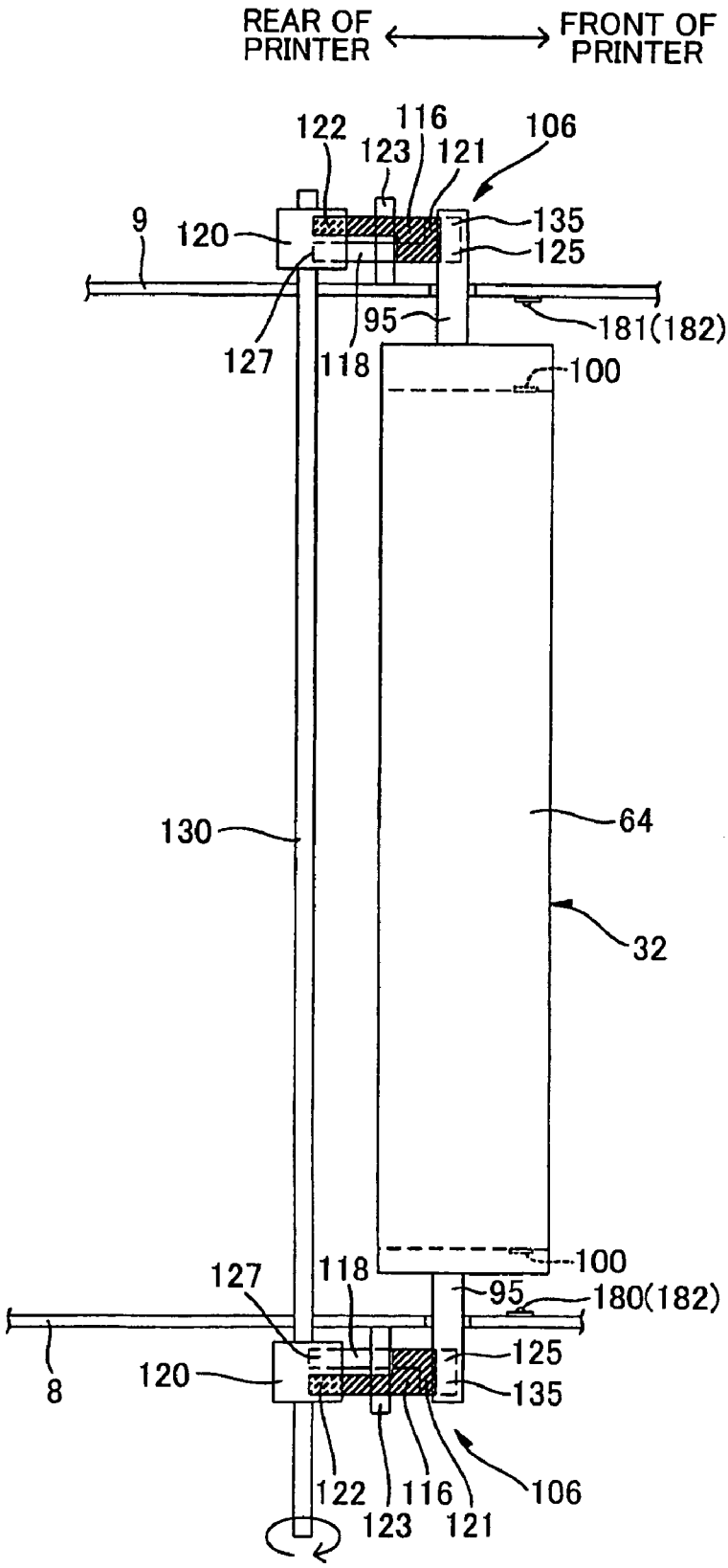
FIG. 22 is a plan view showing the mounted state of the developer cartridge in the process accommodating section (separated state)
Figure 23:
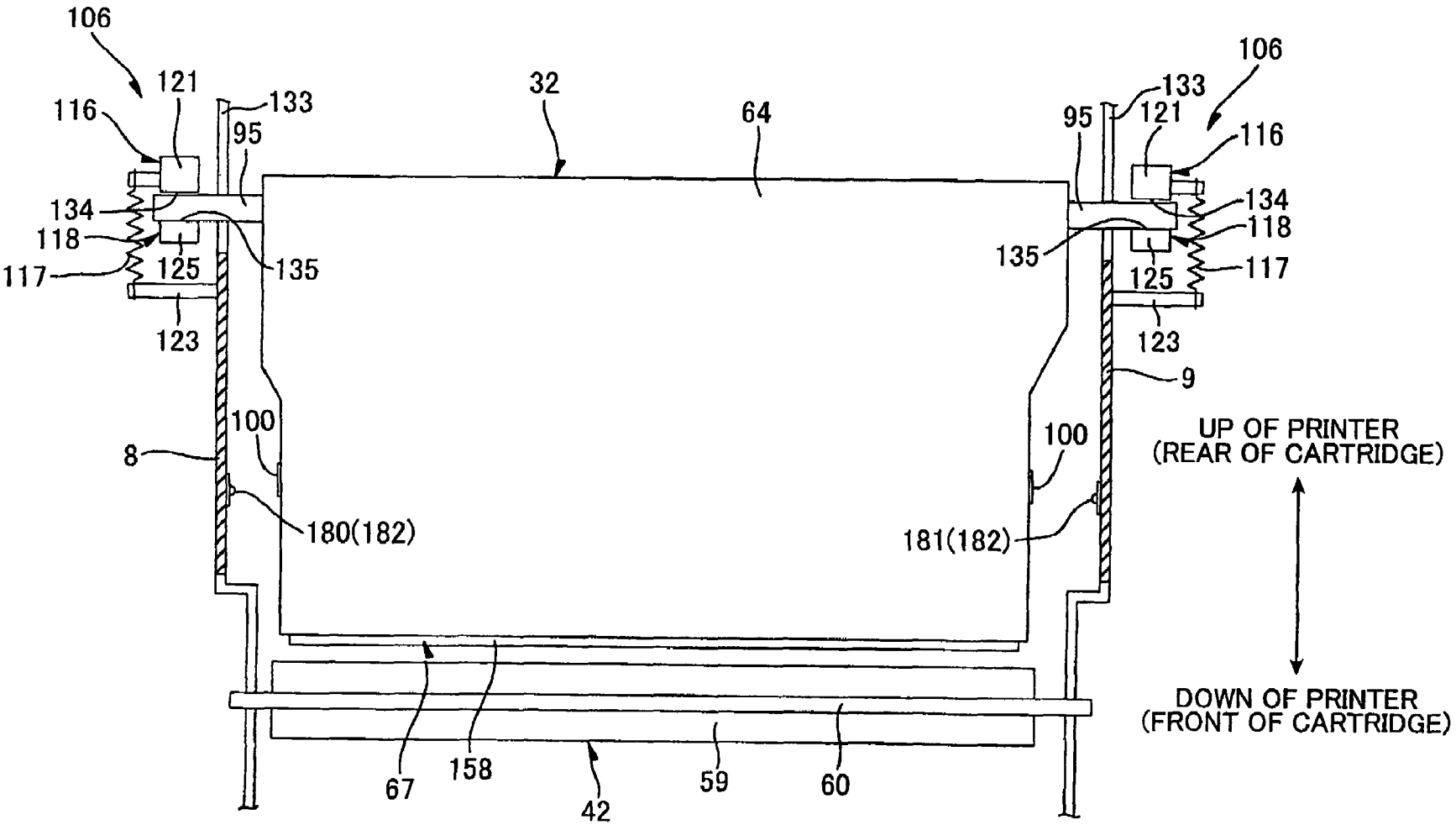
FIG. 23 is a front view showing the mounted state of the developer cartridge in the process accommodating section (separated state)

As shown in FIGS. 22 and 23, a light-emitting unit 180 and a light-receiving unit 181 are provided on the inner surfaces of the left side plate 8 and right side plate 9, respectively. The light-emitting unit 180 and light-receiving unit 181 constitute the optical sensor 182 functioning to detect the amount of residual toner in the toner-accommodating chamber 92 of the developer cartridge 32. The light-emitting unit 180 and light-receiving unit 181 face each other in the widthwise direction across the developer-accommodating section 14.

Specifically, the light-emitting unit 180 and light-receiving unit 181 face each other through the detection windows 100 when the developer cartridge 32 is in a separated position shown in FIG. 22 described later. The light-emitting unit 180 and light-receiving unit 181 face each other through the detection windows 100 also when the developer cartridge 32 is in a contact position shown in FIG. 24 described later. In other words, a line connecting the light-emitting unit 180 and light-receiving unit 181 intersects the detection windows 100 within both of the front-to-rear dimension and the widthwise dimension of the detection windows 100 both of when the developer cartridge 32 is in the separated position and when the developer cartridge 32 is in the contact position.

Figure 25:
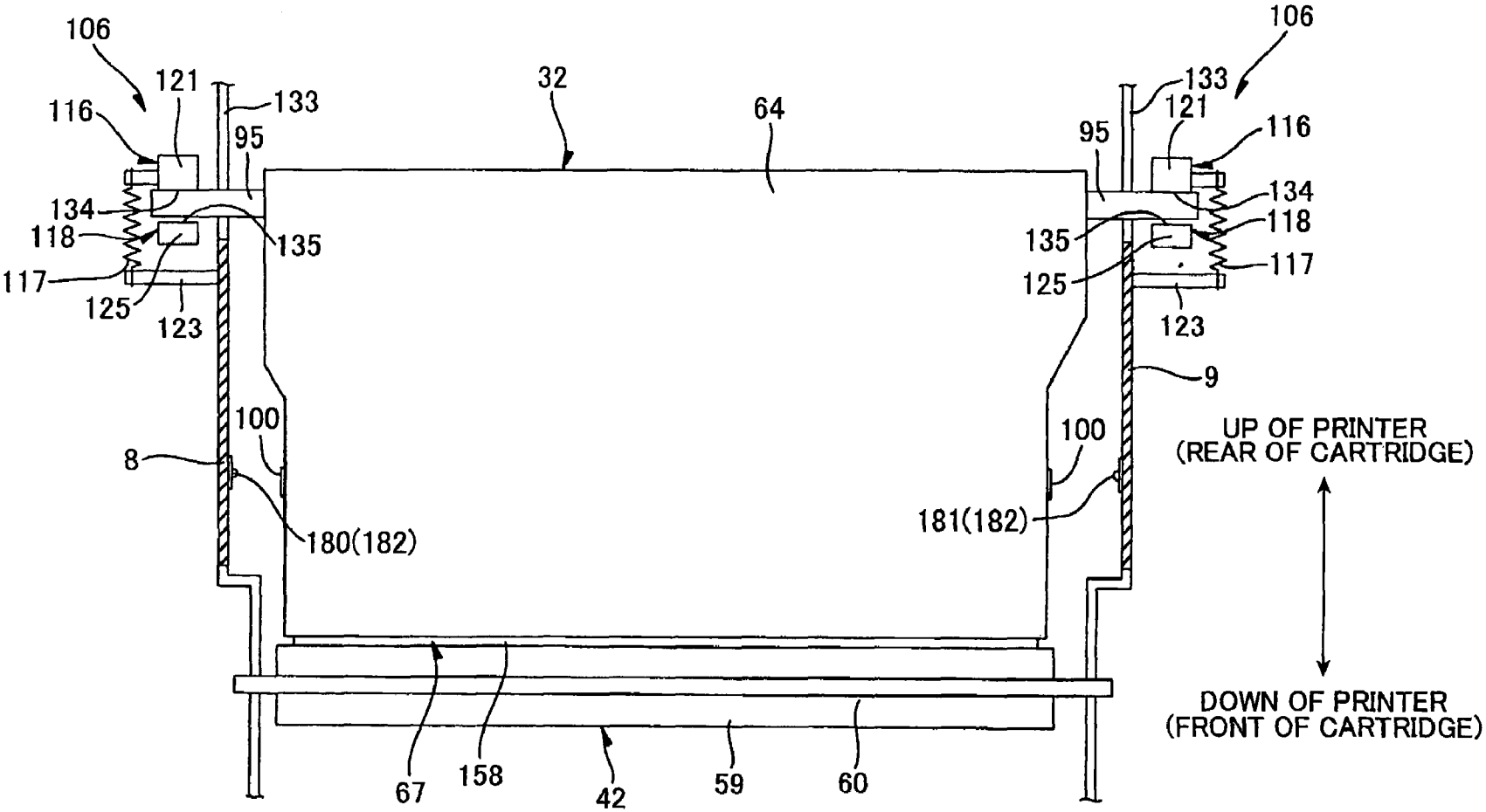
FIG. 25 is a front view showing the mounted state of the developer cartridge in the process accommodating section (contact state)

More specifically, the light-emitting unit 180 and light-receiving unit 181 are positioned to oppose a lower end of the detection windows 100 (the lower end when the developer cartridge 32 is accommodated in the developer-accommodating section 14) when the developer cartridge 32 is in the separated position shown in FIG. 23, and to oppose a top end of the detection windows 100 (the top end when the developer cartridge 32 is accommodated in the developer-accommodating section 14) when the developer cartridge 32 is in the contact position shown in FIG. 25.

The light-emitting unit 180 is configured of a light-emitting element that emits a laser light or other light with high directivity into one of the detection windows 100 as the detection light. The light-receiving unit 181 is configured of a light-receiving element for receiving the detection light outputted from the other detection window 100.

As shown in FIG. 19, a contacting/separating mechanism 106 is provided on each of the left and right side plates 8 and 9 for placing the developer cartridge 32 in contact with and separating the developer cartridge 32 from the drum cartridge 31.

As shown in FIG. 19, the contacting/separating mechanism 106 is disposed one near each of the boss insertion grooves 133 on the outer surface of each of the left side plate 8 and right side plate 9. The contacting/separating mechanism 106 includes a first pressing member 116 for pressing the developer boss part 95 in the mounting direction, a first urging spring 117 for urging the first pressing member 116, a second pressing member 118 for pressing the developer boss part 95 in the removal direction, a second urging spring 119 for urging the second pressing member 118, and a cam 120 disposed in confrontation with the first pressing member 116 and the second pressing member 118.

The first pressing member 116 is substantially shaped like the letter V with one leg connected to the other leg via a bent portion. When the first pressing member 116 is in a separated state described later with reference to FIG. 20, one leg of the first pressing member 116 is parallel to the boss insertion grooves 133, while the other leg extends in the front-to-rear direction. A boss contact part 121 is formed on a distal end of the first leg for contacting the developer boss part 95. The boss contact part 121 is formed at an angle to the first leg so as to extend forward from the end of the first leg when the first pressing member 116 is in the separated state. The bottom surface of the boss contact part 121 is formed as an upper pressing surface 134 for pressing the developer boss part 95 from above. The upper pressing surface 134 is formed so as to contact the developer boss part 95 at a slant, simultaneously generating a pressing force for pressing the developer boss part 95 in the mounting direction and a pressing force for pressing the developer boss part 95 toward the front edge of the boss insertion groove 133, which edge serves as a reference surface. A cam contact part 122 is formed on the other distal end of the first pressing member 116 on the second leg for contacting the cam 120. The cam contact part 122 protrudes upward from the other end when the first pressing member 116 is in the separated state.

The first pressing member 116 is rotatably supported at the bent part thereof on a support shaft 123. The support shaft 123 is provided on the outer surface of the left side plate 8 and right side plate 9 and protrudes outward in the widthwise direction from a position behind the bottom end (deepest part) of the boss insertion groove 133. With this construction, the first pressing member 116 is provided so that the boss contact part 121 can advance into or retract from the boss insertion groove 133, that is, the moving path of the developer boss part 95, in the front-to-rear direction; while the cam contact part 122 can contact or separate from the bottom side of the cam 120 on the opposite side of the support shaft 123 from the boss insertion groove 133.

With this arrangement, the support shaft 123 is disposed downstream of the boss contact part 121 with respect to the mounting direction of the developer boss part 95.

The first urging spring 117 is a tension spring having one end fixed to a first fixing shaft 124 that protrudes from a position on the outer surface of the respective left side plate 8 and right side plate 9 below the bottom end (deepest part) of the boss insertion grooves 133. The other end of the first urging spring 117 is engaged in the cam contact part 121. Hence, the first urging spring 117 constantly urges the first pressing member 116 in a direction for moving the boss contact part 121 toward the moving path of the developer boss parts 95 (forward) and for moving the cam contact part 122 near the cam 120 (upward).

Figure 20:
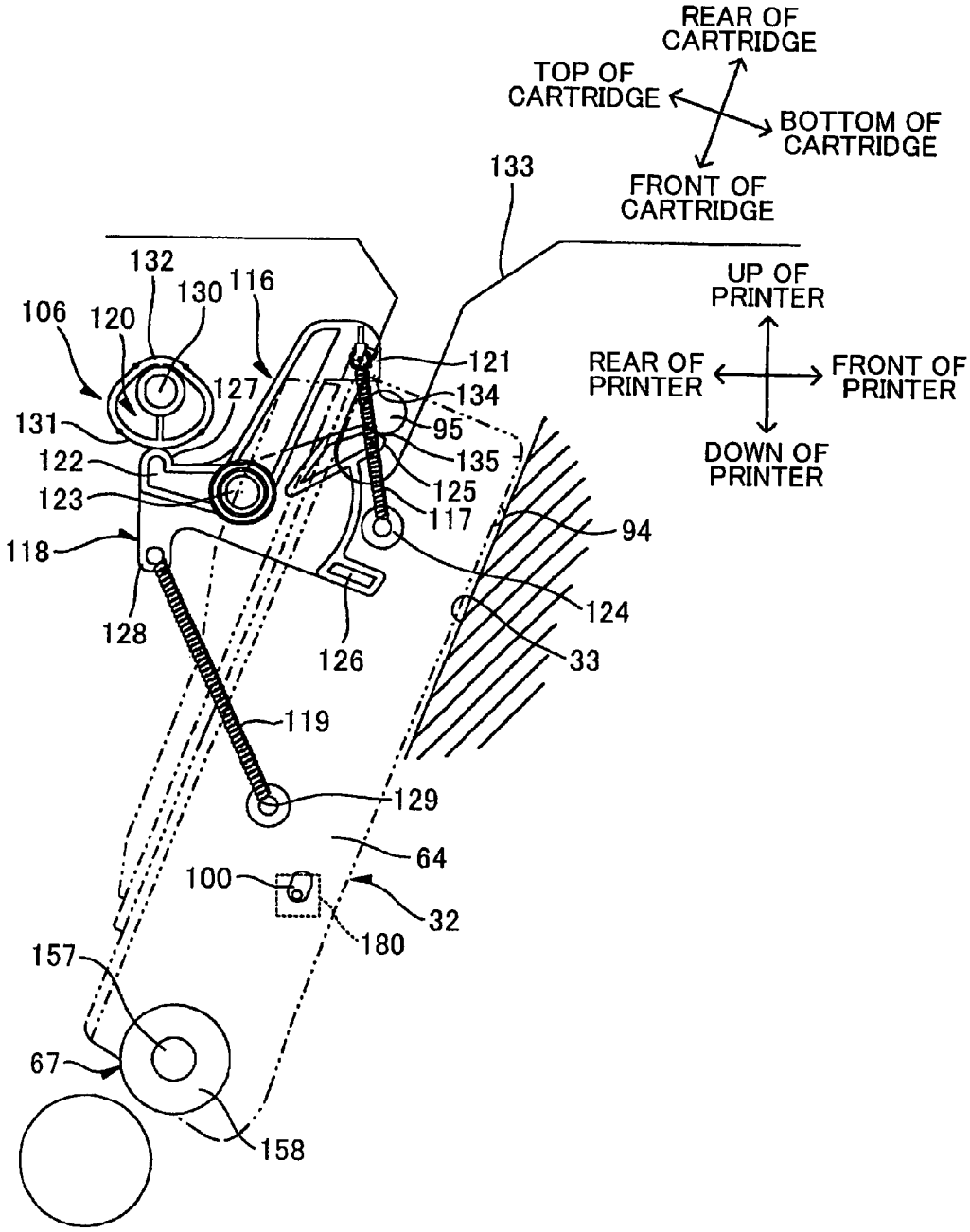
FIG. 20 is a side view showing the mounted state of the developer cartridge in the process accommodating section (separated state)

The second pressing member 118 has a substantially rectangular plate shape. A boss contact pawl part 125 is provided on the upper front corner of the second pressing member 118 for contacting the developer boss parts 95. The boss contact pawl part 125 protrudes diagonally upward and forward when the second pressing member 118 is in the separated state. Further, a rotation restricting pawl part 126 that is capable of contacting the first fixing shaft 124 is provided on the lower front corner of the second pressing member 118 and protrudes diagonally downward and forward when the second pressing member 118 is in the separated state. A cam contacting protrusion 127 for contacting the cam 120 is also provided on the upper edge of the second pressing member 118 near the rear end and protrudes upward when the second pressing member 118 is in the separated state. A spring engaging protrusion 128 for engaging with the other end of the second urging spring 119 is provided on the lower edge of the second pressing member 118 near the rear end and protrudes downward when the second pressing member 118 is in the separated state (FIG. 20).

The second pressing member 118 is rotatably supported on the support shaft 123 at a midpoint in the front-to-rear direction. In this way, the boss contact pawl part 125 extends toward a midpoint of the boss insertion groove 133, that is, a midpoint of the moving path of the developer boss part 95 at a position downstream of the boss contact part 121 in the mounting direction of the developer boss part 95 and can move in the mounting direction or removal direction of the developer boss part 95. Further, the rotation restricting pawl part 126 can contact or separate from the first fixing shaft 124, and the cam contacting protrusion 127 can contact or separate from the lower side of the cam 120 on the opposite side of the support shaft 123 from the boss insertion groove 133.

The second urging spring 119 is a tension spring having one end fixed to a second fixing shaft 129 provided on the outer surface of the respective left side plate 8 and right side plate 9. The second fixing shaft 129 protrudes outward in the widthwise direction from a position below the first fixing shaft 124. The other end of the second urging spring 119 is engaged in the spring engaging protrusion 128. With this construction, the second urging spring 119 constantly urges the second pressing member 118 in a direction by which the boss contact pawl part 125 presses the developer boss part 95 in the removal direction along the moving path of the developer boss parts 95 (upward), by which the rotation restricting pawl part 126 moves toward the first fixing shaft 124 (upward), and by which the cam contacting protrusion 127 separates from the cam 120 (downward).

The spring constant of the second urging spring 119 is set smaller than that of the first urging spring 117.

As shown in FIG. 22, both the first pressing member 116 and the second pressing member 118 are rotatably supported on the support shaft 123, with the first pressing member 116 disposed on the widthwise outer side of the second pressing member 118. The boss contact part 121 of the first pressing member 116 protrudes inward in the widthwise direction, while the boss contact pawl part 125 of the second pressing member 118 protrudes outward in the widthwise direction so that the upper pressing surface 134 of the boss contact part 121 overlaps a lower side pressing surface 135 of the boss contact pawl part 125 in the moving direction of the developer boss parts 95.

As shown in FIG. 19, the cam 120 is shaped somewhat like a folding fan. The cam 120 is coupled to a camshaft 130 and is incapable of rotating relative to the camshaft 130. The camshaft 130 is rotatably supported in the left side plate 8 and right side plate 9 and protrudes outward in the widthwise direction from a position above and behind the support shaft 123. The cam 120 is formed with a continuous peripheral surface that includes a contact surface 131 having an arc shape, and a separating surface 132 formed on the side opposite the contact surface 131 and shaped substantially like the letter V with a corner portion in the center thereof.

By rotating the camshaft 130, the cam 120 can be oriented to selectively position the contact surface 131 or separating surface 132 opposite the cam contact part 122 of the first pressing member 116 and the cam contacting protrusion 127 of the second pressing member 118.

While the developer cartridge 32 is mounted in the developer-accommodating section 14, during non-image-forming operations, the contact surface 131 of the cam 120 contacts the cam contact part 122 and the cam contacting protrusion 127 to push the first pressing member 116 and the second pressing member 118 downward in the separated state in which the photosensitive drum 42 is separated from the developing roller 67 as shown in FIGS. 20, 22, and 23.

Although the first urging spring 117 pulls the boss contact part 121 of the first pressing member 116 downward, in the separated state the first pressing member 116 is rotated against the urging force of the first urging spring 117 so that the boss contact part 121 is retracted from the moving path of the developer boss parts 95.

Also in the separated state, the second pressing member 118 is rotated in a direction that compresses the second urging spring 119 and, by a pressing force larger than the urging force of the second urging spring 119, moves the boss contact pawl part 125 in a direction for pressing the developer boss parts 95 in the removal direction and moves the rotation restricting pawl part 126 toward the first fixing shaft 124. In this separated state, the boss contact pawl part 125 is disposed on the moving path of the developer boss parts 95 at a position upstream of a contact state described later (FIGS. 21, 24, and 25) with respect to the mounting direction of the developer boss parts 95.

Figure 26A:
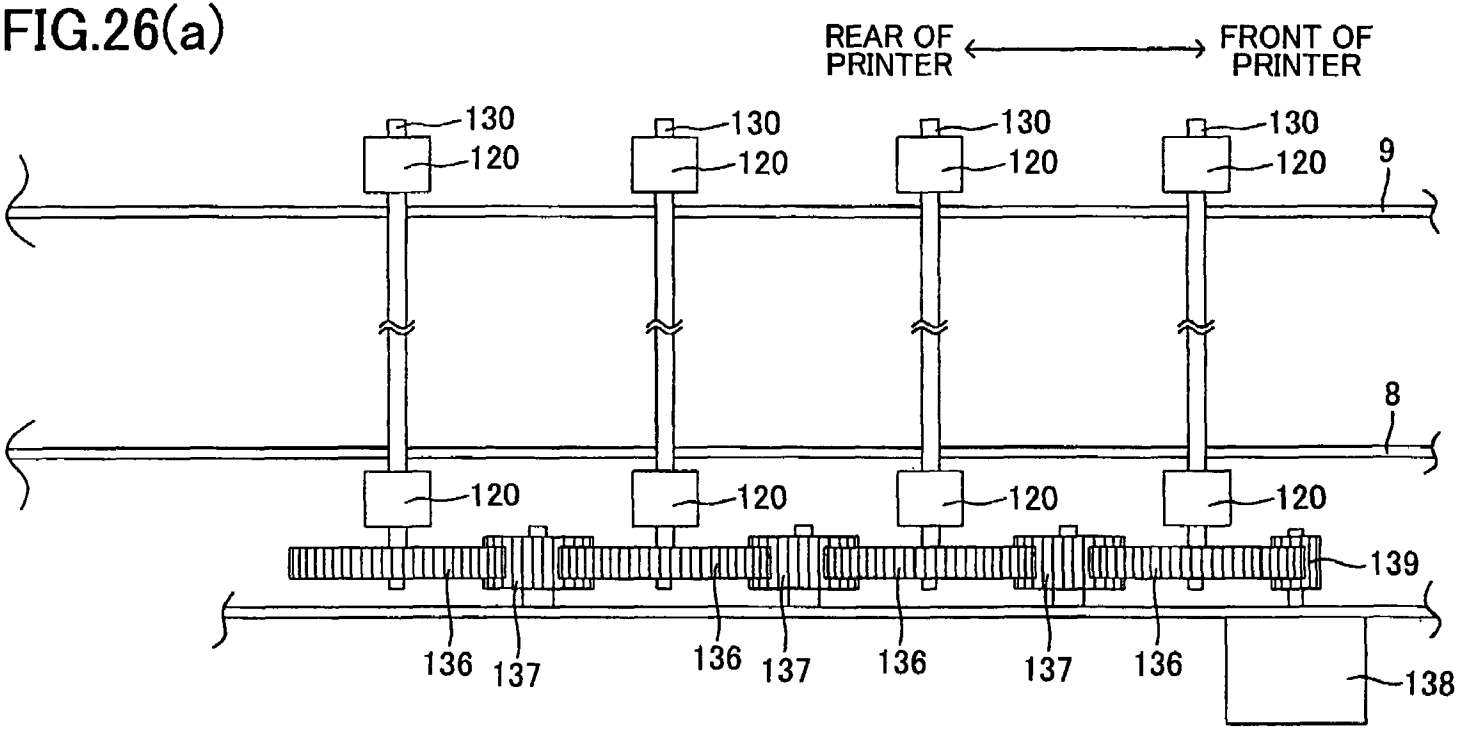
FIG. 26(*a*) is a plan view and FIG. 26(*b*) a side view showing the structure of a cam driving path.
Figure 26B:
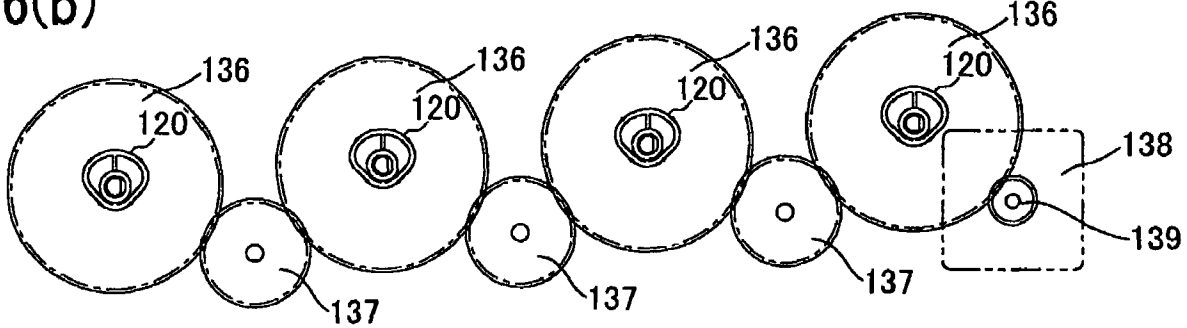

As shown in FIG. 26(*a*), the contacting/separating mechanism 106 is provided for each process-accommodating section 12, and in each process-accommodating section 12 the camshaft 130 spans between the left side plate 8 and right side plate 9 and is rotatably supported in the left side plate 8 and right side plate 9, and the cams 120 are coupled with the camshaft 130, one on each end thereof. While not shown in the drawing, a pair of the first pressing members 116 and a pair of the second pressing members 118 is provided in each process-accommodating section 12 to correspond to the pair of cams 120.

A cam drive gear 136 is coupled with the end of each camshaft 130 protruding from the outside of the left side plate 8. The cam drive gear 136 is incapable of rotating relative to the camshaft 130. An intermediate gear 137 is provided between adjacent cam drive gears 136 and is engaged with the cam drive gears 136. With this construction, a gear train is formed of the cam drive gears 136 and intermediate gears 137, as shown in FIG. 26(*b*). A motor 138 is provided for generating a driving force for driving each of the camshafts 130. The driving force generated by the motor 138 is inputted into the gear train via a pinion gear 139. This driving force is transferred to the camshafts 130 via the gear train for rotating each of the camshafts 130. Accordingly, the pairs of cams 120 are rotated simultaneously to selectively position either the contact surface 131 or the separating surface 132 opposite the cam contact part 122 of the first pressing member 116 and the cam contacting protrusion 127 of the second pressing member 118.

With the color laser printer 1 according to the preferred embodiment, as shown in FIG. 18, each drum cartridge 31 is mounted in the main casing 2 by mounting the drum cartridge 31 for each color into the corresponding drum-accommodating section 13 of the corresponding process-accommodating section 12. Subsequently, the developer cartridge 32 of each color is mounted into the corresponding developer-accommodating section 14 and is thereby mounted on the corresponding drum cartridge 31.

More specifically, to mount the drum cartridge 31 in the drum-accommodating space 15 of the process-accommodating section 12, the user grips the drum grip 57, inserts the drum bosses 56 of the drum cartridge 31 into the corresponding guiding grooves 101, and pushes the drum cartridge 31 downward, as shown in FIG. 18. As a result, the drum cartridge 31 passes through the developer-accommodating section 14, and is finally mounted in the drum-accommodating section 13.

When the holder unit 43 of the drum cartridge 31 passes through the developer-accommodating space 16 of the developer-accommodating section 14, the ridges 51 of the drum cartridge 31 frequently slide against the rail parts 17 of the developer-accommodating section 14 as the drum cartridge 31 is mounted. In this way, since the ridges 51 protrude toward the rail parts 17 and the rail parts 17 are formed of thick strips, the ridges 51 contact the rail parts 17 to form a gap between the front wall 34 of the scanner casing 35 and the top wall 46 opposing the front wall 34, thereby preventing the top wall 46 from rubbing against the front wall 34 of the scanner casing 35.

Then, the drum bosses 56 are inserted into the corresponding drum-positioning grooves 103. As a result, the drum cartridge 31 is accommodated in the drum-accommodating space 15 with the extended part 44 accommodated in the extended accommodating space 18 of the developer-accommodating section 14. In this way, the drum cartridge 31 is mounted in the main casing 2.

In the color laser printer 1 having the construction described above, the front wall 34 of the scanner casing 35 protrudes into the process-accommodating section 12 toward the developer-accommodating space 16, restricting passage of the drum cartridge 31 through the developer-accommodating section 14 when the developer cartridge 32 is mounted on the drum cartridge 31 in the developer-accommodating section 14. However, the drum cartridge 31 is allowed to pass through the developer-accommodating space 16 of the developer-accommodating section 14 when the developer cartridge 32 is separated from the drum cartridge 31.

By forming the front wall 34 of the scanner casing 35 to expand toward the developer-accommodating space 16, the drum cartridge 31 can be passed through the developer-accommodating space 16 without conflicting with the front wall 34 of the scanner casing 35 and can be mounted in the drum-accommodating section 13 and accommodated in the drum-accommodating space 15 when separated from the developer cartridge 32, without simply allocating additional space for the mounting paths of the drum cartridge 31 and the developer cartridge 32. Subsequently, as described below, the developer cartridge 32 can be mounted in the developer-accommodating section 14 and accommodated in the developer-accommodating space 16, thereby completing the process of mounting both the drum cartridge 31 and developer cartridge 32.

When the holder unit 43 is accommodated in the drum-accommodating space 15 of the drum-accommodating section 13, the ridges 51 pass over the rail parts 17 to a position below the scanner casing 35. At this time, the top portion of the charger 62 is disposed below the scanner casing 35, as shown in FIG. 18. In addition, the photosensitive drum 42 is in contact with the conveying belt 168 described later.

Next, the user grips the developer cartridge 32 on the bottom grip part 96 and top side grip part 97, lines up the developer bosses 95 with the corresponding boss insertion grooves 133, as shown in FIG. 19, and pushes the developer cartridge 32 downward. The developer bosses 95 are inserted into the corresponding boss insertion grooves 133 and come into contact with the boss contact pawls 125 that protrude into the moving path of the developer bosses 95, as shown in FIG. 20. The developer bosses 95 press the boss contact pawls 125 in the mounting direction. However, since the cam contact parts 122 are contacting the contact surfaces 131 of the cams 120, rotation of the second pressing members 118 is restricted.

Hence, the developer boss parts 95 are restricted from moving further in the mounting direction and are halted at the contact position with the boss contact pawl parts 125. As a result, as shown in FIG. 20, FIG. 22 and FIG. 23, the developer cartridge 32 is held in a separated state from the drum cartridge 31 in which a slight gap is maintained between the photosensitive drum 42 and the developing roller 67. In this way, the developer cartridge 32 is accommodated in the developer-accommodating space 16 of the developer-accommodating section 14 and is mounted on the drum cartridge 31, which has previously been mounted in the main casing 2.

When the color laser printer 1 of the preferred embodiment is performing a non-image-forming operation, the developer cartridge 32 is maintained in a separated state from the drum cartridge 31, whereby the developing roller 67 is separate from the photosensitive drum 42. During an image-forming operation, the developer cartridge 32 is in a contact state in which the developing roller 67 contacts the photosensitive drum 42.

Specifically, in a separated state, the contact surface 131 of the cam 120 is in contact with the cam contact part 122 of the first pressing member 116 and the cam contacting protrusion 127 of the second pressing member 118. To shift from the separated state to the contact state, the cam 120 is rotated until the separating surface 132 of the cam 120 opposes the cam contact part 122 of the first pressing member 116 and the cam contacting protrusion 127 of the second pressing member 118.

To rotate the cam 120, as shown in FIGS. 26(*a*) and 26(*b*), the motor 138 inputs a driving force into the camshafts 130 via the pinion gear 139 and the gear train configured of the cam drive gears 136 and intermediate gears 137 in order to rotate the camshafts 130. Through this operation, the pairs of cams 120 are rotated simultaneously until the separating surfaces 132 of the cams 120 are positioned opposite the cam contact parts 122 of the first pressing members 116 and the cam contacting protrusions 127 of the second pressing members 118.

Figure 21:
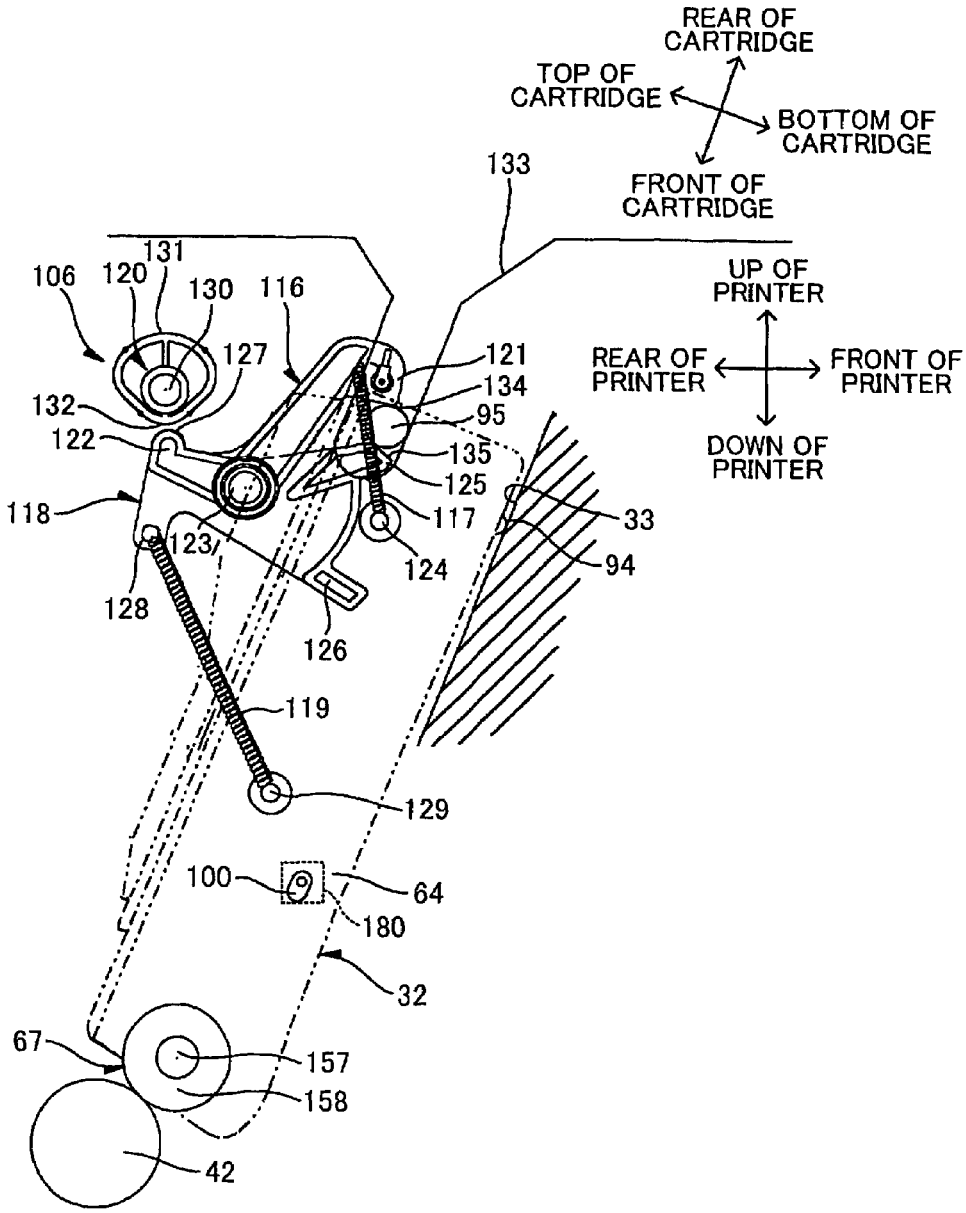
FIG. 21 is a side view showing the mounted state of the developer cartridge in the process accommodating section (contact state)
Figure 24:
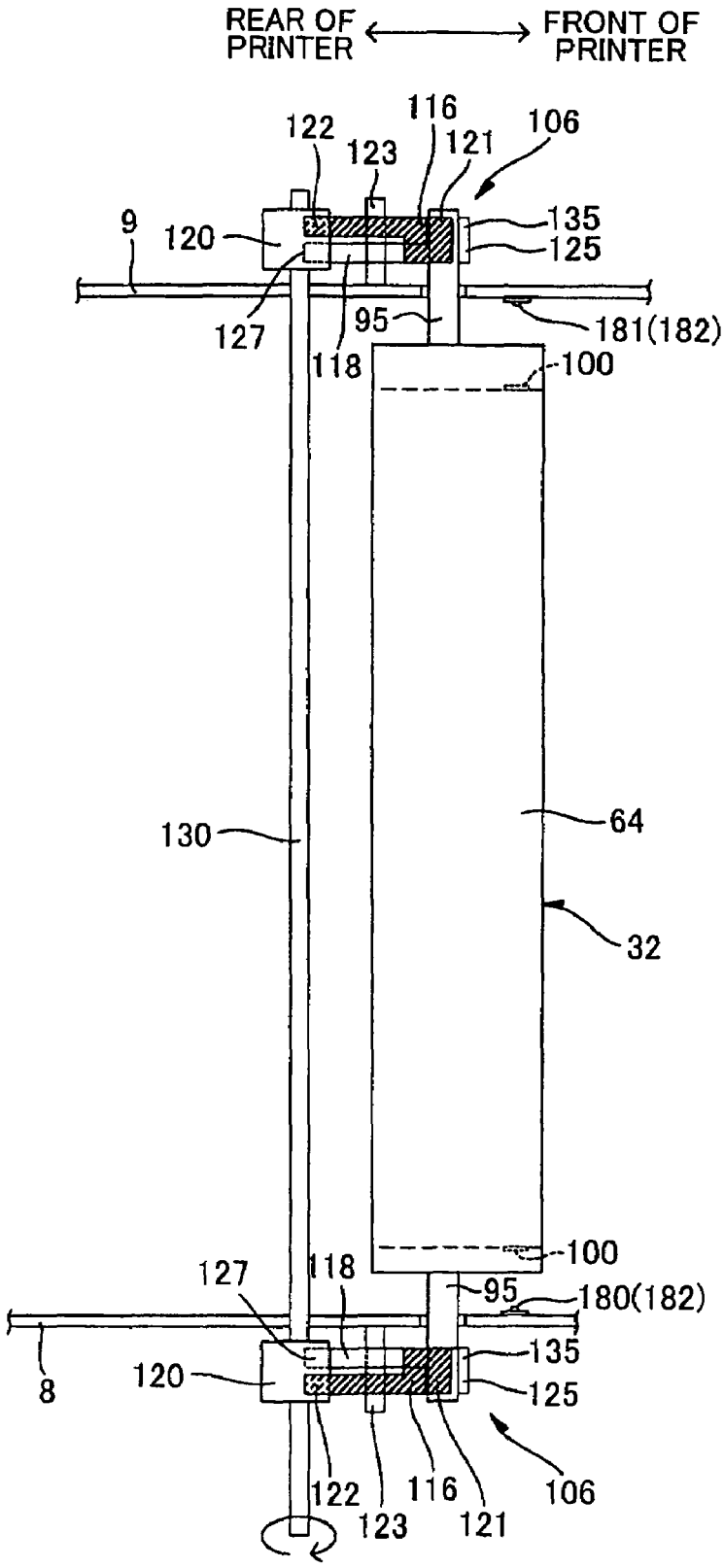
FIG. 24 is a plan view showing the mounted state of the developer cartridge in the process accommodating section (contact state)

Rotating the separating surfaces 132 of the cams 120 opposite the cam contact parts 122 and cam contacting protrusions 127 releases the pressing force of the contact surfaces 131, as shown in FIG. 21, FIG. 24 and FIG. 25. As a result, the first urging springs 117 contract due to their own restoring force, thereby urging the first pressing members 116 to rotate about the support shafts 123 so that the boss contact parts 121 advance into the moving path of the developer boss parts 95. In addition, the second urging springs 119 expand due to their own restoring force and urge the second pressing members 118 to rotate about the support shafts 123 so that the boss contact pawl parts 125 move downstream in the mounting direction of the developer boss parts 95 from their original positions in the separated state.

When the first pressing members 116 rotate, the upper pressing surfaces 134 of the boss contact parts 121 contact the developer boss parts 95 and press the developer boss parts 95 in the mounting direction of the developer boss parts 95 and toward the front edge of the boss insertion grooves 133. As the second pressing members 118 rotate, the boss contact pawl parts 125 move downstream in the mounting direction of the developer boss parts 95. The lower side pressing surfaces 135 of the boss contact pawl parts 125 are contacted by the developer boss parts 95, which are pressed by the upper pressing surfaces 134, and the second urging springs 119 elastically receive the developer boss parts 95.

Since the spring constant of the second urging spring 119 is set smaller than that of the first urging spring 117, the pressing force of the upper pressing surface 134 moves the developer boss part 95 downstream in the mounting direction from the original position of the developer boss part 95 in the separated state, and the lower side pressing surface 135 receives the developer boss part 95 as shown in FIGS. 24 and 25. When the developer boss part 95 is moved downstream in the mounting direction, the developing roller 67 contacts the photosensitive drum 42, thereby placing the photosensitive drum 42 and developing roller 67 in a contact state.

In the contact state, the developer boss part 95 contacts the front edge of the boss insertion groove 133 through the pressing force of the upper pressing surface 134. In addition, the first urging spring 117 and second urging spring 119 are urging the first pressing member 116 and second pressing member 118, respectively, so that a gap is formed between the separating surface 132 of the cam 120 and the cam contact part 122 of the first pressing member 116 and cam contacting protrusion 127 of the second pressing member 118.

When the developer cartridge 32 is in the contact position, the light-emitting unit 180 and light-receiving unit 181 face the corresponding detection windows 100 at the top ends thereof, as shown in FIGS. 21 and 25. As will be described later, when the developer cartridge 32 is at the contact position, the optical sensor 182 is operated to detect the amount of residual toner in the toner-accommodating chamber 92. As will be described later, the light-emitting unit 180 emits a detection light toward the light-receiving unit 181 so that the detection light travels along a path extending through an upper end of the detection windows 100. The upper end of the detection window 100 corresponds to an upper detection light transmitting point.

Next, the operation for shifting the developer cartridge 32 from the contact position to the separated position will be described. In the contact position, the separating surface 132 of the cam 120 faces the cam contact part 122 of the first pressing member 116 and the cam contact protrusion 127 of the second pressing member 118 with a gap therebetween. As described above, the cam 120 is rotated, bringing the contact surface 131 into contact with the cam contact part 122 of the first pressing member 116 and the cam contact protrusion 127 of the second pressing member 118.

When the contact surface 131 is opposing the cam contact part 122 and the cam contacting protrusion 127, as shown in FIG. 20, the contact surface 131 of the cam 120 contacts the cam contact part 122 of the first pressing member 116 and the cam contacting protrusion 127 of the second pressing member 118 and pushes the first pressing member 116 and the second pressing member 118 downward. As a result, the first pressing member 116 is rotated about the support shaft 123 against the urging force of the first urging spring 117, stretching the first urging spring 117 and retracting the boss contact part 121 from the moving path of the developer boss part 95. Further, the second pressing member 118 is rotated about the support shaft 123 by a pressing force larger than the urging force of the second urging spring 119, compressing the second urging spring 119 and moving the boss contact pawl part 125 upstream with respect to the mounting direction of the developer boss part 95.

Through the rotation of the first pressing member 116, the upper pressing surface 134 of the boss contact part 121 separates from the developer boss part 95. Through the rotation of the second pressing member 118, the boss contact pawl part 125 moves upstream with respect to the mounting direction of the developer boss part 95 so that the lower side pressing surface 135 of the boss contact pawl part 125 presses the developer boss part 95 in the removing direction, thereby separating the developing roller 67 from the photosensitive drum 42 so that the photosensitive drum 42 and developing roller 67 are in the separated state. Since the boss contact part 121 is retracted from the moving path of the developer boss part 95, the developer cartridge 32 can be removed from the developer-accommodating section 14.

When the developer cartridge 32 is in the separated position, the light-emitting unit 180 and light-receiving unit 181 face the respective detection windows 100 at the lower end thereof, as shown in FIGS. 20 and 23. As will be described later, also when the developer cartridge 32 is at the separated position, the optical sensor 182 is operated to detect the amount of residual toner in the toner-accommodating chamber 92. As will be described later, the light-emitting unit 180 emits a detection light toward the light-receiving unit 181 so as to pass through the bottom end of the detection window 100, serving as a lower detection light transmitting point.

In this way, the developing roller 67 and photosensitive drum 42 can be placed in contact during an image-forming operation and can be separated during a non-image-forming operation. Since the developing roller 67 and photosensitive drum 42 are placed in contact only when necessary, it is possible to extend the lives of these components.

By fitting the developer roller shaft 157 of the developing roller 67 into the developer positioning grooves 48 of the drum casing 41 when the developer cartridge 32 is mounted on the drum cartridge 31, the developer cartridge 32 can be positioned in relation to the drum cartridge 31 so that the developer cartridge 32 can be selectively switched between the separated position and the contact position in the developer-accommodating section 14.

The developer cartridge 32 can also be positioned in relation to the developer-accommodating section 14 by placing the contact protrusions 94 on the bottom wall 74 of the developer casing 64 in contact with a rear surface 33 of the partitioning plate 10. When the drum cartridge 31 is mounted in the drum-accommodating section 13, the photosensitive drum 42 is electrically grounded through a connection with contact points (not shown). During an image-forming operation, a charge bias is applied to the charger 62. Also during an image-forming operation, a driving force inputted from the motor 138 rotates the photosensitive drum 42 through the engagement of gears (not shown).

When the developer cartridge 32 is mounted in the developer-accommodating section 14, a connection is made with contact points (not shown), enabling a developing bias to be applied to the developer roller shaft 157 of the developing roller 67 during an image-forming operation. The motor 138 also inputs a driving force to rotate the agitator 69, supply roller 66, and developing roller 67 during an image-forming operation through couplings (not shown).

During an image-forming operation, toner accommodated in the toner-accommodating chamber 92 of each developer cartridge 32 corresponding to each color shifts vertically downward by its own weight toward the discharge opening 84 and is discharged through the discharge opening 84 as the agitator 69 rotates. Toner discharged through the discharge opening 84 is supplied onto the supply roller 66 and in turn is supplied onto the developing roller 67 as the supply roller 66 rotates. At this time, a developing bias is applied to the developing roller 67 and the toner is positively tribocharged between the supply roller 66 and the developing roller 67.

As the developing roller 67 rotates, the toner supplied to the surface of the developing roller 67 passes between the developer layer 158 of the developing roller 67 and the pressing part 162 of the thickness-regulating blade 68 so that the thickness-regulating blade 68 can regulate the toner carried on the surface of the developing roller 67 at a fixed thin layer.

In the meantime, a charge bias is applied to the charger 62 in the drum cartridge 31, causing the charger 62 to generate a corona discharge to apply a uniform positive charge to the surface of the photosensitive drum 42. As the photosensitive drum 42 rotates, the surface of the photosensitive drum 42 is exposed to the high-speed scan of a laser beam emitted from the scanning unit 30. The scanning unit 30 forms an electrostatic latent image on the surface of the photosensitive drum 42 corresponding to an image to be formed on the paper 3.

As the photosensitive drum 42 rotates further, the electrostatic latent image formed on the surface of the photosensitive drum 42 comes into contact with the positively charged toner carried on the surface of the developing roller 67. The toner on the surface of the rotating developing roller 67 is supplied to the latent image on the surface of the photosensitive drum 42, that is, is supplied to the exposed parts of the surface of the photosensitive drum 42 that have been exposed by the laser beam and, therefore, have a lower potential than other parts of the surface carrying a positive charge. In this way, the electrostatic latent image is developed into a visible toner image through a reverse developing process, and the toner image is carried on the surface of the photosensitive drum 42 for each color.

As shown in FIG. 1, the transfer section 28 is disposed in the main casing 2 above the feeder unit 4 and extends in the front-to-rear direction beneath the process-accommodating sections 12. The transfer section 28 includes a drive roller 166, a follow roller 167, the conveying belt 168, and transfer rollers 169. The drive roller 166 is disposed farther forward than the process-accommodating section 12 that accommodates the yellow process section 27Y. The follow roller 167 is disposed farther rearward than the process-accommodating section 12 that accommodates the black process section 27K.

The conveying belt 168 is an endless belt formed of a synthetic resin such as an electrically-conductive polycarbonate or polyimide containing dispersed conductive particles such as carbon. The conveying belt 168 is looped around the drive roller 166 and the follow roller 167. When the drive roller 166 is driven, the follow roller 167 follows the rotation of the drive roller 166, while the conveying belt 168 travels in a circuit between the drive roller 166 and follow roller 167. The outer surface of the conveying belt 168 opposes and contacts the photosensitive drum 42 in each process section 27 at an image-forming position and moves in the same direction as the surface of the photosensitive drum 42 at the point of contact.

The transfer rollers 169 are disposed inside the conveying belt 168 at positions opposing each photosensitive drum 42 with the conveying belt 168 interposed therebetween. The transfer rollers 169 are configured of a metal roller shaft covered with a roller part that is formed of an elastic material such as a conductive rubber material. The transfer rollers 169 are rotatably provided so that the surfaces of the transfer rollers 169 move in the same direction as the conveying belt 168 at the image-forming positions. A transfer bias is applied to the transfer rollers 169 during a transfer operation.

As described above, the conveying belt 168 moves in a circuit around the drive roller 166 and follow roller 167 when the drive roller 166 is driven and the follow roller 167 follows. When a sheet of paper 3 is supplied from the feeder unit 4, the conveying belt 168 conveys the paper 3 past each image-forming position between the conveying belt 168 and the photosensitive drum 42 of the process sections 27 in sequence in the rearward direction. As the conveying belt 168 conveys the paper 3, toner images in each color conveyed on the photosensitive drums 42 of each process section 27 are transferred sequentially onto the paper 3, thereby forming a multicolor image on the paper 3.

Specifically, first a yellow toner image carried on the surface of the photosensitive drum 42 in the yellow process section 27Y is transferred onto the paper 3. Next, a magenta toner image carried on the surface of the photosensitive drum 42 in the magenta process section 27M is transferred onto the paper 3 and superimposed over the yellow toner image. This operation is repeated for transferring and superimposing the cyan toner image carried on the surface of the photosensitive drum 42 in the cyan process section 27C and the black toner image carried on the surface of the photosensitive drum 42 in the black process section 27K, producing a multicolor image on the paper 3.

To form multicolor images in this way, the color laser printer 1 is configured as a tandem type device in which the drum cartridge 31 and developer cartridge 32 are provided as a set in each process sections 27, and a set is provided for each color. Accordingly, the color laser printer 1 of the preferred embodiment forms toner images in each color at about the same speed as required for forming monochrome images, thereby achieving rapid color image formation. Hence, the color laser printer 1 of the preferred embodiment can form color images while maintaining a compact shape.

The fixing section 29 is disposed in the main casing 2 at a position rearward of the process-accommodating section 12 accommodating the black process section 27K and is aligned in the front-to-rear direction with the image-forming positions at points of contact between the photosensitive drums 42 and the conveying belt 168. The fixing section 29 includes a heating roller 170 and a pressure roller 171.

The heating roller 170 is configured of a metal tube, the surface of which is coated with a release layer. The metal tube accommodates a halogen lamp that extends along the axis of the heating roller 170. The halogen lamp heats the surface of the heating roller 170 to a fixing temperature. The pressure roller 171 is disposed in confrontation with the heating roller 170 for applying pressure thereto.

After the toner images have been transferred onto the paper 3, the paper 3 is conveyed to the fixing section 29. The fixing section 29 fixes the color image onto the paper 3 with heat as the paper 3 passes between the heating roller 170 and the pressure roller 171.

The discharge unit 6 includes a U-shaped discharge path 172, discharge rollers 173, and a discharge tray 174.

The discharge path 172 has a curved U shape and functions as a path for conveying the paper 3. The upstream end of the discharge path 172 is the lower section of the discharge path 172 and is positioned adjacent to the fixing section 29 for feeding the paper 3 in a rearward direction, while the downstream end of the discharge path 172 is the upper section and is positioned adjacent to the discharge tray 174 for discharging the paper 3 forward.

The discharge rollers 173 are a pair of rollers disposed near the downstream end of the discharge path 172. The discharge tray 174 is a surface formed on the top of the main casing 2 that slopes downward from the front to the rear side.

After a multicolor image is fixed on the paper 3 in the fixing section 29, the paper 3 is conveyed into the upstream end of the discharge path 172 in the rearward direction. The U-shaped discharge path 172 reverses the conveying direction of the paper 3, and the discharge rollers 173 discharges the paper 3 forward onto the discharge tray 174.

During this type of image-forming operation, toner is consumed in each of the developer cartridges 32 corresponding to colors used for image formation. Since the toner in the toner-accommodating chamber 92 shifts vertically downward by its own weight toward the discharge opening 84 when the developer cartridge 32 is mounted in the developer-accommodating section 14, the toner level gradually drops from an initial full state as toner is consumed. Eventually, the toner level reaches a near-empty level, wherein the amount of residual toner is slightly greater than the amount of residual toner requiring the replacement of the developer cartridge 32.

When the toner level reaches the near empty level, a detection light emitted from the light-emitting unit 180 when the developer cartridge 32 is in the contact position shown in FIG. 25 can pass through the toner-accommodating chamber 92 at the upper ends of the detection windows 100, corresponding to the upper detection light transmitting points described later. As toner is consumed further, the toner level drops below the near empty level and eventually reaches an empty level, wherein the amount of residual toner is insufficient, requiring that the developer cartridge 32 be replaced.

When the toner level reaches the empty level, a detection light emitted from the light-emitting unit 180 when the developer cartridge 32 is in the separated position shown in FIG. 23 can pass through the toner-accommodating chamber 92 at the lower ends of the detection windows 100, corresponding to the lower detection light transmitting points described later. With the color laser printer 1 having this construction, the optical sensor 182 in each process section 27 can detect the near empty level and empty level in the toner-accommodating chamber 92 based on whether light emitted from the light-emitting unit 180 via the toner-accommodating chamber 92 and detection windows 100 is detected by the light-receiving unit 181. Through this operation, the color laser printer 1 can determine the amount of residual toner in the toner-accommodating chamber 92.

Figure 27:
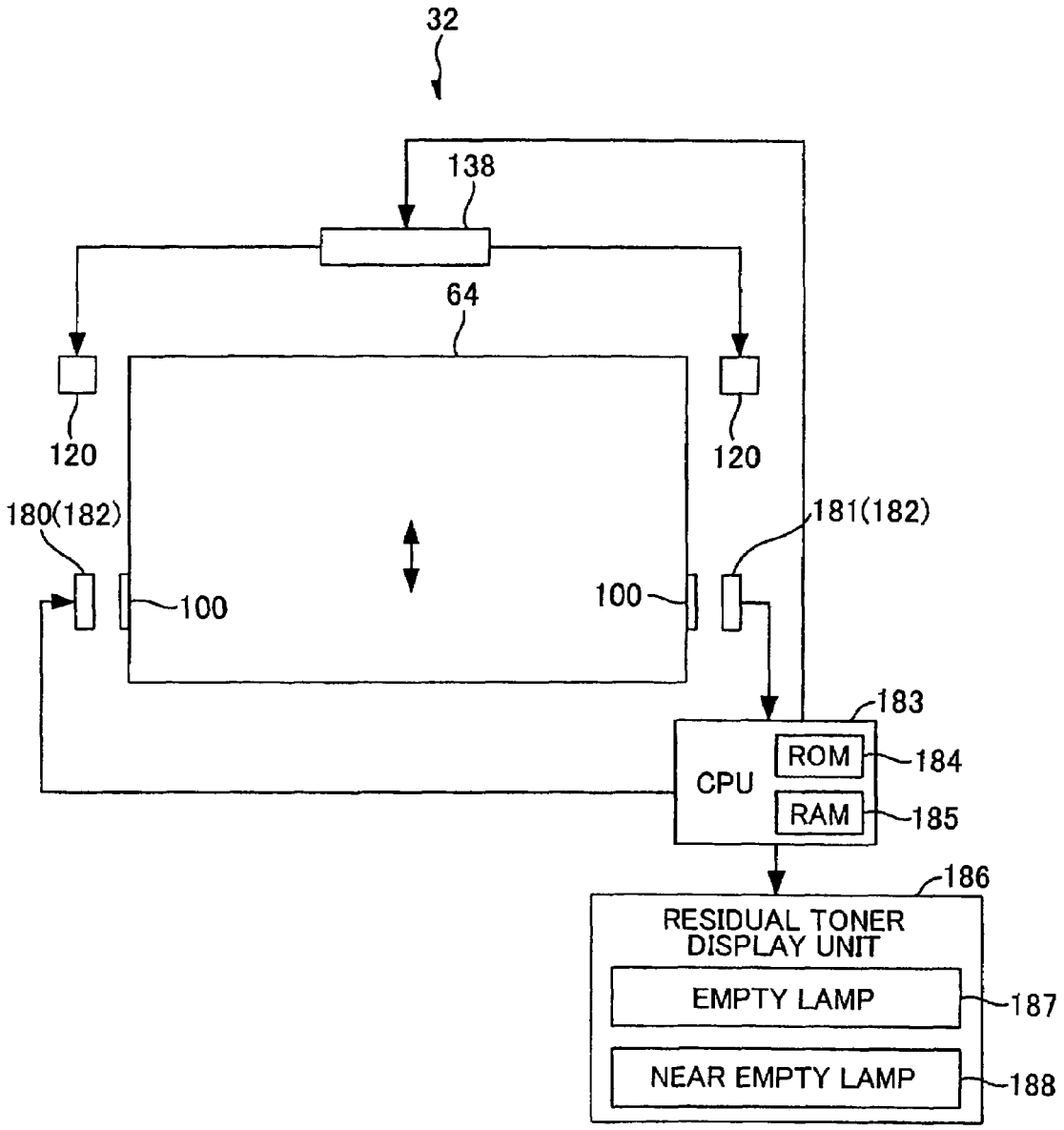
FIG. 27 is a block diagram showing a control system for determining the amount of residual toner.
Figure 28:
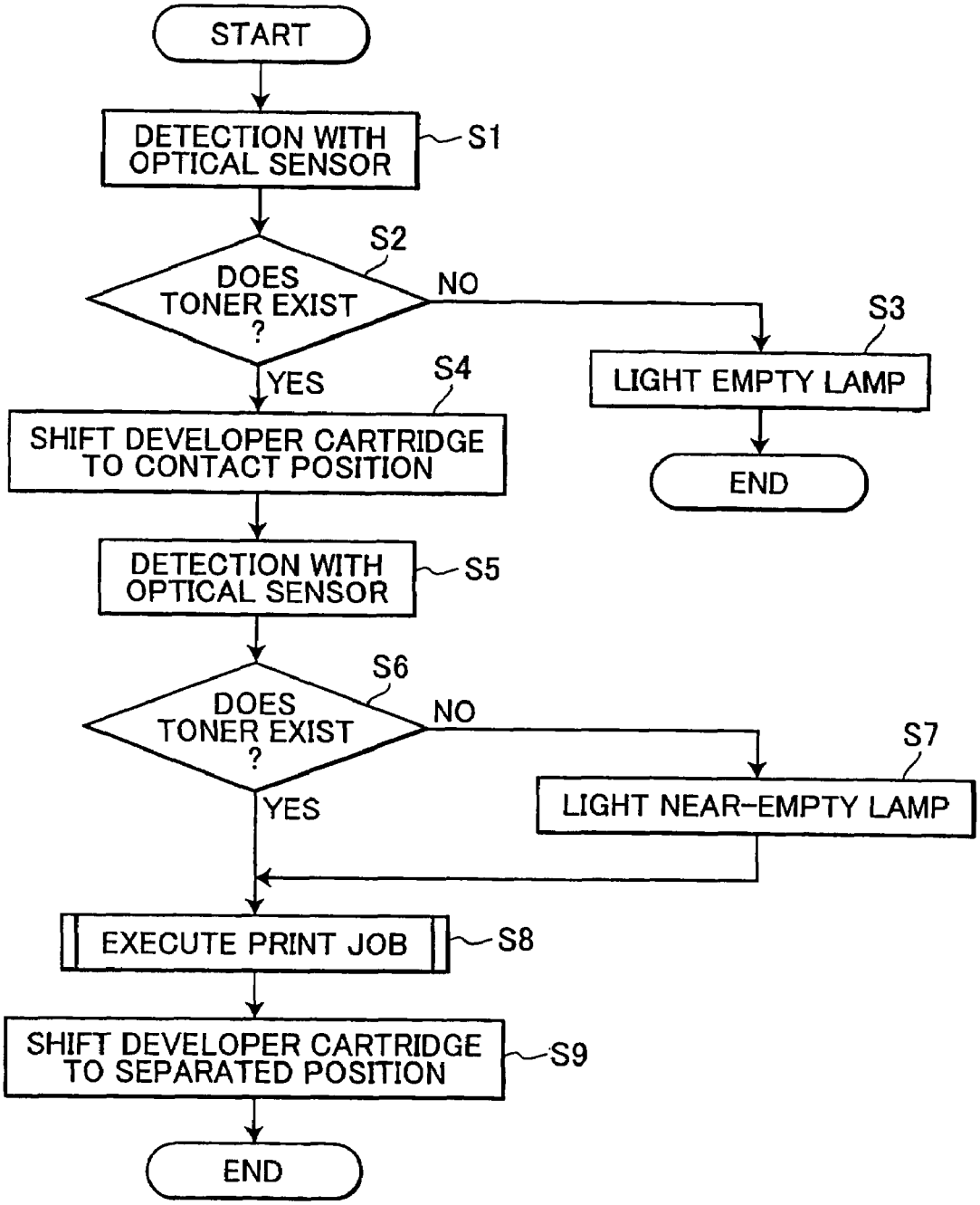
FIG. 28 is a flowchart illustrating steps in a computer program for determining the amount of residual toner.

FIG. 27 is a block diagram showing a control system for determining the amount of residual toner. FIG. 28 is a flowchart illustrating steps in a computer program for determining the amount of residual toner. Next, the control process for determining the amount of residual toner in the color laser printer 1 will be described with reference to FIGS. 27 and 28. The control process described below is performed independently for each developer cartridge 32 (unrelated to the other developer cartridges 32).

As shown in FIG. 27, the light-emitting unit 180 and light-receiving unit 181 constituting the optical sensor 182 are connected to a CPU 183. The CPU 183 includes a ROM 184 for storing various control programs, and a RAM 185 for temporarily storing numerical data when the CPU 183 executes the control programs. The ROM 184 also stores the program for determining residual toner.

The CPU 183 inputs emission signals into the light-emitting unit 180 and receives reception signals from the light-receiving unit 181. Hence, the CPU 183 controls the optical sensor 182 to determine the existence of toner in the toner-accommodating chamber 92. Specifically, the CPU 183 inputs an emission signal into the light-emitting unit 180 at a detection timing for the optical sensor 182. Upon receiving the emission signal inputted from the CPU 183, the light-emitting unit 180 emits the detection light toward the corresponding detection window 100. If the detection light passes through the toner-accommodating chamber 92, exits the far detection window 100, and is received from the light-receiving unit 181, the light-receiving unit 181 inputs a reception signal into the CPU 183. Upon receiving the input of a reception signal, the CPU 183 determines that toner does not exist. However, if the detection light transmitted through the toner-accommodating chamber 92 is blocked by toner in the toner-accommodating chamber 92, the detection light does not exit the far detection window 100 and is not received by the light-receiving unit 181. Accordingly, the CPU 183 does not receive a reception signal from the light-receiving unit 181 and therefore determines that toner exists.

As shown in FIG. 27, a residual toner display unit 186 is connected to the CPU 183. The residual toner display unit 186 is provided in a control panel (not shown) disposed on top of the main casing 2. The residual toner display unit 186 includes an empty lamp 187 and a near empty lamp 188. The residual toner display unit 186 is configured to receive a first lamp signal and a second lamp signal as input from the CPU 183.

The empty lamp 187 is lit when the toner in the toner-accommodating chamber 92 has reached the empty level. Specifically, when the CPU 183 determines that the toner level in the toner-accommodating chamber 92 has reached the empty level at which the developer cartridge 32 must be replaced, the CPU 183 inputs the first lamp signal into the residual toner display unit 186 to turn on the empty lamp 187. The near empty lamp 188 is lit when the toner in the toner-accommodating chamber 92 reaches the near empty level. Specifically, when the CPU 183 determines that the toner level in the toner-accommodating chamber 92 has reached the near empty level, indicating that the residual toner is near the level at which the developer cartridge 32 must be replaced, the CPU 183 inputs the second lamp signal into the residual toner display unit 186 to turn on the near empty lamp 188.

The CPU 183 is also connected to the motor 138, which inputs a driving force into the cams 120 described above. To perform an image-forming operation, the CPU 183 controls the driving of the motor 138 so that the cam 120 is rotated, shifting the developer cartridge 32 to the contact position. When not performing image formation, the CPU 183 controls the driving of the motor 138 so that the cam 120 rotates, shifting the developer cartridge 32 to the separated position.

Next, the process for determining the amount of residual toner in the toner-accommodating chamber 92 based on the program for determining residual toner will be described with reference to the flowchart in FIG. 28. In FIG. 28, the process according to the program for determining residual toner begins when the developer cartridge 32 is moved from the separated position to the contact position, i.e., when a print job is inputted to the CPU 183, or when the CPU 183 begins an initialization operation.

At the beginning of this process, the developer cartridge 32 is in the separated position. In S1 the CPU 183 controls the optical sensor 182 to perform a detection while the developer cartridge 32 is in the separated position shown in FIG. 23. In S2 the CPU 183 determines if toner exists.

When the optical sensor 182 performs detection while the developer cartridge 32 is in the separated position, the light-emitting unit 180 emits the detection light toward the light-receiving unit 181 so as to pass through the lower ends of the detection windows 100 (hereinafter, referred to as the "lower detection light transmitting point") as shown in FIG. 20.

If the light-receiving unit 181 receives the detection light, the CPU 183 determines that no toner exists (S2: NO). In this case, the CPU 183 inputs the first lamp signal to the residual toner display unit 186 in S3, turning on the empty lamp 187. Subsequently the process ends.

Specifically, the lower detection light transmitting point is positioned so that the detection light can pass when the toner level in the toner-accommodating chamber 92 is at the empty level, that is, when the developer cartridge 32 should be replaced. Accordingly, when the detection light emitted from the light-emitting unit 180 passes through the lower detection light transmitting point and is received by the light-receiving unit 181, indicating that the residual toner in the toner-accommodating chamber 92 is such that the developer cartridge 32 needs replacing, the empty lamp 187 is lit to notify the user that the developer cartridge 32 needs replacing.

However, if the light-receiving unit 181 does not receive the detection light, the CPU 183 determines that toner exists (S2: YES). In this case, the CPU 183 drives the motor 138 to rotate the cam 120 in S4, shifting the developer cartridge 32 from the separated position to the contact position. In S5 the CPU 183 controls the optical sensor 182 to perform a detection when the developer cartridge 32 is in the contact position shown in FIG. 25. In S6 the CPU 183 determines whether toner exists in the toner-accommodating chamber 92.

When the optical sensor 182 performs a detection while the developer cartridge 32 is in the contact position, the light-emitting unit 180 emits the detection light toward the light-receiving unit 181 so as to pass through the toner-accommodating chamber 92 in the upper ends of the detection windows 100 (hereinafter referred to as the "upper detection light transmitting point"), as shown in FIG. 21. If the light-receiving unit 181 receives the detection light, then the CPU 183 determines that toner does not exist (S6: NO). In this case, the CPU 183 inputs the second lamp signal into the residual toner display unit 186 in S7, turning on the near empty lamp 188, and subsequently executes the print job in S8.

Specifically, the upper detection light transmitting point is positioned so that the detection light can pass even if the toner remaining in the toner-accommodating chamber 92 is not so low as to require replacement of the developer cartridge 32 but is slightly greater than the amount necessitating replacement. Accordingly, when the detection light emitted from the light-emitting unit 180 passes through the upper detection light transmitting point and is received by the light-receiving unit 181, indicating that the level of toner remaining in the toner-accommodating chamber 92 is slightly greater than the amount necessitating replacement of the developer cartridge 32, the near empty lamp 188 is lighted to warn the user that the developer cartridge 32 will need to be replaced soon.

However, if the light-receiving unit 181 does not receive the detection light, then the CPU 183 determines that toner exists (S6: YES) and executes the print job in S8 without inputting the second lamp signal into the residual toner display unit 186 to light the near empty lamp 188. In other words, when the detection light emitted from the light-emitting unit 180 does not pass through the upper detection light transmitting point, but is blocked by toner in the toner-accommodating chamber 92, then the amount of toner in the toner-accommodating chamber 92 is greater than the near empty level. Hence, image formation can be performed normally without warning the user about the amount of residual toner.

After executing the print job, the CPU 183 drives the motor 138 to rotate the cams 120 in S9, shifting the developer cartridge 32 from the contact position to the separated position. Subsequently the process ends.

In this process for determining residual toner, the light-emitting unit 180 emits the detection light toward the light-receiving unit 181 through the upper detection light transmitting point and the lower detection light transmitting point. Therefore, if an abnormality occurs at one of these two transmitting points, resulting in an incorrect detection, a correct detection can still be made at the other normal detection light transmitting point, thereby achieving accuracy in determining the amount of residual toner.

In the process for determining residual toner described above, the CPU 183 can determine the amount of residual toner based on the results of light received via the upper detection light transmitting point and the lower detection light transmitting point, enabling the amount of residual toner to be determined with accuracy. More specifically, the CPU 183 determines the amount of residual toner based on the upper detection light transmitting point and the lower detection light transmitting point, and the results of received light corresponding to the upper detection light transmitting point and the results of the received light corresponding to the lower detection light transmitting point, enabling the CPU 183 to determine the amount of residual toner in detail.

In the process for determining the amount of residual toner described above, the CPU 183 lights the near empty lamp 188 when the level of toner reaches the near empty level and lights the empty lamp 187 when the level of toner reaches the empty level. Therefore, the color laser printer 1 can notify the user of the amount of residual toner with precision and in stages based on the determinations made by the CPU 183.

In the process for determining the amount of residual toner described above, the detection light can be transmitted through the pair of detection windows 100 at an upper detection light transmitting point in the upper end and a lower detection light transmitting point in the lower end. Accordingly, a lower rate of toner leaks from the detection windows 100 with this construction than when two pairs of detection windows 100 are provided in correspondence with the upper detection light transmitting point and the lower detection light transmitting point independently.

Since the upper detection light transmitting point and the lower detection light transmitting point are provided at intervals along the vertical, the color laser printer 1 can accurately detect the amount of residual toner as the toner level drops along with toner consumption. In this way, the amount of residual toner can be detected even more accurately.

In the process for determining the amount of residual toner described above, the upper detection light transmitting point and the lower detection light transmitting point are switched by moving the developer cartridge 32 between the separated position and the contact position. This construction eliminates the need to provide the optical sensor 182 for each of the upper detection light transmitting point and lower detection light transmitting point, thereby simplifying the structure of the device and reducing manufacturing costs.

Further, the developer cartridges 32 are mounted in the developer-accommodating sections 14 at a slant to the vertical that slopes downward from the front side to the rear side and shifted between the separated position and the contact position along the mounting direction for a non-image-forming process and an image-forming process, respectively. The upper detection light transmitting point and lower detection light transmitting point are effectively switched along the vertical as the developer cartridge 32 is shifted diagonally upward and downward, thereby achieving accurate detection of the detection light through a simple construction.

Switching between the upper detection light transmitting point and the lower detection light transmitting point by moving the developer cartridge 32 with the contacting/separating mechanism 106 eliminates the need for a special switching device to switch between the two transmitting points. This configuration achieves a simple and reliable structure at a low cost that can switch between the upper detection light transmitting point and the lower detection light transmitting point.

Moreover, in the process for determining the amount of residual toner described above, the CPU 183 determines the amount of residual toner at the timing in which the developer cartridge 32 is moved from the separated position to the contact position, that is, the timing for switching from the lower detection light transmitting point to the upper detection light transmitting point as the contacting/separating mechanism 106 moves the developer cartridge 32. Hence, the amount of residual toner can be detected at an appropriate timing and with even greater accuracy.

In the process for determining the amount of residual toner described above, when the developer cartridge 32 arrives at the separated position and the contact position, that is, the upper and lower ends within the maximum range of the developer cartridge 32, the optical sensor 182 transmits the detection light at the upper detection light transmitting point and the lower detection light transmitting point corresponding to the upper and lower ends of the elongated detection window 100 to detect the existence of toner. This configuration allocates a wide range for detecting the amount of residual toner enabling the toner to be detected appropriately.

Forming the detection windows 100 in the developer cartridge 32 so as to have a substantially elliptical shape in a side view facilitates provision of the upper and lower detection light transmitting points using a simple construction. Moreover, by forming the detection windows 100 in a substantially elliptical shape that is elongated vertically when the developer cartridge 32 is mounted in the developer-accommodating section 14, it is possible to detect the level of toner with accuracy.

The toner-accommodating chamber 92 has the discharge opening 84 formed at one end for discharging developer. The detection windows 100 are formed in an elongated shape extending in a range that is defined between the front end of the developer-accommodating chamber 92 at which the discharge opening 84 is formed and the opposite, rear end. The lower detection light transmitting points and the upper detection light transmitting points are defined in the detection windows 100. With this construction, the amount of developer discharged through the discharge opening 84 can be accurately detected, enabling the amount of residual developer to be more accurately detected.

Since the detection windows 100 are formed at positions in the front side walls 75 corresponding to each other in the widthwise direction, the detection light can be introduced through the detection window 100 provided on one front side wall 75 and outputted through the detection window 100 provided on the other front side wall 75, enabling the amount of residual toner in the toner-accommodating chamber 92 to be detected with accuracy.

In the process for determining residual toner described above, the existence of toner is detected by transmitting a detection light at the upper detection light transmitting point and the lower detection light transmitting point. However, the optical sensor 182 may detect the existence of toner continuously in the vertical direction between the top end and bottom end of the detection window 100 as the developer cartridge 32 is shifted between the separated position and the contact position, for example, and the toner level in the toner-accommodating chamber 92 can be displayed as a percentage.

Figure 29:
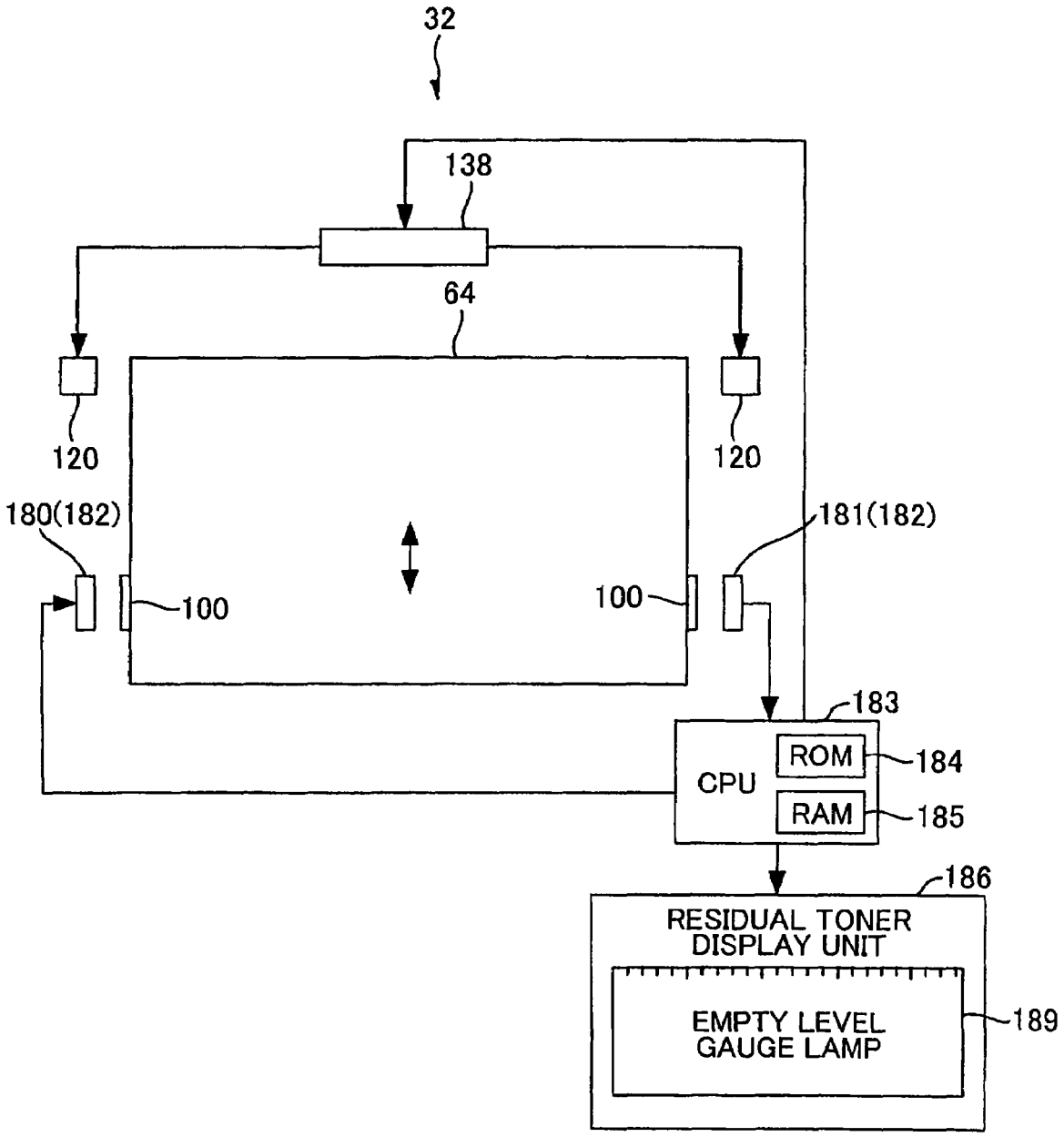
FIG. 29 is a block diagram showing a control system for executing a program to display the amount of residual toner according to a second embodiment of the present invention.
Figure 30:
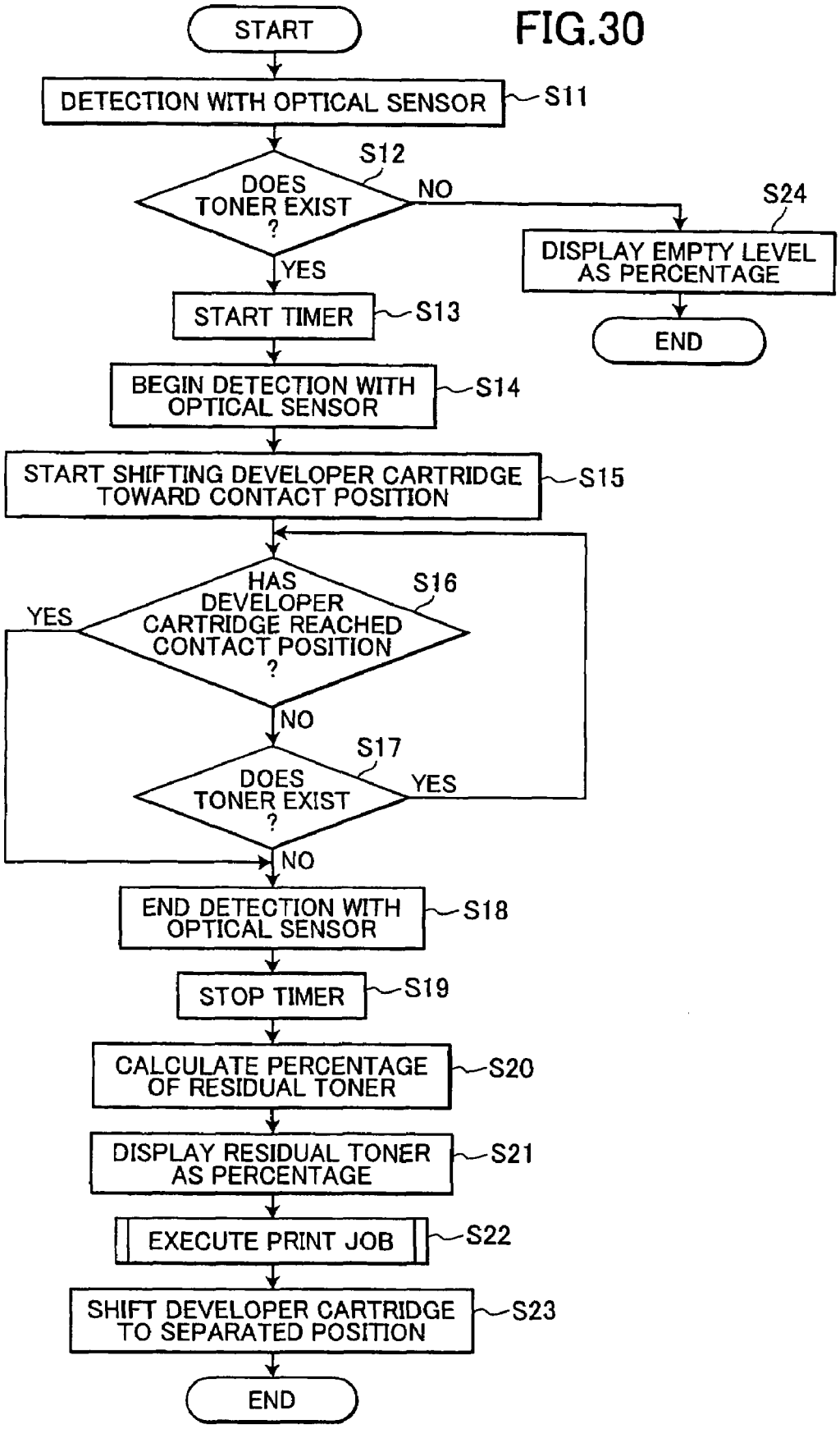
FIG. 30 is a flowchart illustrating steps in the program for displaying the amount of residual toner according to the second embodiment.

FIG. 29 is a block diagram showing a control system for executing a program to display the amount of residual toner according to a second embodiment of the present invention, wherein like parts and components are designated with the same reference numerals to avoid duplicating description. FIG. 30 is a flowchart illustrating steps in the program for displaying the amount of residual toner.

As shown in FIG. 29, an empty level gauge lamp 189 is provided in the residual toner display unit 186 in place of the empty lamp 187 and near empty lamp 188 of the first embodiment. When the CPU 183 inputs a level signal corresponding to the amount of residual toner into the residual toner display unit 186, the empty level gauge lamp 189 displays the amount of residual toner in the toner-accommodating chamber 92 as a percentage.

Next, the process for displaying the amount of residual toner in the toner-accommodating chamber 92 will be described with reference to FIG. 30. As with the program for determining the amount of residual toner, the process of the program for displaying the amount of residual toner in FIG. 30 begins at a timing that the developer cartridge 32 moves from the separated position to the contact position, such as when a print job is inputted into the CPU 183 or when the CPU 183 begins an initialization operation. At the beginning of this process, the developer cartridge 32 is in a separated position.

In S11 the CPU 183 controls the optical sensor 182 to execute a detection while the developer cartridge 32 is in the separated position shown in FIG. 23. In S12 the CPU 183 determines whether toner exists. If the CPU 183 determines that toner does not exist (S12: NO), then in S24 the CPU 183 inputs an empty level signal into the residual toner display unit 186 (a level signal corresponding to a specific percentage range (empty level) at which the developer cartridge 32 must be replaced), causing the empty level gauge lamp 189 to display the specific percentage range of the empty level. For example, the specific percentage range is defined as a range lower than or equal to a specific low level of percentage. Subsequently the process ends.

However, if the CPU 183 determines that toner does exist (S12: YES), then in S13 the CPU 183 starts a timer that is built in the CPU 183. At the same time, the CPU 183 controls the optical sensor 182 to begin detection in S14. Subsequently, in S15 the CPU 183 starts driving the motor 138 to rotate the cams 120, shifting the developer cartridge 32 from the separated position to the contact position. In S16, the CPU 183 judges whether or not the developer cartridge 32 has reached the contact position. While the developer cartridge 32 has not yet reached the contact position (no in S16), the CPU 183 determines the existence of toner in S17. When toner exists (yes in S17), the program returns to S16. Thus, while the developer cartridge 32 is continuously moving toward the contact position (no in S16), the optical sensor 182 continuously executes detections and the CPU 183 repeatedly determines the existence of toner in S17.

When the developer cartridge 32 reaches the contact position while toner remains existing (yes in S16), the program proceeds directly from S16 to S18 without executing S17 any more. The CPU 183 stops driving the motor 138 and stops rotating the cams 120.

On the other hand, when the CPU 183 determines that no toner exists before the developer cartridge 32 reaches the contact position (S17: NO), the program proceeds from S17 to S18.

In S18, the CPU 183 halts detections by the optical sensor 182. At the same time, in S19, the CPU 183 stops the built-in timer. It is noted that the motor 138 continues moving the developer cartridge 32 until the developer cartridge 32 reaches the contact position.

In S20 the CPU 183 calculates the amount of residual toner in the toner-accommodating chamber 92 as a percentage based on the count value of the timer, that is, the length of time when the detection light has passed through the toner-accommodating chamber 92, and inputs a level signal corresponding to this percentage into the residual toner display unit 186. In S21 the empty level gauge lamp 189 displays the percentage level for the amount of residual toner in the toner-accommodating chamber 92 corresponding to the level signal received from the CPU 183.

It is noted that if the developer cartridge 32 has reached the contact position while toner remains existing (yes in S16), the CPU 183 may calculate in S20 the amount of residual toner as a range higher than or equal to some high percentage level based on the count value of the timer, and the empty level gauge lamp 189 may indicate in S21 the range higher than or equal to the high percentage level.

In S22 the CPU 183 executes the print job. In S23 the CPU 183 drives the motor 138 to rotate the cams 120, shifting the developer cartridge 32 from the contact position to the separated position. Subsequently the process ends.

In the program for displaying the amount of residual toner described above, the optical sensor 182 continually irradiates a detection light through the detection light transmitting point in the detection windows 100 along the moving path of the developer cartridge 32 as the developer cartridge 32 is moved from the separated position to the contact position so that the existence of toner is detected continuously. Accordingly, it is possible to display the amount of residual toner in the toner-accommodating chamber 92 as a percentage, thereby achieving a more accurate detection of the amount of residual toner.

In the color laser printer 1 described above, the forward direction in which the pickup roller 22 picks up the paper 3 is opposite the rearward direction in which the paper 3 is conveyed past the image-forming positions. Further, the rearward direction in which the paper 3 is conveyed past the image-forming positions is opposite the forward direction in which the discharge rollers 173 discharge the paper 3. This construction enables the device to be made compact while providing conveying paths for the paper 3.

In the color laser printer 1 of the preferred embodiment described above, the drum cartridge 31 and developer cartridge 32 are mounted in the drum-accommodating section 13 and developer-accommodating section 14 of each process-accommodating section 12 at a slant to the front-to-rear direction (conveying direction of the paper 3 that is being conveyed while being formed with images) and the vertical direction (thickness direction of the paper 3 that is being conveyed while being formed with images). More specifically, the drum cartridge 31 and the developer cartridge 32 are mounted in a direction that slopes rearward from top to bottom. This construction can improve the operability of mounting and removing the drum cartridge 31 and developer cartridge 32.

In the color laser printer 1, the plurality of sets of the drum cartridge 31 and developer cartridge 32 are disposed alternately with the plurality of scanning units 30 in the front-to-rear direction, thereby achieving an efficient arrangement that can produce a compact device.

Although the present invention has been described with respect to specific embodiments, it will be appreciated by one skilled in the art that a variety of changes may be made without departing from the scope of the invention.

For example, in the embodiments described above, the detection windows 100 are formed in a substantially elliptical shape extending substantially vertically when the developer cartridge 32 is mounted in the developer-accommodating section 14. However, the detection windows 100 may also be formed in a substantially rectangular shape elongated substantially in the vertical direction, for example. This construction also facilitates provision of the upper and lower detection light transmitting points using a simple construction.

In the preferred embodiments described above, the existence of toner is determined based on whether the detection light is transmitted through the detection windows 100 or blocked by the toner. However, the existence of toner may be determined based on a light-transmitting time when the agitator 69 is rotated. Specifically, when the agitator 69 is rotated to agitate the toner, the detection window 100 is periodically blocked by the agitated toner. Therefore, the detection light is periodically blocked so that the transmitting time of the detection light is intermittently restricted. However, by providing a threshold for the transmitting time of the detection light, it is possible to determine the existence of toner based on this threshold.

In the preferred embodiments described above, the residual toner display unit 186 reports the amount of residual toner using the empty lamp 187 and near empty lamp 188 or the empty level gauge lamp 189, but is not restricted to this method. For example, the amount of residual toner may be reported to a host computer functioning to operate the color laser printer 1 by inputting signals related to the amount of residual toner and notifying the user with sound (such as a beep).

In the preferred embodiments described above, a single optical sensor 182 is provided to detect the amount of residual toner for each developer cartridge 32 moved between the contact position and the separated position. However, a plurality of optical sensors 182 may be provided for each developer cartridge 32. For example, a plurality of optical sensors 182 may be provided at intervals along the vertical corresponding to the detection windows 100, while the developer cartridge 32 is not moved. However, detecting the amount of residual toner with a single optical sensor 182 as in the embodiments described above achieves a lower cost than when a plurality of the optical sensors 182 are provided.

In the preferred embodiments described above, the drum cartridge 31 and developer cartridge 32 are configured as separate members, but these members may also be integrally configured.

Further, in the preferred embodiments described above, the CPU 183 detects the amount of residual toner as the developing roller 67 is separated and placed in contact with the photosensitive drum 42 in the developer cartridge 32. However, separate control can be performed to move the developer cartridge 32 for the purpose of detecting the amount of residual toner, but the control process is simplified by detecting the amount of residual toner while the developer cartridge 32 is moved between the separated position and the contact position.

In the preferred embodiments described above, the optical sensor 182 is fixed to the main casing 2. However, the developer cartridge 32 may not be moved, but the optical sensor 182 may be moved instead. However, the method of moving the developer cartridge 32 described in the preferred embodiments achieves a simpler construction than when moving the optical sensor 182.

The preferred embodiments are related to a tandem-type color laser printer 1 for directly transferring toner images from each photosensitive drum 42 to the paper 3, but the present invention is not limited to this device. For example, the present invention may be applied to an intermediate transfer-type color laser printer that transfers toner images in each color from the respective photosensitive members to an intermediate transfer member temporarily and subsequently transfers the entire color image to the paper. The present invention may also be applied to a monochrome laser printer.

What is claimed is:

1. An image-forming device, comprising:

a developer-accommodating section that accommodates a developer, the developer-accommodating section defining a plurality of detection light transmitting points through which a detection light is transmitted to detect an amount of developer accommodated in the developer-accommodating section; and a residual developer detecting unit that has a light-emitting unit that irradiates a detection light through one of the detection light transmitting points and a light-receiving unit that receives the detection light that has passed through the subject one detection light transmitting point, wherein the developer-accommodating section is movably disposed, and the detection light transmitting points are switched through movement of the developer-accommodating section, the detection light transmitting points including at least a first detection light transmitting point and a second detection light transmitting point that is spaced from the first detection light transmitting point, wherein the image-forming device further comprises a determining unit that determines the amount of developer in the developer-accommodating section, and wherein the determining unit includes:

a first control unit that controls the light-emitting unit to irradiate the detection light through the first detection light transmitting point, and that determines the amount of developer in the developer-accommodating section based on a detection result indicating whether the light-receiving unit has received the detection light that has passed through the first detection light transmitting point;

a moving unit that selectively moves the developer-accommodating section, dependently on a determining result of the first control unit, to switch the detection light transmitting points, thereby enabling the light-emitting unit to irradiate the detection light through the second detection light transmitting point; and a second control unit that controls the light-emitting unit to irradiate the detection light through the second detection light transmitting point, and that determines the amount of developer in the developer-accommodating section based on a detection result indicating whether the light-receiving unit has received the detection light that has passed through the second detection light transmitting point.

2. The image-forming device as claimed in claim 1, further comprising a reporting unit that reports the amount of developer remaining in the developer-accommodating section based on the results of the determination performed by the determining unit.

3. The image-forming device as claimed in claim 1, wherein the developer-accommodating section comprises detection windows through which the detection light enters and exits, all of the detection light transmitting points being provided within the same detection windows.

4. The image-forming device as claimed in claim 1, wherein the detection light transmitting points are spaced at intervals in a vertical direction.

5. The image-forming device as claimed in claim 1, wherein the developer-accommodating section moves substantially vertically, and the detection light transmitting points are switched substantially in the vertical direction through the substantially vertical movement of the developer-accommodating section.

6. The image-forming device as claimed in claim 1, wherein the developer-accommodating section moves within a maximum range; the light-emitting unit emits detection light at the first detection light transmitting point when the developer-accommodating section arrives at one end of the maximum range of movement; and the light-emitting unit emits detection light at the second detection light transmitting point when the developer-accommodating section arrives at the other end of the maximum range of movement.

7. The image-forming device as claimed in claim 1, further comprising:

a developer cartridge comprising a developer carrying member that carries a developer, and the developer-accommodating section;

a photosensitive member; and a contacting/separating unit that moves the developer cartridge so that the developer carrying member contacts or separates from the photosensitive member;

wherein the detection light transmitting points are switched through movement of the developer-accommodating section as the contacting/separating unit moves the developer cartridge.

8. The image-forming device as claimed in claim 7, wherein the light-receiving unit of the residual developer detecting unit receives the detection light at a timing synchronized with the switching of the detection light transmitting points, the detection light transmitting points being switched through movement of the developer-accommodating section as the contacting/separating unit moves the developer cartridge; and a determining unit determines the amount of developer remaining in the developer-accommodating section based on the results of the received light.

9. The image-forming device as claimed in claim 7, wherein the developer cartridge includes a plurality of developer cartridges for a plurality of colors, and the photosensitive member includes a plurality of photosensitive members, further comprising a plurality of photosensitive member cartridges, each comprising a corresponding one of the photosensitive members, wherein a plurality of sets of the photosensitive member cartridges and the developer cartridges correspond to the number of colors, each set including one each of the photosensitive member cartridges and developer cartridges.

10. The image-forming device as claimed in claim 9, further comprising:

a housing in which the plurality of sets of the photosensitive member cartridges and the developer cartridges are mounted;

a feeding unit that picks up and feeds a recording medium;

a conveying unit that conveys the recording medium through the housing to form images sequentially with the plurality of sets of the photosensitive member cartridges and developer cartridges; and a discharging unit that discharges the recording medium from the housing;

wherein a pickup direction in which the feeding unit picks up and feeds the recording medium is opposite a conveying direction in which the conveying unit conveys the recording medium through the housing to form images sequentially with the plurality of sets of the photosensitive member cartridges and developer cartridges, and the conveying direction is opposite a discharging direction in which the discharging unit discharges the recording medium from the housing.

11. The image-forming device as claimed in claim 10, wherein the photosensitive member cartridges and the developer cartridges are mounted in and removed from the housing in a direction that is slanted both with respect to the conveying direction for conveying the recording medium through the housing and a thickness direction of the recording medium orthogonal to the conveying direction.

12. The image-forming device as claimed in claim 10, further comprising a plurality of exposing devices corresponding to the plurality of sets of the photosensitive member cartridges and the developer cartridges, the plurality of sets of photosensitive cartridges and developer cartridges being arranged in an alternating relationship with the corresponding exposing devices along the conveying direction for conveying the recording medium through the housing.

13. An image-forming device as claim 1, wherein the second detection light transmitting point is spaced from the first detection light transmitting point in a vertical direction.

14. An image-forming device, comprising:

a developer-accommodating section that accommodates a developer, the developer-accommodating section defining a plurality of detection light transmitting points through which a detection light is transmitted to detect an amount of developer accommodated in the developer-accommodating section; and a residual developer detecting unit that has a light-emitting unit that irradiates a detection light through one of the detection light transmitting points and a light-receiving unit that receives the detection light that has passed through the subject one detection light transmitting point, wherein the developer-accommodating section is movably disposed, and the detection light transmitting points are switched through movement of the developer-accommodating section, wherein the light-emitting unit emits a detection light continuously while the developer-accommodating section moves along a path, the plurality of detection light transmitting points being arranged along the path.

15. A cartridge that can be detachably mounted in an image-forming device, the image-forming device being capable of outputting a detection light at a plurality of different positions for detecting the amount of developer accommodated in the cartridge, the cartridge comprising:

a developer-accommodating section that accommodates developer, the developer-accommodating section including a plurality of detection light transmitting points corresponding to the positions, at which the image-forming device outputs the detection light, to transmit the detection light and the developer-accommodating section has a discharge opening that is formed at one end to discharge developer; and detection windows through which the detection light is transmitted to detect the amount of developer accommodated in the developer-accommodating section, the detection windows being formed in an elongated shape extending between the end of the developer-accommodating section at which the discharge opening is formed and the opposite end, wherein the plurality of detection light transmitting points is defined in the detection windows.

16. The cartridge as claimed in claim 15, wherein the detection windows are formed in either a substantially elliptical shape or a substantially rectangular shape.

17. The cartridge as claimed in claim 15, wherein the discharge opening extends in a longitudinal direction;

the developer-accommodating section comprises side walls disposed opposite one another on both longitudinal ends of the discharge opening; and the detection windows are formed one in each of the side walls, opposing each other in the longitudinal direction of the discharge opening.

18. The cartridge as claimed in claim 15, further comprising a developing section that includes a developing member that performs developing operation with the developer supplied from the developer-accommodating section.

19. A cartridge that can be detachably mounted in an image-forming device, the image-forming device being capable of outputting a detection light at a plurality of different positions for detecting the amount of developer accommodated in the cartridge, the cartridge comprising:

a developer-accommodating section that accommodates developer, the developer-accommodating section including a plurality of detection light transmitting points corresponding to the positions, at which the image-forming device outputs the detection light, to transmit the detection light, wherein the developer-accommodating section is movably disposed, and the detection light transmitting points are switched through movement of the developer-accommodating section.

20. An image forming device, comprising:

a residual developer detection light transmitter;

a residual developer detection light receiver, wherein said transmitter and receiver form a light path therebetween;

a central processing unit configured to cause an image forming device cartridge to move between first and second resting positions, wherein said light path passes through a first pair of residual developer detection light transmitting points of a cartridge when said cartridge is in said first resting position, and wherein said light path passes through a second pair of residual developer detection light transmitting points when said cartridge is in said second resting position.

* * * * *